US007345666B2

(12) United States Patent
Kubo et al.

(10) Patent No.: US 7,345,666 B2
(45) Date of Patent: Mar. 18, 2008

(54) LIQUID CRYSTAL DISPLAY APPARATUS AND LIQUID CRYSTAL TELEVISION AND LIQUID CRYSTAL MONITOR ADOPTING SAME

(75) Inventors: Masumi Kubo, Ikoma (JP); Tomoo Furukawa, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 524 days.

(21) Appl. No.: 11/001,503

(22) Filed: Dec. 2, 2004

(65) Prior Publication Data

US 2005/0122296 A1 Jun. 9, 2005

(30) Foreign Application Priority Data

Dec. 5, 2003 (JP) ..... 2003-408080

(51) Int. Cl.
*G09G 3/36* (2006.01)

(52) U.S. Cl. ..... 345/89; 345/87; 345/99; 345/100; 349/129

(58) Field of Classification Search ..... 349/129, 349/130, 193
See application file for complete search history.

(56) References Cited

U.S. PATENT DOCUMENTS

| | | | | |
|---|---|---|---|---|
| 6,882,351 | B2 * | 4/2005 | Morita | 345/690 |
| 2001/0033260 | A1 * | 10/2001 | Nishitani et al. | 345/87 |
| 2001/0038371 | A1 * | 11/2001 | Yoshinaga et al. | 345/87 |
| 2001/0038372 | A1 | 11/2001 | Lee | |
| 2002/0024481 | A1 | 2/2002 | Kawabe et al. | |
| 2002/0033789 | A1 | 3/2002 | Miyata et al. | |
| 2002/0075433 | A1 | 6/2002 | Nishio et al. | |
| 2002/0080101 | A1 * | 6/2002 | Asao et al. | 345/87 |
| 2002/0140652 | A1 | 10/2002 | Suzuki et al. | |
| 2002/0158825 | A1 * | 10/2002 | Endo et al. | 345/87 |
| 2003/0058264 | A1 | 3/2003 | Takako et al. | |

(Continued)

FOREIGN PATENT DOCUMENTS

EP 0 884 626 A2 12/1998

(Continued)

*Primary Examiner*—Richard Hjerpe
*Assistant Examiner*—Kimnhung Nguyen
(74) *Attorney, Agent, or Firm*—Nixon & Vanderhye, P.C.

(57) ABSTRACT

To facilitate a gradation transition from the last gradation to a current gradation, in a modulation driving processing section for correcting current image data, the gradation transition is facilitated in such a degree that an actual luminance of the pixel can be a luminance indicated by image data of a current frame in a state where the gradation transition is made to a sufficient level from the second last gradation to the last gradation. In the liquid crystal display panel, $d2\cdot\gamma/\Delta V$ is set to be not larger than $41\times10^{-6}[mm^4/(V\cdot s)]$ wherein d [μm] indicates a thickness of the liquid crystal layer in the liquid crystal panel, $\gamma[mm^2/s]$ indicates a flow viscosity when the liquid crystal panel is set to a temperature of 5° C., and ΔV[V] indicates a difference in liquid crystal layer application voltage between a maximum luminance display and a minimum luminance display. With this structure, under general use conditions of the liquid crystal display apparatus, an improved response speed can be realized by facilitating a gradation transition from the last gradation to the current gradation by means of one parameter, and a high display quality can be maintained.

30 Claims, 54 Drawing Sheets

TARGET TRANSMITTANCE ACHIEVEMENT RATIO IN 1 FIELD OF PANEL K12
(TRANSITION FROM 32 TO X GRADATION)

U.S. PATENT DOCUMENTS

| | | | | |
|---|---|---|---|---|
| 2003/0080983 | A1 | 5/2003 | Someya et al. | |
| 2003/0098839 | A1 | 5/2003 | Lee | |
| 2003/0146893 | A1* | 8/2003 | Sawabe | 345/89 |
| 2003/0160750 | A1* | 8/2003 | Ueda et al. | 345/87 |
| 2003/0189541 | A1* | 10/2003 | Hashimoto | 345/89 |
| 2003/0197667 | A1* | 10/2003 | Numao | 345/82 |

FOREIGN PATENT DOCUMENTS

| | | | |
|---|---|---|---|
| JP | 2650479 | B2 | 5/1997 |
| JP | 3338135 | B2 | 8/2002 |
| TW | 509808 | | 11/2002 |
| TW | 589504 | | 6/2004 |

* cited by examiner

FIG. 15

| TYPE | STRUCTURE | d[um] | FLOW VISCOSITY | | DRIVING VOLTAGE |
|---|---|---|---|---|---|
| | | | 25°C | 5°C | |
| PANEL K1 | MVA | 2.4 | 16 | 40 | 7.1V→1.6V |
| PANEL K2 | MVA | 2.5 | 17 | 43 | 7.1V→1.6V |
| PANEL K3 | MVA | 3.4 | 15 | 43 | 7.1V→1.6V |
| PANEL K4 | MVA | 3.7 | 15 | 43 | 7.1V→1.6V |
| PANEL K5 | CPA | 3.4 | 20 | 65 | 6.2V→1.2V |
| PANEL K6 | CPA | 3.4 | 20 | 65 | 6.2V→1.2V |
| PANEL K7 | CPA | 3.4 | 18 | 55 | 6.2V→1.2V |
| PANEL K8 | CPA | 3.3 | 16 | 46 | 6.2V→1.2V |
| PANEL K9 | CPA | 3.4 | 17 | 50 | 6.2V→1.2V |
| PANEL K10 | CPA | 3.2 | 16 | 46 | 6.2V→1.2V |
| PANEL K11 | CPA | 3.3 | 21 | 67 | 6.2V→1.2V |
| PANEL K12 | CPA | 3.2 | 20 | 65 | 7.1V→1.2V |
| PANEL K13 | CPA | 3.0 | 17 | 48 | 7.1V→1.2V |
| PANEL K14 | CPA | 2.5 | 17 | 48 | 7.1V→1.2V |
| PANEL K15 | CPA | 1.9 | 17 | 48 | 7.1V→1.2V |
| PANEL K16 | MVA | 3.9 | 15 | 43 | 7.1V→1.6V |
| PANEL K17 | MVA | 2.3 | 17 | 48 | 7.1V→1.7V |
| PANEL K18 | MVA | 2.3 | 16 | 44 | 7.1V→1.7V |
| PANEL K19 | MVA | 2.3 | 15 | 42 | 7.1V→1.8V |
| PANEL K20 | MVA | 2.5 | 16 | 46 | 7.3V→1.7V |
| PANEL K21 | MVA | 3.7 | 15 | 43 | 7.1V→1.6V |
| PANEL K22 | MVA | 3.4 | 15 | 43 | 7.1V→1.6V |

FIG. 16

| TYPE | RESPONSE TIME [ms] (100→10%) | |
|---|---|---|
| | 25°C | 5°C |
| PANEL K1 | 5.6 | 13.1 |
| PANEL K2 | 6.0 | 13.1 |
| PANEL K3 | 10.1 | 25.5 |
| PANEL K4 | 11.3 | 25.3 |
| PANEL K5 | 15.5 | 39.1 |
| PANEL K6 | 14.9 | 40.6 |
| PANEL K7 | 12.7 | 30.5 |
| PANEL K8 | 11.6 | 28.3 |
| PANEL K9 | 11.1 | 26.8 |
| PANEL K10 | 10.9 | 26.2 |
| PANEL K11 | 15.7 | 36.9 |
| PANEL K12 | 11.5 | 29.4 |
| PANEL K13 | 8.3 | 19.6 |
| PANEL K14 | 6.3 | 14.5 |
| PANEL K15 | 4.1 | 8.2 |
| PANEL K16 | 12.0 | 27.4 |
| PANEL K17 | 5.3 | 11.3 |
| PANEL K18 | 4.9 | 10.3 |
| PANEL K19 | 4.0 | 8.2 |
| PANEL K20 | 6.8 | 16.6 |
| PANEL K21 | 11.6 | 26.6 |
| PANEL K22 | 10.1 | 25.5 |

FIG. 17

| TYPE | TARGET GRADATION ACHIEVEMENT RATIO [%] WHEN DRIVING IN A DISPLAY PERIOD OF 16.7 ms | |
|---|---|---|
| | 25°C | 5°C |
| PANEL K1 | 100 | 95 |
| PANEL K2 | 99 | 94 |
| PANEL K3 | 97 | 73 |
| PANEL K4 | 96 | 76 |
| PANEL K5 | 91 | 57 |
| PANEL K6 | 92 | 55 |
| PANEL K7 | 95 | 67 |
| PANEL K8 | 97 | 71 |
| PANEL K9 | 96 | 73 |
| PANEL K10 | 96 | 74 |
| PANEL K11 | 91 | 62 |
| PANEL K12 | 97 | 66 |
| PANEL K13 | 99 | 84 |
| PANEL K14 | 100 | 94 |
| PANEL K15 | 100 | 99 |
| PANEL K16 | 97 | 73 |
| PANEL K17 | 100 | 97 |
| PANEL K18 | 100 | 97 |
| PANEL K19 | 100 | 99 |
| PANEL K20 | 99 | 90 |
| PANEL K21 | 96 | 73 |
| PANEL K22 | 98 | 74 |

FIG. 18

| TYPE | d2* γ [× $10^{-6}$ $mm^4$/(V·S)] | |
|---|---|---|
| | 25°C | 5°C |
| PANEL K1 | 92 | 230 |
| PANEL K2 | 106 | 269 |
| PANEL K3 | 173 | 497 |
| PANEL K4 | 205 | 589 |
| PANEL K5 | 228 | 740 |
| PANEL K6 | 228 | 741 |
| PANEL K7 | 208 | 639 |
| PANEL K8 | 177 | 507 |
| PANEL K9 | 198 | 584 |
| PANEL K10 | 169 | 485 |
| PANEL K11 | 224 | 713 |
| PANEL K12 | 205 | 667 |
| PANEL K13 | 151 | 427 |
| PANEL K14 | 110 | 312 |
| PANEL K15 | 61 | 171 |
| PANEL K16 | 230 | 661 |
| PANEL K17 | 89 | 252 |
| PANEL K18 | 81 | 223 |
| PANEL K19 | 77 | 215 |
| PANEL K20 | 101 | 287 |
| PANEL K21 | 205 | 589 |
| PANEL K22 | 172 | 494 |

FIG. 19

| TYPE | $d2*\gamma/\Delta V$ [$\times 10^{-6} mm^4/(V \cdot S)$] | |
|---|---|---|
| | 25°C | 5°C |
| PANEL K1 | 17 | 42 |
| PANEL K2 | 19 | 49 |
| PANEL K3 | 32 | 90 |
| PANEL K4 | 37 | 107 |
| PANEL K5 | 46 | 148 |
| PANEL K6 | 46 | 148 |
| PANEL K7 | 42 | 128 |
| PANEL K8 | 35 | 101 |
| PANEL K9 | 40 | 117 |
| PANEL K10 | 34 | 97 |
| PANEL K11 | 45 | 143 |
| PANEL K12 | 35 | 113 |
| PANEL K13 | 26 | 72 |
| PANEL K14 | 19 | 53 |
| PANEL K15 | 10 | 29 |
| PANEL K16 | 42 | 120 |
| PANEL K17 | 17 | 47 |
| PANEL K18 | 15 | 41 |
| PANEL K19 | 14 | 40 |
| PANEL K20 | 18 | 51 |
| PANEL K21 | 37 | 107 |
| PANEL K22 | 31 | 90 |

FIG. 20

| TYPE | STRUCTURE | PANEL TEMPERATURE | ACHIEVEMENT RATIO [%] | EVALUATION |
|---|---|---|---|---|
| PANEL K12 | CPA | 5°C | 66 | × |
| PANEL K3 | MVA | 5°C | 73 | × |
| PANEL K16 | MVA | 5°C | 73 | × |
| PANEL K22 | MVA | 5°C | 74 | × |
| PANEL K4 | MVA | 5°C | 76 | × |
| PANEL K4 | MVA | 10°C | 83 | × |
| PANEL K13 | CPA | 5°C | 84 | × |
| PANEL K4 | MVA | 15°C | 90 | × |
| PANEL K20 | MVA | 5°C | 90 | × |
| PANEL K3 | MVA | 15°C | 93 | × |
| PANEL K14 | CPA | 5°C | 94 | × |
| PANEL K4 | MVA | 20°C | 94 | × |
| PANEL K2 | MVA | 5°C | 94 | × |
| PANEL K1 | MVA | 5°C | 95 | △ |
| PANEL K21 | MVA | 25°C | 96 | △ |
| PANEL K4 | MVA | 25°C | 96 | ○ |
| PANEL K17 | MVA | 5°C | 97 | ○ |
| PANEL K12 | CPA | 25°C | 97 | ○ |
| PANEL K18 | MVA | 5°C | 97 | ○ |
| PANEL K3 | MVA | 25°C | 97 | ○ |
| PANEL K4 | MVA | 30°C | 98 | ○ |
| PANEL K22 | MVA | 25°C | 98 | ○ |
| PANEL K4 | MVA | 35°C | 98 | ○ |
| PANEL K19 | MVA | 5°C | 99 | ○ |
| PANEL K1 | MVA | 15°C | 99 | ○ |
| PANEL K2 | MVA | 15°C | 99 | ○ |
| PANEL K15 | CPA | 5°C | 99 | ○ |
| PANEL K4 | MVA | 40°C | 99 | ○ |
| PANEL K4 | CPA | 25°C | 99 | ○ |
| PANEL K13 | MVA | 25°C | 99 | ○ |
| PANEL K2 | MVA | 25°C | 100 | ○ |
| PANEL K1 | MVA | 40°C | 100 | ○ |
| PANEL K3 | MVA | 40°C | 100 | ○ |
| PANEL K2 | CPA | 25°C | 100 | ○ |
| PANEL K15 | MVA | 40°C | 100 | ○ |
| PANEL K1 | CPA | 25°C | 100 | ○ |
| PANEL K14 | CPA | 25°C | 100 | ○ |

FIG. 33

| TYPE | STRUCTURE | PANEL TEMPERATURE | d2* γ / ⊿V | ACHIEVEMENT RATIO [%] | EVALUATION |
|---|---|---|---|---|---|
| PANEL K6 | CPA | 5°C | 148 | 55 | × |
| PANEL K5 | CPA | 5°C | 148 | 57 | × |
| PANEL K11 | CPA | 5°C | 143 | 62 | × |
| PANEL K12 | CPA | 5°C | 113 | 66 | × |
| PANEL K7 | CPA | 5°C | 128 | 67 | × |
| PANEL K8 | CPA | 5°C | 101 | 71 | × |
| PANEL K3 | MVA | 5°C | 90 | 73 | × |
| PANEL K16 | MVA | 5°C | 120 | 73 | × |
| PANEL K21 | MVA | 5°C | 107 | 73 | × |
| PANEL K9 | CPA | 5°C | 117 | 73 | × |
| PANEL K10 | CPA | 5°C | 97 | 74 | × |
| PANEL K22 | MVA | 5°C | 90 | 74 | × |
| PANEL K4 | MVA | 5°C | 107 | 76 | × |
| PANEL K4 | MVA | 10°C | 77 | 83 | × |
| PANEL K13 | CPA | 5°C | 72 | 84 | × |
| PANEL K4 | MVA | 15°C | 60 | 90 | × |
| PANEL K20 | MVA | 5°C | 51 | 90 | × |
| PANEL K11 | CPA | 25°C | 45 | 91 | × |
| PANEL K5 | CPA | 25°C | 46 | 91 | × |
| PANEL K6 | CPA | 25°C | 46 | 92 | × |
| PANEL K3 | MVA | 15°C | 50 | 93 | × |
| PANEL K14 | CPA | 5°C | 53 | 94 | × |
| PANEL K4 | MVA | 20°C | 47 | 94 | × |
| PANEL K2 | MVA | 5°C | 49 | 94 | × |
| PANEL K1 | MVA | 5°C | 42 | 95 | △ |
| PANEL K7 | CPA | 25°C | 42 | 95 | △ |
| PANEL K21 | MVA | 25°C | 37 | 96 | △ |
| PANEL K4 | MVA | 25°C | 37 | 96 | ○ |
| PANEL K10 | CPA | 25°C | 34 | 96 | ○ |
| PANEL K9 | CPA | 25°C | 40 | 96 | ○ |
| PANEL K17 | MVA | 5°C | 47 | 97 | ○ |
| PANEL K12 | CPA | 25°C | 35 | 97 | ○ |
| PANEL K7 | CPA | 25°C | 35 | 97 | ○ |
| PANEL K18 | MVA | 5°C | 41 | 97 | ○ |
| PANEL K16 | MVA | 25°C | 42 | 97 | ○ |
| PANEL K3 | MVA | 25°C | 32 | 97 | ○ |
| PANEL K4 | MVA | 30°C | 30 | 98 | ○ |
| PANEL K22 | MVA | 25°C | 31 | 98 | ○ |
| PANEL K4 | MVA | 35°C | 25 | 98 | ○ |
| PANEL K19 | MVA | 5°C | 40 | 99 | ○ |
| PANEL K1 | MVA | 15°C | 24 | 99 | ○ |
| PANEL K2 | MVA | 15°C | 28 | 99 | ○ |
| PANEL K15 | CPA | 5°C | 29 | 99 | ○ |
| PANEL K4 | MVA | 40°C | 22 | 99 | ○ |
| PANEL K13 | CPA | 25°C | 26 | 99 | ○ |
| PANEL K20 | MVA | 25°C | 18 | 99 | ○ |
| PANEL K2 | MVA | 25°C | 19 | 99 | ○ |
| PANEL K18 | MVA | 25°C | 15 | 100 | ○ |
| PANEL K1 | MVA | 25°C | 17 | 100 | ○ |
| PANEL K3 | MVA | 40°C | 19 | 100 | ○ |
| PANEL K2 | MVA | 40°C | 10 | 100 | ○ |
| PANEL K17 | MVA | 25°C | 17 | 100 | ○ |
| PANEL K15 | CPA | 25°C | 10 | 100 | ○ |
| PANEL K1 | MVA | 40°C | 9 | 100 | ○ |
| PANEL K19 | MVA | 25°C | 14 | 100 | ○ |
| PANEL K14 | CPA | 25°C | 19 | 100 | ○ |

FIG. 35

| TYPE | STRUCTURE | PANEL TEMPERATURE | RESPONSE TIME [ms] | ACHIEVEMENT RATIO [%] | EVALUATION |
|---|---|---|---|---|---|
| PANEL K6 | CPA | 5°C | 40.6 | 55 | × |
| PANEL K5 | CPA | 5°C | 39.1 | 57 | × |
| PANEL K11 | CPA | 5°C | 36.9 | 62 | × |
| PANEL K12 | CPA | 5°C | 29.4 | 66 | × |
| PANEL K7 | CPA | 5°C | 30.5 | 67 | × |
| PANEL K8 | CPA | 5°C | 28.3 | 71 | × |
| PANEL K3 | MVA | 5°C | 25.5 | 73 | × |
| PANEL K16 | MVA | 5°C | 27.4 | 73 | × |
| PANEL K21 | MVA | 5°C | 26.6 | 73 | × |
| PANEL K9 | CPA | 5°C | 26.8 | 73 | × |
| PANEL K10 | CPA | 5°C | 26.2 | 74 | × |
| PANEL K22 | MVA | 5°C | 25.5 | 74 | × |
| PANEL K4 | MVA | 5°C | 25.3 | 76 | × |
| PANEL K4 | MVA | 10°C | 20.5 | 83 | × |
| PANEL K13 | CPA | 5°C | 19.6 | 84 | × |
| PANEL K4 | MVA | 15°C | 17.8 | 90 | × |
| PANEL K20 | MVA | 5°C | 16.6 | 90 | × |
| PANEL K11 | CPA | 25°C | 15.7 | 91 | × |
| PANEL K5 | CPA | 25°C | 15.5 | 91 | × |
| PANEL K6 | CPA | 25°C | 14.9 | 92 | × |
| PANEL K3 | MVA | 15°C | 14.6 | 93 | × |
| PANEL K14 | CPA | 5°C | 14.5 | 94 | × |
| PANEL K4 | MVA | 20°C | 13.7 | 94 | × |
| PANEL K2 | MVA | 5°C | 13.1 | 94 | × |
| PANEL K1 | MVA | 5°C | 13.1 | 95 | △ |
| PANEL K7 | CPA | 25°C | 12.7 | 95 | △ |
| PANEL K21 | MVA | 25°C | 11.6 | 96 | △ |
| PANEL K4 | MVA | 25°C | 11.3 | 96 | ○ |
| PANEL K10 | CPA | 25°C | 10.9 | 96 | ○ |
| PANEL K9 | CPA | 25°C | 11.1 | 96 | ○ |
| PANEL K17 | MVA | 5°C | 11.3 | 97 | ○ |
| PANEL K12 | CPA | 25°C | 11.5 | 97 | ○ |
| PANEL K7 | CPA | 25°C | 11.6 | 97 | ○ |
| PANEL K18 | MVA | 5°C | 10.3 | 97 | ○ |
| PANEL K16 | MVA | 25°C | 12.0 | 97 | ○ |
| PANEL K3 | MVA | 25°C | 10.1 | 97 | ○ |
| PANEL K4 | MVA | 30°C | 9.4 | 98 | ○ |
| PANEL K22 | MVA | 25°C | 10.1 | 98 | ○ |
| PANEL K4 | MVA | 35°C | 8.1 | 98 | ○ |
| PANEL K19 | MVA | 5°C | 8.2 | 99 | ○ |
| PANEL K1 | MVA | 15°C | 7.8 | 99 | ○ |
| PANEL K2 | MVA | 15°C | 8.2 | 99 | ○ |
| PANEL K15 | CPA | 5°C | 8.2 | 99 | ○ |
| PANEL K4 | MVA | 40°C | 7.3 | 99 | ○ |
| PANEL K13 | CPA | 25°C | 8.3 | 99 | ○ |
| PANEL K20 | MVA | 25°C | 6.8 | 99 | ○ |
| PANEL K2 | MVA | 25°C | 6.0 | 99 | ○ |
| PANEL K18 | MVA | 25°C | 4.9 | 100 | ○ |
| PANEL K1 | MVA | 25°C | 5.6 | 100 | ○ |
| PANEL K3 | MVA | 40°C | 6.3 | 100 | ○ |
| PANEL K2 | MVA | 40°C | 4.3 | 100 | ○ |
| PANEL K17 | MVA | 25°C | 5.3 | 100 | ○ |
| PANEL K15 | CPA | 25°C | 4.1 | 100 | ○ |
| PANEL K1 | MVA | 40°C | 3.8 | 100 | ○ |
| PANEL K19 | MVA | 25°C | 4.0 | 100 | ○ |
| PANEL K14 | CPA | 25°C | 6.3 | 100 | ○ |

FIG. 37

| TYPE | RESPONSE TIME [ms] WHEN DRIVING IN A DISPLAY PERIOD OF 8.3 ms (100 % → 10 %) | |
|---|---|---|
| | 25°C | 5°C |
| PANEL K1 | 5.6 | 13.1 |
| PANEL K2 | 6.0 | 13.1 |
| PANEL K3 | 10.1 | 25.5 |
| PANEL K4 | 11.3 | 25.3 |
| PANEL K5 | 15.5 | 39.1 |
| PANEL K6 | 14.9 | 40.6 |
| PANEL K7 | 12.7 | 30.5 |
| PANEL K8 | 11.6 | 28.3 |
| PANEL K9 | 11.1 | 26.8 |
| PANEL K10 | 10.9 | 26.2 |
| PANEL K11 | 15.7 | 36.9 |
| PANEL K12 | 11.5 | 29.4 |
| PANEL K13 | 8.3 | 19.6 |
| PANEL K14 | 6.3 | 14.5 |
| PANEL K15 | 4.1 | 8.2 |
| PANEL K16 | 12.0 | 27.4 |
| PANEL K17 | 5.3 | 11.3 |
| PANEL K18 | 4.9 | 10.3 |
| PANEL K19 | 4.0 | 8.2 |
| PANEL K20 | 6.8 | 16.6 |
| PANEL K21 | 11.6 | 26.6 |

FIG. 38

| TYPE | TARGET GRADATION ACHIEVEMENT RATIO [%] WHEN DRIVING IN A DISPLAY PERIOD OF 8.3 ms | |
|---|---|---|
| | 25°C | 5°C |
| PANEL K1 | 97 | 75 |
| PANEL K2 | 96 | 75 |
| PANEL K3 | 77 | 42 |
| PANEL K4 | 81 | 47 |
| PANEL K5 | 70 | 34 |
| PANEL K6 | 70 | 32 |
| PANEL K7 | 77 | 41 |
| PANEL K8 | 79 | 44 |
| PANEL K9 | 81 | 47 |
| PANEL K10 | 82 | 48 |
| PANEL K11 | 72 | 39 |
| PANEL K12 | 78 | 39 |
| PANEL K13 | 90 | 54 |
| PANEL K14 | 96 | 68 |
| PANEL K15 | 99 | 90 |
| PANEL K16 | 76 | 40 |
| PANEL K17 | 98 | 80 |
| PANEL K18 | 98 | 84 |
| PANEL K19 | 99 | 90 |
| PANEL K20 | 94 | 63 |
| PANEL K21 | 80 | 45 |

FIG. 41

| TYPE | STRUCTURE | PANEL TEMPERATURE | d2* γ / ⊿V | ACHIEVEMENT RATIO [%] | EVALUATION |
|---|---|---|---|---|---|
| PANEL K6 | CPA | 5°C | 148 | 32 | × |
| PANEL K5 | CPA | 5°C | 148 | 34 | × |
| PANEL K11 | CPA | 5°C | 143 | 39 | × |
| PANEL K12 | CPA | 5°C | 113 | 39 | × |
| PANEL K16 | MVA | 5°C | 120 | 40 | × |
| PANEL K7 | CPA | 5°C | 128 | 41 | × |
| PANEL K3 | MVA | 5°C | 90 | 42 | × |
| PANEL K8 | CPA | 5°C | 101 | 44 | × |
| PANEL K21 | MVA | 5°C | 107 | 45 | × |
| PANEL K9 | CPA | 5°C | 117 | 47 | × |
| PANEL K4 | MVA | 5°C | 107 | 47 | × |
| PANEL K10 | CPA | 5°C | 97 | 48 | × |
| PANEL K13 | CPA | 5°C | 72 | 54 | × |
| PANEL K4 | MVA | 10°C | 77 | 55 | × |
| PANEL K20 | MVA | 5°C | 51 | 63 | × |
| PANEL K4 | MVA | 15°C | 60 | 66 | × |
| PANEL K14 | CPA | 5°C | 53 | 68 | × |
| PANEL K3 | MVA | 15°C | 50 | 69 | × |
| PANEL K5 | CPA | 25°C | 46 | 70 | × |
| PANEL K6 | CPA | 25°C | 46 | 70 | × |
| PANEL K11 | CPA | 25°C | 45 | 72 | × |
| PANEL K4 | MVA | 20°C | 47 | 74 | × |
| PANEL K2 | MVA | 5°C | 49 | 75 | × |
| PANEL K1 | MVA | 5°C | 42 | 75 | × |
| PANEL K16 | MVA | 25°C | 42 | 76 | × |
| PANEL K3 | MVA | 25°C | 32 | 77 | × |
| PANEL K7 | CPA | 25°C | 42 | 77 | × |
| PANEL K12 | CPA | 25°C | 35 | 78 | × |
| PANEL K8 | CPA | 25°C | 35 | 79 | × |
| PANEL K17 | MVA | 5°C | 47 | 80 | × |
| PANEL K21 | MVA | 25°C | 37 | 80 | × |
| PANEL K4 | MVA | 25°C | 37 | 81 | × |
| PANEL K9 | CPA | 25°C | 40 | 81 | × |
| PANEL K10 | CPA | 25°C | 34 | 82 | × |
| PANEL K18 | MVA | 5°C | 41 | 84 | × |
| PANEL K4 | MVA | 30°C | 30 | 87 | × |
| PANEL K13 | CPA | 25°C | 26 | 90 | × |
| PANEL K19 | MVA | 5°C | 40 | 90 | × |
| PANEL K2 | MVA | 15°C | 28 | 90 | × |
| PANEL K15 | CPA | 5°C | 29 | 90 | × |
| PANEL K4 | MVA | 35°C | 25 | 91 | × |
| PANEL K1 | MVA | 15°C | 24 | 91 | × |
| PANEL K4 | MVA | 40°C | 22 | 93 | × |
| PANEL K20 | MVA | 25°C | 18 | 94 | × |
| PANEL K2 | MVA | 25°C | 19 | 96 | ○ |
| PANEL K3 | MVA | 40°C | 19 | 96 | ○ |
| PANEL K14 | CPA | 25°C | 19 | 96 | ○ |
| PANEL K1 | MVA | 25°C | 17 | 97 | ○ |
| PANEL K17 | MVA | 25°C | 17 | 98 | ○ |
| PANEL K18 | MVA | 25°C | 15 | 98 | ○ |
| PANEL K2 | MVA | 40°C | 10 | 99 | ○ |
| PANEL K15 | CPA | 25°C | 10 | 99 | ○ |
| PANEL K19 | MVA | 25°C | 14 | 99 | ○ |
| PANEL K1 | MVA | 40°C | 9 | 99 | ○ |

FIG. 42

| TYPE | STRUCTURE | PANEL TEMPERATURE | RESPONSE TIME [ms] | ACHIEVEMENT RATIO [%] | EVALUATION |
|---|---|---|---|---|---|
| PANEL K6 | CPA | 5°C | 40.6 | 32 | × |
| PANEL K5 | CPA | 5°C | 39.1 | 34 | × |
| PANEL K11 | CPA | 5°C | 36.9 | 39 | × |
| PANEL K12 | CPA | 5°C | 29.4 | 39 | × |
| PANEL K16 | MVA | 5°C | 27.4 | 40 | × |
| PANEL K7 | CPA | 5°C | 30.5 | 41 | × |
| PANEL K3 | MVA | 5°C | 25.5 | 42 | × |
| PANEL K8 | CPA | 5°C | 28.3 | 44 | × |
| PANEL K21 | MVA | 5°C | 26.6 | 45 | × |
| PANEL K9 | CPA | 5°C | 26.8 | 47 | × |
| PANEL K4 | MVA | 5°C | 25.3 | 47 | × |
| PANEL K10 | CPA | 5°C | 26.2 | 48 | × |
| PANEL K13 | CPA | 5°C | 19.6 | 54 | × |
| PANEL K4 | MVA | 10°C | 20.5 | 55 | × |
| PANEL K20 | MVA | 5°C | 16.6 | 63 | × |
| PANEL K4 | MVA | 15°C | 17.8 | 66 | × |
| PANEL K14 | CPA | 5°C | 14.5 | 68 | × |
| PANEL K3 | MVA | 15°C | 14.6 | 69 | × |
| PANEL K5 | CPA | 25°C | 15.5 | 70 | × |
| PANEL K6 | CPA | 25°C | 14.9 | 70 | × |
| PANEL K11 | CPA | 25°C | 15.7 | 72 | × |
| PANEL K4 | MVA | 20°C | 13.7 | 74 | × |
| PANEL K2 | MVA | 5°C | 13.1 | 75 | × |
| PANEL K1 | MVA | 5°C | 13.1 | 75 | × |
| PANEL K16 | MVA | 25°C | 12.0 | 76 | × |
| PANEL K3 | MVA | 25°C | 10.1 | 77 | × |
| PANEL K7 | CPA | 25°C | 12.7 | 77 | × |
| PANEL K12 | CPA | 25°C | 11.5 | 78 | × |
| PANEL K8 | CPA | 25°C | 11.6 | 79 | × |
| PANEL K17 | MVA | 5°C | 11.3 | 80 | × |
| PANEL K21 | MVA | 25°C | 11.6 | 80 | × |
| PANEL K4 | MVA | 25°C | 11.3 | 81 | × |
| PANEL K9 | CPA | 25°C | 11.1 | 81 | × |
| PANEL K10 | CPA | 25°C | 10.9 | 82 | × |
| PANEL K18 | MVA | 5°C | 10.3 | 84 | × |
| PANEL K4 | MVA | 30°C | 9.4 | 87 | × |
| PANEL K13 | CPA | 25°C | 8.3 | 90 | × |
| PANEL K19 | MVA | 5°C | 8.2 | 90 | × |
| PANEL K2 | MVA | 15°C | 8.2 | 90 | × |
| PANEL K15 | CPA | 5°C | 8.2 | 90 | × |
| PANEL K4 | MVA | 35°C | 8.1 | 91 | × |
| PANEL K1 | MVA | 15°C | 7.8 | 91 | × |
| PANEL K4 | MVA | 40°C | 7.3 | 93 | × |
| PANEL K20 | MVA | 25°C | 6.8 | 94 | × |
| PANEL K2 | MVA | 25°C | 6.0 | 96 | ○ |
| PANEL K3 | MVA | 40°C | 6.3 | 96 | ○ |
| PANEL K14 | CPA | 25°C | 6.3 | 96 | ○ |
| PANEL K1 | MVA | 25°C | 5.6 | 97 | ○ |
| PANEL K17 | MVA | 25°C | 5.3 | 98 | ○ |
| PANEL K18 | MVA | 25°C | 4.9 | 98 | ○ |
| PANEL K2 | MVA | 40°C | 4.3 | 99 | ○ |
| PANEL K15 | CPA | 25°C | 4.1 | 99 | ○ |
| PANEL K19 | MVA | 25°C | 4.0 | 99 | ○ |
| PANEL K1 | MVA | 40°C | 3.8 | 99 | ○ |

FIG. 43

| TYPE | STRUCTURE | PANEL TEMPERATURE | ACHIEVEMENT RATIO [%] | EVALUATION |
|---|---|---|---|---|
| PANEL K12 | CPA | 5°C | 66 | × |
| PANEL K2 | MVA | 5°C | 73 | × |
| PANEL K16 | MVA | 5°C | 73 | × |
| PANEL K22 | MVA | 5°C | 74 | × |
| PANEL K4 | MVA | 5°C | 76 | × |
| PANEL K4 | MVA | 10°C | 83 | × |
| PANEL K13 | CPA | 5°C | 84 | × |
| PANEL K4 | MVA | 15°C | 90 | △ |
| PANEL K20 | MVA | 5°C | 90 | △ |
| PANEL K3 | MVA | 15°C | 93 | ○ |
| PANEL K14 | CPA | 5°C | 94 | ○ |
| PANEL K4 | MVA | 20°C | 94 | ○ |
| PANEL K2 | MVA | 5°C | 94 | ○ |
| PANEL K1 | MVA | 5°C | 95 | ○ |
| PANEL K21 | MVA | 25°C | 96 | ○ |
| PANEL K4 | MVA | 25°C | 96 | ○ |
| PANEL K17 | MVA | 5°C | 97 | ○ |
| PANEL K12 | CPA | 25°C | 97 | ○ |
| PANEL K18 | MVA | 5°C | 97 | ○ |
| PANEL K3 | MVA | 25°C | 97 | ○ |
| PANEL K4 | MVA | 30°C | 98 | ○ |
| PANEL K22 | MVA | 25°C | 98 | ○ |
| PANEL K4 | MVA | 35°C | 98 | ○ |
| PANEL K19 | MVA | 5°C | 99 | ○ |
| PANEL K1 | MVA | 15°C | 99 | ○ |
| PANEL K2 | MVA | 15°C | 99 | ○ |
| PANEL K15 | CPA | 5°C | 99 | ○ |
| PANEL K4 | MVA | 40°C | 99 | ○ |
| PANEL K4 | CPA | 25°C | 99 | ○ |
| PANEL K13 | MVA | 25°C | 99 | ○ |
| PANEL K2 | MVA | 25°C | 100 | ○ |
| PANEL K1 | MVA | 40°C | 100 | ○ |
| PANEL K3 | MVA | 40°C | 100 | ○ |
| PANEL K2 | CPA | 25°C | 100 | ○ |
| PANEL K15 | MVA | 40°C | 100 | ○ |
| PANEL K1 | CPA | 25°C | 100 | ○ |
| PANEL K14 | CPA | 25°C | 100 | ○ |

TARGET TRANSMITTANCE ACHIEVEMENT RATIO IN 1 FIELD OF PANEL K14
(TRANSITION FROM 32 TO X GRADATION)

TARGET TRANSMITTANCE ACHIEVEMENT RATIO IN 1 FIELD OF PANEL K15
(TRANSITION FROM 32 TO X GRADATION)

FIG. 53

| TYPE | STRUCTURE | PANEL TEMPERATURE | d2* γ / ⊿V | ACHIEVEMENT RATIO [%] | EVALUATION |
|---|---|---|---|---|---|
| PANEL K6 | CPA | 5°C | 148 | 55 | × |
| PANEL K5 | CPA | 5°C | 148 | 57 | × |
| PANEL K11 | CPA | 5°C | 143 | 62 | × |
| PANEL K12 | CPA | 5°C | 113 | 66 | × |
| PANEL K7 | CPA | 5°C | 128 | 67 | × |
| PANEL K8 | CPA | 5°C | 101 | 71 | × |
| PANEL K3 | MVA | 5°C | 90 | 73 | × |
| PANEL K16 | MVA | 5°C | 120 | 73 | × |
| PANEL K21 | MVA | 5°C | 107 | 73 | × |
| PANEL K9 | CPA | 5°C | 117 | 73 | × |
| PANEL K10 | CPA | 5°C | 97 | 74 | × |
| PANEL K22 | MVA | 5°C | 90 | 74 | × |
| PANEL K4 | MVA | 5°C | 107 | 76 | × |
| PANEL K4 | MVA | 10°C | 77 | 83 | × |
| PANEL K13 | CPA | 5°C | 72 | 84 | × |
| PANEL K4 | MVA | 15°C | 60 | 90 | △ |
| PANEL K20 | MVA | 5°C | 51 | 90 | △ |
| PANEL K11 | CPA | 25°C | 45 | 91 | ○ |
| PANEL K5 | CPA | 25°C | 46 | 91 | ○ |
| PANEL K6 | CPA | 25°C | 46 | 92 | ○ |
| PANEL K3 | MVA | 15°C | 50 | 93 | ○ |
| PANEL K14 | CPA | 5°C | 53 | 94 | ○ |
| PANEL K4 | MVA | 20°C | 47 | 94 | ○ |
| PANEL K2 | MVA | 5°C | 49 | 94 | ○ |
| PANEL K1 | MVA | 5°C | 42 | 95 | ○ |
| PANEL K7 | CPA | 25°C | 42 | 95 | ○ |
| PANEL K21 | MVA | 25°C | 37 | 96 | ○ |
| PANEL K4 | MVA | 25°C | 37 | 96 | ○ |
| PANEL K10 | CPA | 25°C | 34 | 96 | ○ |
| PANEL K9 | CPA | 25°C | 40 | 96 | ○ |
| PANEL K17 | MVA | 5°C | 47 | 97 | ○ |
| PANEL K12 | CPA | 25°C | 35 | 97 | ○ |
| PANEL K7 | CPA | 25°C | 35 | 97 | ○ |
| PANEL K18 | MVA | 5°C | 41 | 97 | ○ |
| PANEL K16 | MVA | 25°C | 42 | 97 | ○ |
| PANEL K3 | MVA | 25°C | 32 | 97 | ○ |
| PANEL K4 | MVA | 30°C | 30 | 98 | ○ |
| PANEL K22 | MVA | 25°C | 31 | 98 | ○ |
| PANEL K4 | MVA | 35°C | 25 | 98 | ○ |
| PANEL K19 | MVA | 5°C | 40 | 99 | ○ |
| PANEL K1 | MVA | 15°C | 24 | 99 | ○ |
| PANEL K2 | MVA | 15°C | 28 | 99 | ○ |
| PANEL K15 | CPA | 5°C | 29 | 99 | ○ |
| PANEL K4 | MVA | 40°C | 22 | 99 | ○ |
| PANEL K13 | CPA | 25°C | 26 | 99 | ○ |
| PANEL K20 | MVA | 25°C | 18 | 99 | ○ |
| PANEL K2 | MVA | 25°C | 19 | 99 | ○ |
| PANEL K18 | MVA | 25°C | 15 | 100 | ○ |
| PANEL K1 | MVA | 25°C | 17 | 100 | ○ |
| PANEL K3 | MVA | 40°C | 19 | 100 | ○ |
| PANEL K2 | MVA | 40°C | 10 | 100 | ○ |
| PANEL K17 | MVA | 25°C | 17 | 100 | ○ |
| PANEL K15 | CPA | 25°C | 10 | 100 | ○ |
| PANEL K1 | MVA | 40°C | 9 | 100 | ○ |
| PANEL K19 | MVA | 25°C | 14 | 100 | ○ |
| PANEL K14 | CPA | 25°C | 19 | 100 | ○ |

FIG. 54

| TYPE | STRUCTURE | PANEL TEMPERATURE | RESPONSE TIME [ms] | ACHIEVEMENT RATIO [%] | EVALUATION |
|---|---|---|---|---|---|
| PANEL K6 | CPA | 5°C | 40.6 | 55 | × |
| PANEL K5 | CPA | 5°C | 39.1 | 57 | × |
| PANEL K11 | CPA | 5°C | 36.9 | 62 | × |
| PANEL K12 | CPA | 5°C | 29.4 | 66 | × |
| PANEL K7 | CPA | 5°C | 30.5 | 67 | × |
| PANEL K8 | CPA | 5°C | 28.3 | 71 | × |
| PANEL K3 | MVA | 5°C | 25.5 | 73 | × |
| PANEL K16 | MVA | 5°C | 27.4 | 73 | × |
| PANEL K21 | MVA | 5°C | 26.6 | 73 | × |
| PANEL K9 | CPA | 5°C | 26.8 | 73 | × |
| PANEL K10 | CPA | 5°C | 26.2 | 74 | × |
| PANEL K22 | MVA | 5°C | 25.5 | 74 | × |
| PANEL K4 | MVA | 5°C | 25.3 | 76 | × |
| PANEL K4 | MVA | 10°C | 20.5 | 83 | × |
| PANEL K13 | CPA | 5°C | 19.6 | 84 | × |
| PANEL K4 | MVA | 15°C | 17.8 | 90 | △ |
| PANEL K20 | MVA | 5°C | 16.6 | 90 | △ |
| PANEL K11 | CPA | 25°C | 15.7 | 91 | ○ |
| PANEL K5 | CPA | 25°C | 15.5 | 91 | ○ |
| PANEL K6 | CPA | 25°C | 14.9 | 92 | ○ |
| PANEL K3 | MVA | 15°C | 14.6 | 93 | ○ |
| PANEL K14 | CPA | 5°C | 14.5 | 94 | ○ |
| PANEL K4 | MVA | 20°C | 13.7 | 94 | ○ |
| PANEL K2 | MVA | 5°C | 13.1 | 94 | ○ |
| PANEL K1 | MVA | 5°C | 13.1 | 95 | ○ |
| PANEL K7 | CPA | 25°C | 12.7 | 95 | ○ |
| PANEL K21 | MVA | 25°C | 11.6 | 96 | ○ |
| PANEL K4 | MVA | 25°C | 11.3 | 96 | ○ |
| PANEL K10 | CPA | 25°C | 10.9 | 96 | ○ |
| PANEL K9 | CPA | 25°C | 11.1 | 96 | ○ |
| PANEL K17 | MVA | 5°C | 11.3 | 97 | ○ |
| PANEL K12 | CPA | 25°C | 11.5 | 97 | ○ |
| PANEL K7 | CPA | 25°C | 11.6 | 97 | ○ |
| PANEL K18 | MVA | 5°C | 10.3 | 97 | ○ |
| PANEL K16 | MVA | 25°C | 12.0 | 97 | ○ |
| PANEL K3 | MVA | 25°C | 10.1 | 97 | ○ |
| PANEL K4 | MVA | 30°C | 9.4 | 98 | ○ |
| PANEL K22 | MVA | 25°C | 10.1 | 98 | ○ |
| PANEL K4 | MVA | 35°C | 8.1 | 98 | ○ |
| PANEL K19 | MVA | 5°C | 8.2 | 99 | ○ |
| PANEL K1 | MVA | 15°C | 7.8 | 99 | ○ |
| PANEL K2 | MVA | 15°C | 8.2 | 99 | ○ |
| PANEL K15 | CPA | 5°C | 8.2 | 99 | ○ |
| PANEL K4 | MVA | 40°C | 7.3 | 99 | ○ |
| PANEL K13 | CPA | 25°C | 8.3 | 99 | ○ |
| PANEL K20 | MVA | 25°C | 6.8 | 99 | ○ |
| PANEL K2 | MVA | 25°C | 6.0 | 99 | ○ |
| PANEL K18 | MVA | 25°C | 4.9 | 100 | ○ |
| PANEL K1 | MVA | 25°C | 5.6 | 100 | ○ |
| PANEL K3 | MVA | 40°C | 6.3 | 100 | ○ |
| PANEL K2 | MVA | 40°C | 4.3 | 100 | ○ |
| PANEL K17 | MVA | 25°C | 5.3 | 100 | ○ |
| PANEL K15 | CPA | 25°C | 4.1 | 100 | ○ |
| PANEL K1 | MVA | 40°C | 3.8 | 100 | ○ |
| PANEL K19 | MVA | 25°C | 4.0 | 100 | ○ |
| PANEL K14 | CPA | 25°C | 6.3 | 100 | ○ |

FIG. 55

| TYPE | STRUCTURE | PANEL TEMPERATURE | d2* γ / ⊿V | ACHIEVEMENT RATIO [%] | EVALUATION |
|---|---|---|---|---|---|
| PANEL K6 | CPA | 5°C | 148 | 32 | × |
| PANEL K5 | CPA | 5°C | 148 | 34 | × |
| PANEL K11 | CPA | 5°C | 143 | 39 | × |
| PANEL K12 | CPA | 5°C | 113 | 39 | × |
| PANEL K16 | MVA | 5°C | 120 | 40 | × |
| PANEL K7 | CPA | 5°C | 128 | 41 | × |
| PANEL K3 | MVA | 5°C | 90 | 42 | × |
| PANEL K8 | CPA | 5°C | 101 | 44 | × |
| PANEL K21 | MVA | 5°C | 107 | 45 | × |
| PANEL K9 | CPA | 5°C | 117 | 47 | × |
| PANEL K4 | MVA | 5°C | 107 | 47 | × |
| PANEL K10 | CPA | 5°C | 97 | 48 | × |
| PANEL K13 | CPA | 5°C | 72 | 54 | × |
| PANEL K4 | MVA | 10°C | 77 | 55 | × |
| PANEL K20 | MVA | 5°C | 51 | 63 | × |
| PANEL K4 | MVA | 15°C | 60 | 66 | × |
| PANEL K14 | CPA | 5°C | 53 | 68 | × |
| PANEL K3 | MVA | 15°C | 50 | 69 | × |
| PANEL K5 | CPA | 25°C | 46 | 70 | × |
| PANEL K6 | CPA | 25°C | 46 | 70 | × |
| PANEL K11 | CPA | 25°C | 45 | 72 | × |
| PANEL K4 | MVA | 20°C | 47 | 74 | × |
| PANEL K2 | MVA | 5°C | 49 | 75 | × |
| PANEL K1 | MVA | 5°C | 42 | 75 | × |
| PANEL K16 | MVA | 25°C | 42 | 76 | × |
| PANEL K3 | MVA | 25°C | 32 | 77 | × |
| PANEL K7 | CPA | 25°C | 42 | 77 | × |
| PANEL K12 | CPA | 25°C | 35 | 78 | × |
| PANEL K8 | CPA | 25°C | 35 | 79 | × |
| PANEL K17 | MVA | 5°C | 47 | 80 | × |
| PANEL K21 | MVA | 25°C | 37 | 80 | × |
| PANEL K4 | MVA | 25°C | 37 | 81 | × |
| PANEL K9 | CPA | 25°C | 40 | 81 | × |
| PANEL K10 | CPA | 25°C | 34 | 82 | × |
| PANEL K18 | MVA | 5°C | 41 | 84 | × |
| PANEL K4 | MVA | 30°C | 30 | 87 | × |
| PANEL K13 | CPA | 25°C | 26 | 90 | ○ |
| PANEL K19 | MVA | 5°C | 40 | 90 | ○ |
| PANEL K2 | MVA | 15°C | 28 | 90 | ○ |
| PANEL K15 | CPA | 5°C | 29 | 90 | ○ |
| PANEL K4 | MVA | 35°C | 25 | 91 | ○ |
| PANEL K1 | MVA | 15°C | 24 | 91 | ○ |
| PANEL K4 | MVA | 40°C | 22 | 93 | ○ |
| PANEL K20 | MVA | 25°C | 18 | 94 | ○ |
| PANEL K2 | MVA | 25°C | 19 | 96 | ○ |
| PANEL K3 | MVA | 40°C | 19 | 96 | ○ |
| PANEL K14 | CPA | 25°C | 19 | 96 | ○ |
| PANEL K1 | MVA | 25°C | 17 | 97 | ○ |
| PANEL K17 | MVA | 25°C | 17 | 98 | ○ |
| PANEL K18 | MVA | 25°C | 15 | 98 | ○ |
| PANEL K2 | MVA | 40°C | 10 | 99 | ○ |
| PANEL K15 | CPA | 25°C | 10 | 99 | ○ |
| PANEL K19 | MVA | 25°C | 14 | 99 | ○ |
| PANEL K1 | MVA | 40°C | 9 | 99 | ○ |

FIG. 56

| TYPE | STRUCTURE | PANEL TEMPERATURE | RESPONSE TIME [ms] | ACHIEVEMENT RATIO [%] | EVALUATION |
|---|---|---|---|---|---|
| PANEL K6 | CPA | 5°C | 40.6 | 32 | × |
| PANEL K5 | CPA | 5°C | 39.1 | 34 | × |
| PANEL K11 | CPA | 5°C | 36.9 | 39 | × |
| PANEL K12 | CPA | 5°C | 29.4 | 39 | × |
| PANEL K16 | MVA | 5°C | 27.4 | 40 | × |
| PANEL K7 | CPA | 5°C | 30.5 | 41 | × |
| PANEL K3 | MVA | 5°C | 25.5 | 42 | × |
| PANEL K8 | CPA | 5°C | 28.3 | 44 | × |
| PANEL K21 | MVA | 5°C | 26.6 | 45 | × |
| PANEL K9 | CPA | 5°C | 26.8 | 47 | × |
| PANEL K4 | MVA | 5°C | 25.3 | 47 | × |
| PANEL K10 | CPA | 5°C | 26.2 | 48 | × |
| PANEL K13 | CPA | 5°C | 19.6 | 54 | × |
| PANEL K4 | MVA | 10°C | 20.5 | 55 | × |
| PANEL K20 | MVA | 5°C | 16.6 | 63 | × |
| PANEL K4 | MVA | 15°C | 17.8 | 66 | × |
| PANEL K14 | CPA | 5°C | 14.5 | 68 | × |
| PANEL K3 | MVA | 15°C | 14.6 | 69 | × |
| PANEL K5 | CPA | 25°C | 15.5 | 70 | × |
| PANEL K6 | CPA | 25°C | 14.9 | 70 | × |
| PANEL K11 | CPA | 25°C | 15.7 | 72 | × |
| PANEL K4 | MVA | 20°C | 13.7 | 74 | × |
| PANEL K2 | MVA | 5°C | 13.1 | 75 | × |
| PANEL K1 | MVA | 5°C | 13.1 | 75 | × |
| PANEL K16 | MVA | 25°C | 12.0 | 76 | × |
| PANEL K3 | MVA | 25°C | 10.1 | 77 | × |
| PANEL K7 | CPA | 25°C | 12.7 | 77 | × |
| PANEL K12 | CPA | 25°C | 11.5 | 78 | × |
| PANEL K8 | CPA | 25°C | 11.6 | 79 | × |
| PANEL K17 | MVA | 5°C | 11.3 | 80 | × |
| PANEL K21 | MVA | 25°C | 11.6 | 80 | × |
| PANEL K4 | MVA | 25°C | 11.3 | 81 | × |
| PANEL K9 | CPA | 25°C | 11.1 | 81 | × |
| PANEL K10 | CPA | 25°C | 10.9 | 82 | × |
| PANEL K18 | MVA | 5°C | 10.3 | 84 | × |
| PANEL K4 | MVA | 30°C | 9.4 | 87 | × |
| PANEL K13 | CPA | 25°C | 8.3 | 90 | ○ |
| PANEL K19 | MVA | 5°C | 8.2 | 90 | ○ |
| PANEL K2 | MVA | 15°C | 8.2 | 90 | ○ |
| PANEL K15 | CPA | 5°C | 8.2 | 90 | ○ |
| PANEL K4 | MVA | 35°C | 8.1 | 91 | ○ |
| PANEL K1 | MVA | 15°C | 7.8 | 91 | ○ |
| PANEL K4 | MVA | 40°C | 7.3 | 93 | ○ |
| PANEL K20 | MVA | 25°C | 6.8 | 94 | ○ |
| PANEL K2 | MVA | 25°C | 6.0 | 96 | ○ |
| PANEL K3 | MVA | 40°C | 6.3 | 96 | ○ |
| PANEL K14 | CPA | 25°C | 6.3 | 96 | ○ |
| PANEL K1 | MVA | 25°C | 5.6 | 97 | ○ |
| PANEL K17 | MVA | 25°C | 5.3 | 98 | ○ |
| PANEL K18 | MVA | 25°C | 4.9 | 98 | ○ |
| PANEL K2 | MVA | 40°C | 4.3 | 99 | ○ |
| PANEL K15 | CPA | 25°C | 4.1 | 99 | ○ |
| PANEL K19 | MVA | 25°C | 4.0 | 99 | ○ |
| PANEL K1 | MVA | 40°C | 3.8 | 99 | ○ |

LIQUID CRYSTAL DISPLAY APPARATUS AND LIQUID CRYSTAL TELEVISION AND LIQUID CRYSTAL MONITOR ADOPTING SAME

This Nonprovisional application claims priority under 35 U.S.C. § 119(a) on Patent Application No. 2003-408080 filed in Japan on Dec. 5, 2003, the entire contents of which are hereby incorporated by reference.

FIELD OF THE INVENTION

The present invention relates to a liquid crystal display apparatus adopting a liquid crystal panel of a vertically aligned mode, and also relates to a liquid crystal television and a liquid crystal monitor adopting such liquid crystal display apparatus.

BACKGROUND OF THE INVENTION

Liquid crystal display apparatuses have been widely used as screens for word processors or computers. In recent years, a demand for such liquid crystal display apparatuses has been increasing rapidly also for TV screens. The liquid crystal display apparatuses are generally used in a TN (Twisted Nematic) mode; however, such liquid crystal apparatuses are liable to have problems when viewed obliquely, such as a reduction in contrast, a reversed gradation characteristic, etc. In response, recently, liquid crystal display apparatuses used in a VA (Vertical Alignment) mode have been viewed with interest. A liquid crystal cell in a liquid crystal display apparatus used in the VA mode is made up of a combination of a nematic liquid crystal having negative dielectric anisotropy and a vertical alignment film.

Recently, a liquid crystal cell having physical values and cell thickness which realizes a response speed in a sufficiently high level under the condition of a liquid crystal panel temperature of 25° C. has been developed. It should be noted here that the temperature of the liquid crystal panel generally becomes 10° C. higher than the ambient temperature by the heat generated from circuits surrounding liquid crystal cells, and the foregoing liquid crystal cells are applicable to apparatuses used in indoors without problem. However, when installing the apparatuses adopting the foregoing liquid crystal cells in the outside or applying liquid crystal cells to portable apparatuses, the response speed in a sufficiently high level may not be realized. Therefore, a liquid crystal cell which realizes a response speed in a sufficiently high level in any general use conditions has not yet been developed.

In response, for example, a driving method of liquid crystal cells in which a gradation transition is facilitated to realize a response speed is disclosed by Patent Document 1 (U.S. Pat. No. 2650479, published on Sep. 3, 1997). In this driving method, a voltage to be applied to a liquid crystal cell is corrected to facilitate a gradation transition. In this way, as compared to the case where the gradation transition is not facilitated, the luminance of the pixel in the level as desired can be attained in a shorter period of time.

However, even when adopting the above driving method to the foregoing conventional liquid crystal cell in a vertically aligned mode, if the response speed of the liquid crystal cell is not in the sufficient level, in such event that the luminance of the target level cannot be attained by the gradation transition from the last gradation to the current gradation, as it is assumed that the gradation transition made from the second last gradation to the last gradation is sufficient, a gradation transition may not be facilitated appropriately in the subsequent frame.

For example, as indicated by the solid line in FIG. 13, in the case where the gradation transition from the second last gradation to the current gradation is from a decay (in the direction of decreasing a luminance) to a rise (in the direction of increasing a luminance), if pixels are driven in the current frame FR (k) in the same manner as the case where the gradation transition is made in a sufficient level as indicated by the dashed line, despite of that the gradation transition made from the second last gradation to the last gradation is in fact insufficient, and the luminance at a start of the current frame FR (k) is not reduced to a sufficiently low level, a problem of generating an excessive brightness occurs resulting from an over facilitation of gradation transition.

On the other hand, as indicated by the solid line in FIG. 14, in the case where the gradation transition from the second last gradation to the current gradation is from rise to decay, if pixels are driven in the current frame FR (k) in the same manner as the case where the gradation transition is made in a sufficient level as shown by the dashed line, despite of that the gradation transition made from the second last gradation to the last gradation is in fact insufficient, and the luminance at a start of the current frame FR (k) is not raised to a sufficiently high level, a problem of generating a poor brightness occurs resulting from a over facilitation of gradation transition.

Incidentally, in the case where the gradation transition from the second last gradation to the current gradation is from a decay to a decay, if the gradation transition from the second last gradation to the last gradation is not made sufficiently, and the luminance at the start of the last frame FR(k-1) is not reduced to a sufficiently low level, the response speed of the liquid crystal in the current frame FR(k) is liable to be lowered. Similarly, in the case where the gradation transition from the second last gradation to the current gradation is from a rise to a rise, if the gradation transition from the second last gradation to the last gradation is not made sufficiently, and the luminance at the start of the last frame FR(k-1) is not raised to a sufficiently high level, the response speed of the liquid crystal in the current frame FR(k) is liable to be lowered.

As described, when adopting the foregoing driving method for the driving of the described conventional liquid crystal cells of the vertical alignment, a problem of reducing a display quality of the liquid crystal display apparatus is liable to occur if the gradation transition is facilitated in the same manner as the case where the gradation transition is made to a sufficient level, despite of that the response speed of a display element is not high enough, and the gradation transition is not in fact made sufficiently, a problem of deterioration of the display quality of the display apparatus is liable to occur resulting from an over facilitation of the gradation transition.

In applications of the liquid crystal display in environments of wider temperature range, because of the described characteristics of liquid crystals that their viscosities rise with a decrease in temperature, a problem of deteriorating the display quality is more liable to occur. In view of the foregoing, when it is expected to use under low temperature conditions, it is required to adopt a liquid crystal cell which offers an enough response speed to prevent deterioration of the display quality even under low temperature environments.

For example, under the condition of an ambient temperature of 0° C., since the panel temperature of the liquid crystal cell becomes around 5° C., it is required to adopt a liquid crystal cell which offers a high response speed enough to prevent the deterioration of the display quality under the condition of an ambient temperature of 5° C.

On the other hand, due to the limited selections for the applicable liquid crystal materials, cell thickness and application voltage, etc., a liquid crystal cell which offers a high response speed is more difficult to be manufactured as compared to the case of manufacturing a liquid crystal cell of low response speed. In view of this problem, provided that the deterioration of the display quality can be prevented, it is desirable to adopt liquid crystal cells of lower response speed in the aspect of manufacturing liquid crystal cells.

SUMMARY OF THE INVENTION

As a result of earnest research and development to realize an improved response speed by facilitating a gradation transition by means of one parameter defined by a gradation transition from a last transition to a current transition under general use conditions of a liquid crystal display apparatus, irrespectively of a gradation transition from a second last transition to a last transition, and in the meantime to maintain a high quality display level, the present invention is achieved by discovering that it is a key factor to maintain an achievement ratio after one field of a liquid crystal at 5° C. within a predetermined range to prevent excessive brightness and poor brightness and the deterioration of display quality noticeable with eyes and further discovering that to maintain the achievement ratio after one field of the liquid crystal at 5° C. within the predetermined range, it is a key factor to maintain $d^2 \cdot \gamma / \Delta V$ within a predetermined range, wherein d [μm] indicates a thickness of liquid crystal, γ [$mm^2/s$] indicates a flow viscosity when the liquid crystal panel is set to a temperature of 5° C., and ΔV [V] indicates a difference in liquid crystal layer application voltage between a maximum luminance display and a minimum luminance display. It is therefore an object of the present invention to provide a liquid crystal display apparatus, which realizes a high contrast and desirable viewing angle characteristics, and which suppresses an occurrence of excessive brightness or poor brightness, while realizing an improved response speed by facilitating the gradation transition.

In order to achieve the foregoing object, the liquid crystal display apparatus of the present invention is provided with i) a liquid crystal panel in which a display signal indicative of a luminance of each pixel is written at every predetermined display period, and ii) correction means for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate, a second substrate, and a liquid crystal layer formed between the first substrate and the second substrate;

in the liquid crystal panel, formed is a region made up of a plurality of pixels, the region being defined by a first electrode provided on the first substrate on the side of the liquid crystal layer, and a second electrode provided on the second substrate so as to face the first electrode via the liquid crystal layer, wherein a voltage corresponding to the display signal is applied across the first electrode and the second electrode;

liquid crystal molecules of the liquid crystal layer are vertically aligned without an application of a voltage across the first electrode and the second electrode, and are inclined from a vertical alignment with an application of a voltage across the first electrode and the second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means, and the liquid crystal display apparatus has the following characteristic structure.

That is, the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and an achievement ratio after one period is in a range of from 95% to 100% when the liquid crystal panel is set to a temperature of 5° C., and the second last data signal indicates a maximum luminance display, and the last data signal indicates a minimum luminance display.

According to the foregoing structure, the correction means facilitates a gradation transition to the above degree, and therefore, as long as a gradation transition from the second last gradation to the last gradation is made to a sufficient level, it is possible to attain a current luminance in a level as desired by a gradation transition from the last gradation to the current gradation.

The gradation transition is facilitated by the correction means to the above degree, and therefore, in the case where in the gradation transition from the second last gradation to the last gradation is decay (in the direction of decreasing the luminance), and the gradation transition is made in an insufficient level, the following problem may arise. That is, in the case where the gradation transition from the last transition to the current transition is rise (in the direction of increasing the luminance), the gradation transition may be over facilitated, which may result in an excessive luminance. Particularly, under the outdoor use environment, or even under the indoor use environment, if the liquid crystal panel has not been heated enough by circuits of the liquid crystal apparatus (for example, directly after turning on the power of the liquid crystal display apparatus), an excessive brightness is liable to occur, and an image quality is therefore liable to be deteriorated.

However, according to the structure of the present invention, the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and an achievement ratio after one period is in a range of from 95% to 100% when said liquid crystal panel is set to a temperature of 5° C., and the second last data signal indicates a maximum luminance display, and the last data signal indicates a minimum luminance display, even in the case of driving the liquid crystal display apparatus under the foregoing low temperature conditions, an occurrence of excessive brightness or poor brightness can be suppressed to a level acceptable by the user. Moreover, it is possible to provide a liquid crystal display apparatus, which realizes a high contrast and desirable viewing angle characteristics, while suppressing a deterioration of an image quality due to a difference between a target luminance as specified and an actual luminance of a pixel to a level acceptable by the user, irrespectively of an improved response speed by facilitating gradation transition.

For a fuller understanding of the nature and advantages of the invention, reference should be made to the ensuing detailed description taken in conjunction with the accompanying drawings.

BRIEF DESCRIPTION OF THE DRAWINGS

FIG. 15 is a table showing, a structure, a thickness, a flow viscosity and a driving voltage for each liquid crystal panel adopted for evaluations of display quality.

FIG. 16 is a table showing a response time measured when each liquid crystal panel is driven once in each field.

FIG. 17 is a table showing an achievement ratio measured when each liquid crystal panel is driven once in each field.

FIG. 18 is a table showing $d^2 \cdot \gamma$ measured when each liquid crystal panel is driven once in each field.

FIG. 19 is a table showing $d^2 \cdot \gamma/\Delta V$ when each liquid crystal panel is driven once in each field.

FIG. 20 is a table showing evaluation results with regard to display quality measured when each liquid crystal panel is driven once in each field.

FIG. 33 is a table showing a relationship among $d^2 \cdot \gamma/\Delta V$, achievement ratio and evaluation when each liquid crystal panel is driven once in each field.

FIG. 35 is a table showing a relationship among response time, achievement ratio and evaluation when each liquid crystal panel is driven once in each field.

FIG. 37 is a table showing a response time when each liquid crystal panel is driven at double speed.

FIG. 38 is a table showing an achievement ratio when each liquid crystal panel is driven at double speed.

FIG. 41 is a table showing the relationship among $d^2 \cdot \gamma / \Delta V$, achievement ratio and evaluation when each liquid crystal panel is driven at double speed.

FIG. 42 is a table showing the relationship among response time, achievement ratio and evaluation when each liquid crystal panel is driven at double speed.

FIG. 43 which shows another embodiment of the present invention is a table showing results of evaluation of a display quality of each liquid crystal panel when the gradation transition is less facilitated by the modulation driving processing section as compared to the previous embodiment.

FIG. 53 is a table showing the relationship among $d^2 \cdot \gamma / \Delta V$, achievement ratio and evaluation when each liquid crystal panel is driven once in each field.

FIG. 54 is a table showing the relationship among response time, achievement ratio and evaluation when each liquid crystal panel is driven once in each field.

FIG. 55 is a table showing the relationship among $d^2 \cdot \gamma / \Delta V$, achievement ratio and evaluation when each liquid crystal panel is driven at double speed.

FIG. 56 is a table showing the relationship among response time, achievement ratio and evaluation when each liquid crystal panel is driven at double speed.

DESCRIPTION OF THE EMBODIMENTS

First Embodiment

The following descriptions will explain one embodiment of the present invention with reference to FIG. 1 through FIG. 42. Specifically, a liquid crystal display apparatus 1 in accordance with the present embodiment realizes an improved response speed under general use conditions, by facilitating a gradation transition by means of one parameter which is determined by a gradation transition from the last gradation to the current gradation, irrespectively of a gradation transition from the second last gradation to the last gradation, while maintaining the display quality at high level. The liquid crystal display apparatus 1 of the present embodiment is suitably applied for liquid crystal televisions, liquid crystal monitors, etc.

Figure 2:
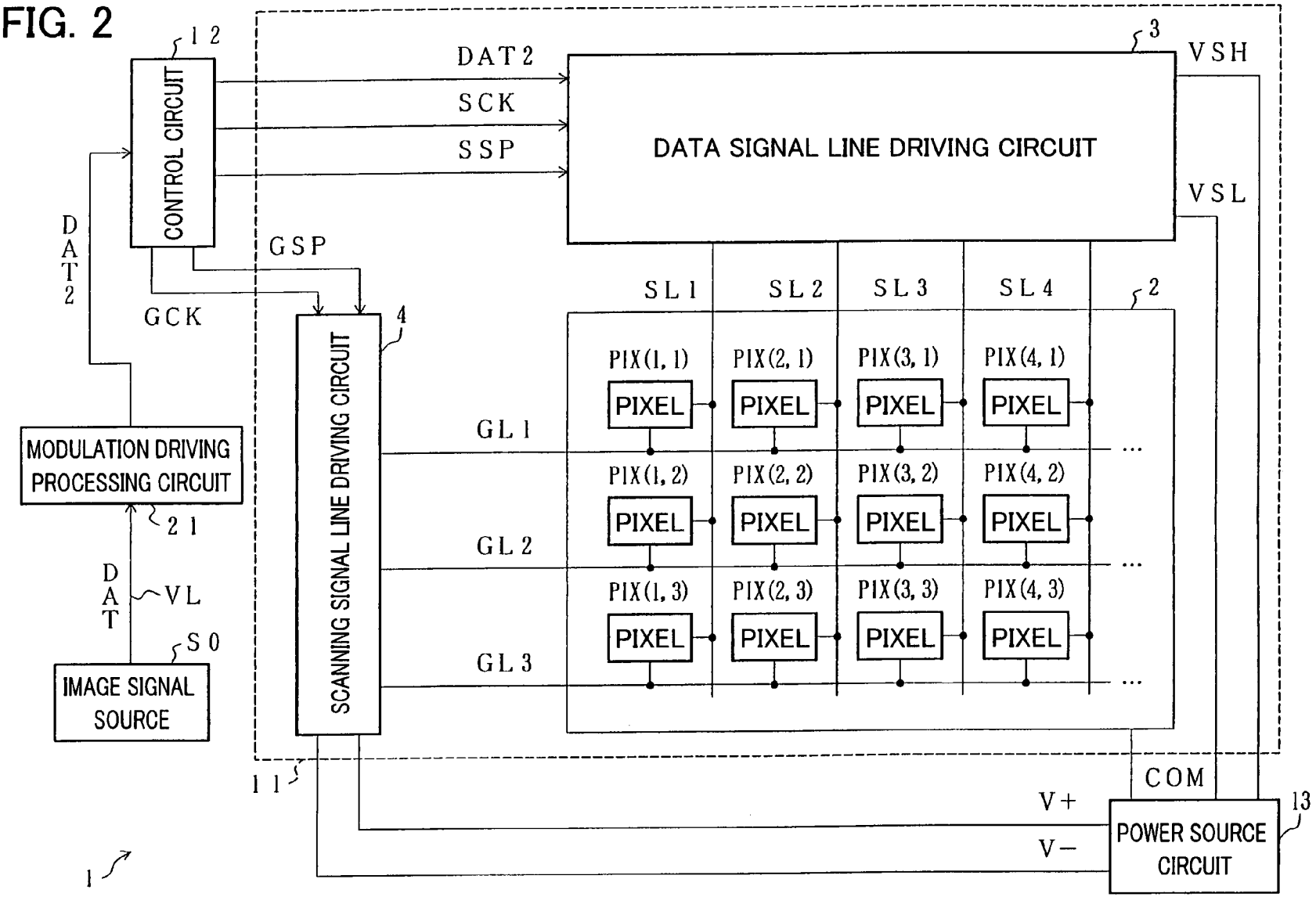
FIG. 2 is a block diagram illustrating essential structures of a liquid crystal display apparatus in accordance with the embodiment of the present invention.

As shown in FIG. 2, a liquid crystal panel 11 (a liquid crystal display apparatus) of the liquid crystal display apparatus 1 includes (a) a pixel array 2 made up of pixels PIX(1, 1) through PIX(n, m) provided in a matrix matrix, (b) a data signal line driving circuit 3 for driving data signal lines SL1 through SLn of the pixel array 2, and (c) a scanning signal line driving circuit 4 for driving scanning signal lines GL1 through GLn of the pixel array 2. The liquid crystal display apparatus 1 further includes (d) a control circuit 12 for supplying control signals to the driving circuits 3 and 4 respectively, and (e) a modulation driving processing section 21 for modulating an image signal to be input to the control circuit 12 so as to facilitate the gradation transition based on the image signal as input from an image signal source S0. Incidentally, these circuits operate by the power supplied from a power source circuit 13.

For example, in an application of the liquid crystal display apparatus 1 to a liquid crystal television, the image signal source S0 corresponds to a tuner section which selects a channel of a television broadcasting signal, and which outputs a television image signal of the channel thus selected. In an application of the liquid crystal display apparatus to a liquid crystal monitor which displays an image signal from an external device such as a computer, the image signal source S0 corresponds to a signal processing section which processes an image signal as input from the external device, and which outputs a monitor signal thus processed.

In the following, before explaining the characteristics of the pixel array 2 in accordance with the present embodiment, the schematic structure and functions of the liquid crystal display apparatus 1 as a whole and the schematic structure and the functions of a modulation driving processing section 21 will be explained. For convenience in explanations, for example, like the i-th data signal line SLi, a reference is made by adding a figure or an alphabetical character indicative of a position, only when a position is to be specified. Otherwise, a reference is made by omitting a character indicative of a position, when it is not necessary to specify the position or when a generic name is given.

The pixel array 2 includes a plurality of data signal lines SL1 through SLn (n data signal lines in this example), a plurality of scanning signal lines GL1 through GLm (m scanning signal lines in this example) that intersect with the data signal lines SL1 through SLn, respectively. When it is assumed that an arbitrary integer i falls within the range of 1 to n, and that an arbitrary integer j falls within the range of 1 to m, a pixel PIX (i, j) is provided for each combination of the data signal line Sli and the scanning signal line GLj. According to the present embodiment, the pixel PIX (i, j) is provided in an area defined by neighboring two data signal lines SL(i-1) and SLi and by neighboring two scanning signal lines GL(j-1) and GLj.

Figure 3:
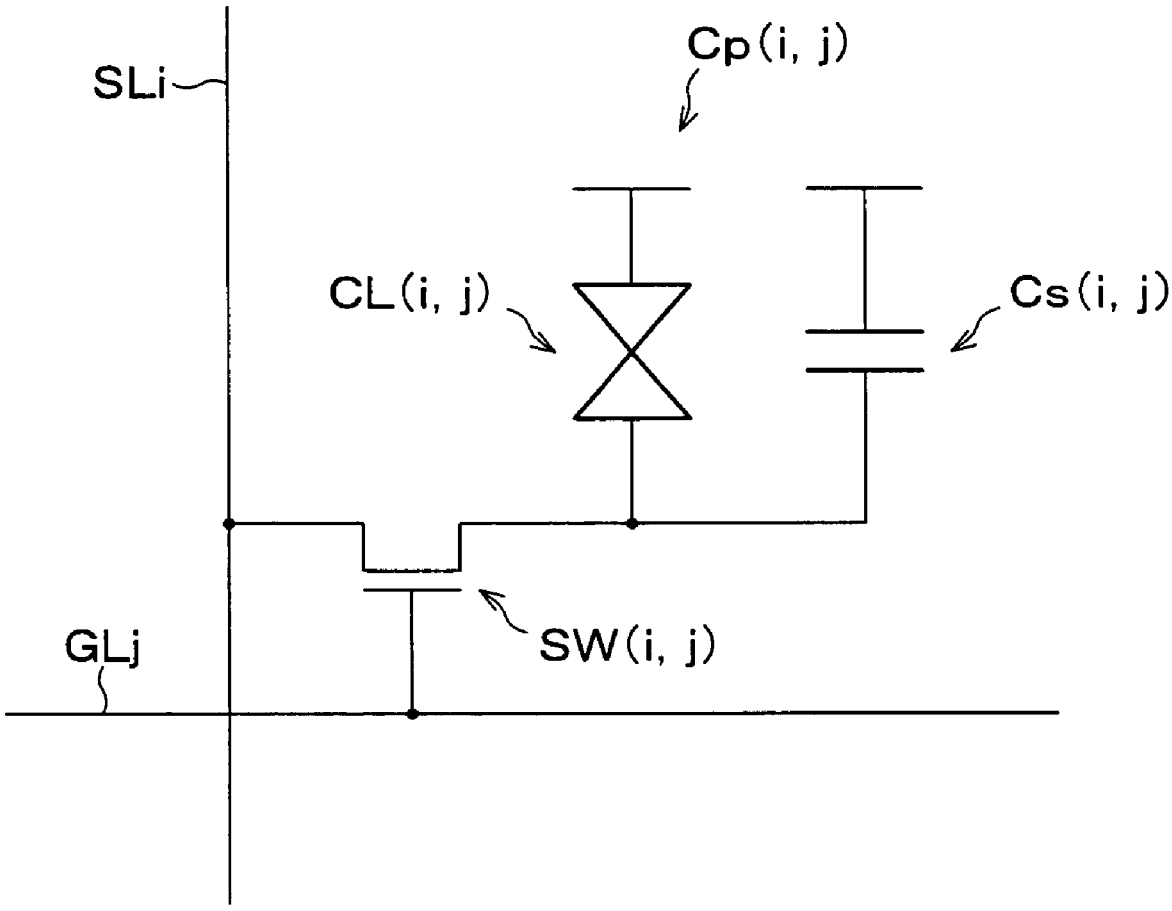
FIG. 3 is a circuit diagram illustrating an example structure of a pixel provided in the liquid crystal display apparatus.

As shown in FIG. 3, the pixel PIX (i, j), for example, includes (i) a field effect transistor SW(i, j), which serves as a switching element, in which a gate terminal is connected to the scanning signal line GLj while a drain terminal is connected to the data signal line SLi, and (ii) a pixel capacitance Cp(i, j) one of the electrodes (later described pixel electrode 121*a*) of which is connected to a source terminal of the field effect transistor SW(i, j). The other electrode (later described opposed electrode 121*b*) of the pixel capacitance Cp(i, j) is connected to a common electrode line that is common to all the pixels PIX. The pixel capacitance Cp (i, j) is made up of a liquid crystal capacity CL(i, j) and an auxiliary capacity Cs(i, j) to be added as necessary.

When the scanning signal line GLj is selected, in the pixel PIX(i, j), the field effect transistor SW(i, j) conducts, and the voltage applied to the data signal line SLi is applied to the pixel capacitance Cp(i, j). Thereafter, the selection period of the scanning signal line GLj is over, and the field effect transistor SW(i, j) turns off. During the off period of the field effect transistor SW(i, j), the pixel capacitance Cp(i, j) keeps a predecessor voltage. The predecessor voltage corresponds to a voltage applied to the pixel capacitance Cp(i, j) in the off state of the field effect transistor SW(i, j). It should be noted here that the transmittance of the liquid crystal varies depending on a voltage to be applied to the liquid crystal capacity CL(i, j). Accordingly, when the scanning signal line GLj is selected and a voltage that varies depending on an image data D to be supplied to the pixel PIX(i, j) is supplied to the data signal line SLi, it is possible to change a display state of the pixel PIX(i, j) in accordance with the image data D.

As shown in FIG. 2, the scanning signal line driving circuit 4 supplies to each of the scanning signal lines GL1 through GLm a signal, such as a voltage signal, indicative of whether or not the scanning signal line is in a selection period. The scanning signal line driving circuit 4 changes the scanning signal line GLj, via which the signal indicative of whether or not the scanning signal line is in a selection period is supplied, in accordance with, for example, a timing signal such as the clock signal GCK or the start pulse signal GSP as supplied from the control circuit 12. This allows the respective scanning signal lines GL1 through GLm to be sequentially selected in response to a predetermined timing.

Further, the data signal line driving circuit 3 carries out at a predetermined timing, a sampling of the image data D supplied to the respective pixels PIX in a time-sharing manner, so as to extract the image data D thus sampled. The data signal line driving circuit 3 also supplies output signals, which vary depending on the respective image data D, to the respective pixels PIX(1, j) through PIX(n, j) corresponding to the scanning signal line GLj which the scanning signal line driving circuit 4 has selected, via the respective data signal lines SL1 through SLn. Incidentally, the data signal line driving circuit 3 determines the above sampling timing and the output timing of the output signal in accordance with the timing signals such as the clock signal SCK and the start pulse signal SSP supplied from the control circuit 12.

In the pixels PIX(1, j) through PIX(n, j), levels of the voltages to be applied to the pixel electrodes 121*a* are adjusted in accordance with the output signals applied to the corresponding data signal lines SL1 through SLn, respectively, while the corresponding scanning signal line GLj is selected. As a result, the transmittances of the respective pixels PIX(1, j) through PIX(n, j) is adjusted, to determine respective luminance levels.

Here, the scanning signal line driving circuit 4 sequentially selects the scanning signal lines GL1 through GLm. Accordingly, all the pixels PIX(1, 1) through PIX(n, m) of the pixel array 2 can be set to have respective brightness levels indicated by respective image data D, thereby updating an image to be displayed in the pixel array 2.

Incidentally, in the liquid crystal display apparatus 1, an image signal DAT supplied from an image signal source S0 to the modulation driving processing section 21 may be transmitted in frame unit (in a unit of full screen). Alternatively, the image signal DAT may be transmitted for every plural fields into which one frame is divided. The following description deals with a case as an example where the image signal DAT is transmitted for every plural fields.

Specifically, in the present embodiment, the image signal DAT, supplied from the image signal source S0 to the modulation driving processing section 21, is transmitted in every field of a plurality of fields (two fields, for example) into which one frame is segmented.

More specifically, when transmitting the image signal DAT to the modulation driving processing section 21 of the liquid crystal display apparatus 1 via an image signal line VL, the image signal source S0 transmits the entire image data for a specific field, and thereafter transmits image data for the next field, for example. Thus, the image signal source S0 transmits image data for respective fields in a time-sharing manner.

The field is made of a plurality of horizontal lines. For example, in a specific field, via the image signal line VL, entire image data for a specific horizontal line are transmitted and thereafter image data for a horizontal line to be transmitted next are transmitted. Thus, the image data for the respective horizontal lines are transmitted in a time-sharing manner.

In the present embodiment, one frame is made up of two fields. Among the horizontal lines constituting one frame, image data of an even-numbered horizontal line is transmitted in an even field. Image data of an odd-numbered horizontal line is transmitted in an odd field. Further, when transmitting image data corresponding to the amount of one horizontal line, the image signal source S0 also drives the image signal line VL in a time-sharing manner. This allows the respective image data to be sequentially transmitted in a predetermined order.

Figure 4:
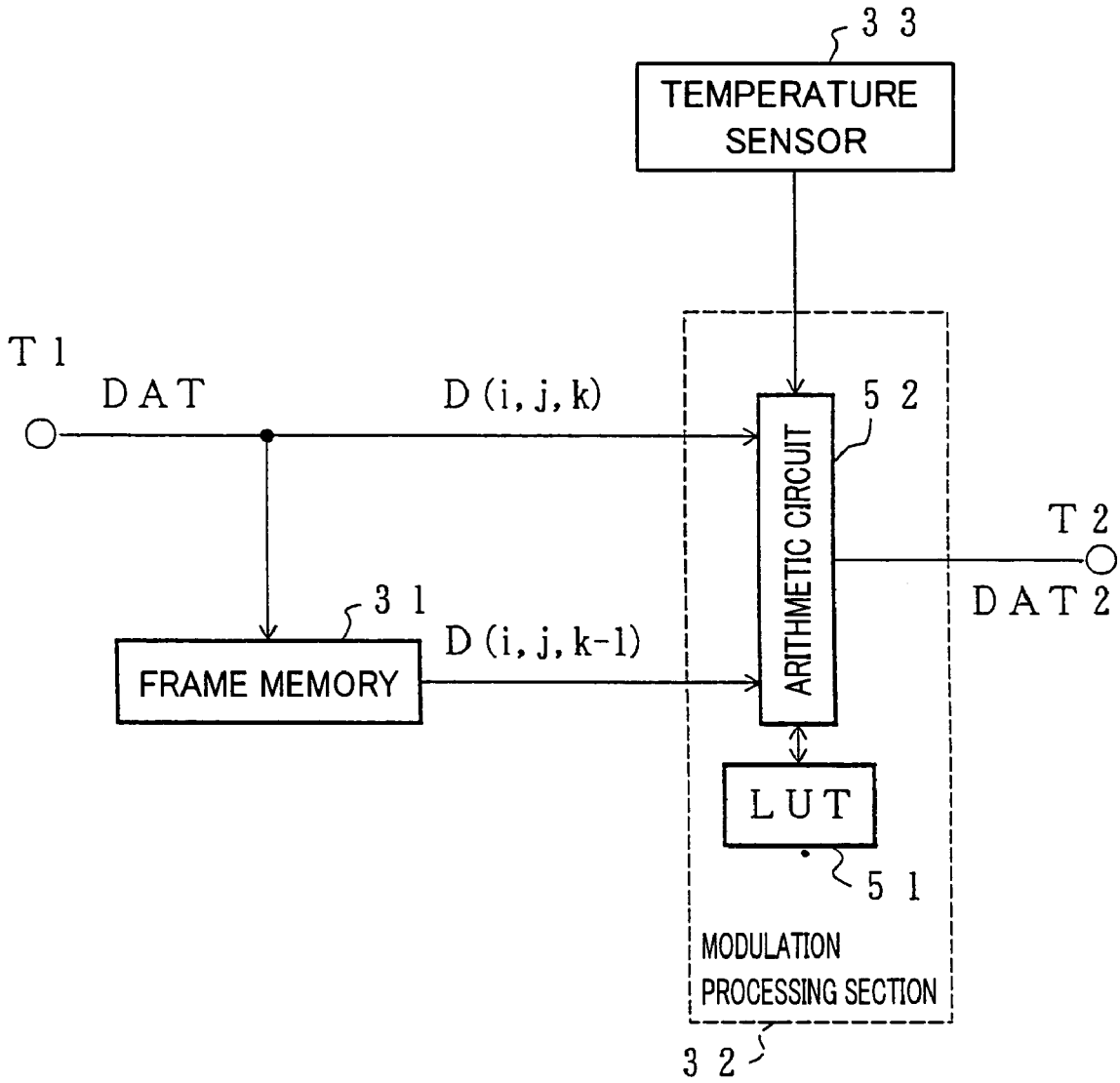
FIG. 4 is a block diagram illustrating essential structures of a modulation driving processing section provided in the liquid crystal display apparatus.
Figure 5:
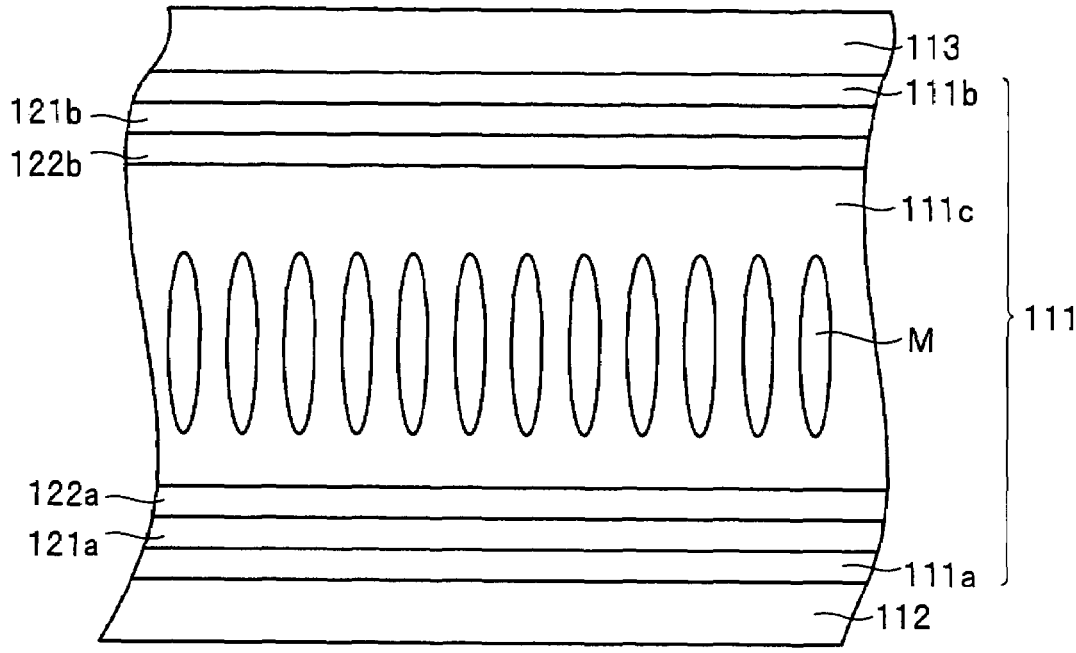
FIG. 5 is a typical depiction illustrating a liquid crystal cell provided in the liquid crystal display apparatus without an application of a voltage.

As shown in FIG. 4, the modulation driving processing section 21 of the present embodiment includes (i) a frame memory 31 that stores image data in an amount corresponding to one frame, to be supplied via an input terminal T1, and (ii) a modulation processing section 32 which modulates image data of a current frame FR(k) so as to facilitate a gradation transition from a last frame FR(k-1) to the current frame FR(k) based on (1) the image data of the current frame FR(k) to be supplied via the input terminal T1, and (2) image data to be supplied to the same pixel PIX(i, j) to which the above image data are supplied which is the image data of the last frame FR(k-1) as read from the frame memory 31, and which outputs the image data as modulated (corrected image data) via the output terminal T2.

It may be arranged such that the modulation processing section 32 obtains the image data D2(*i, j, k*) by storing in the LUT 51 a plurality of data corresponding to all of the combinations of image data D(i, j, k-1) and D(i, j, k), and outputting the data (the correction image data D2(*i, j, k*)) which corresponds to the combination as input. However, the present invention is not limited to this structure. Specifically, in the present embodiment, in order to reduce the memory capacity required for the LUT 51, (i) the target gradations stored in the LUT 51 do not correspond to all the combinations but correspond to several predetermined combinations, and (ii) the modulation processing section 32 obtains the correction image data D2(*i, j, k*) by the calculation for the interpolation. Specifically, the modulation processing section 32 includes a calculation circuit 52 for (i) interpolating the corrected image data corresponding to each of the combinations stored in the LUT 51, and (ii) calculating the correction image data D2(*i, j, k*) corresponding to the combination of image data D(i, j, k-1) and D(i, j, k). It may be arranged, for example, such that the image data D(i, j, k-1) in the last frame FR(k-1) and the image data D(i, j, k) in the current frame FR(k) are divided into eight areas, respectively, and that the corrected image data are stored for combinations of (i) nine image data D(i, j, k) that become both ends of the respective eight areas, and (ii) nine image data D(i, j, k-1) that become both ends of the respective eight areas.

In the present embodiment, a plurality of LUTs 51 are provided so that the corrected image data D2(*i, j, k*) can be adjusted in response to an output from a temperature sensor 33, and the calculation circuit 52 switches a LUT 51 to be referred to in obtaining the corrected image data D2(*i, j, k*) according to the output from the temperature sensor 33.

For example, the modulation processing section 32 of the present embodiment is provided with four LUTs 51 for 5° C., 10° C., 15° C., and 20° C., respectively, and the calculation circuit 52 switches and selects the LUTs 51 according to an output from the temperature sensor 33. It should be noted here that the calculation circuit 52 may obtain the corrected image data D2(*i, j, k*) by referring only to a LUT 51 for a temperature that is proximate to a temperature (an actual panel temperature) which the temperature sensor 33 indicates. Alternatively, the calculation circuit 52 may derive the correction image data D2(*i, j, k*) by (i) referring to two LUTs 51 for respective temperatures that are close to the actual panel temperature, and (ii) interpolating between the two corrected image data that are calculated from the two LUTs 51.

According to the liquid crystal display apparatus 1 in accordance with the present embodiment, even when the response speed of the pixel PIX(i, j) is slow, by facilitating the gradation transition from the last frame FR(k-1) to the current frame FR(k), it is possible for the luminance of the pixel PIX(i, j) to reach a target gradation (a gradation indicated by the image data D(i, j, k) of the current frame FR(k)) in a shorter period of time.

The liquid crystal display apparatus 1 of the present embodiment adopts as the liquid crystal cell, a liquid crystal cell of a vertically aligned mode. In the liquid crystal cell of a vertically aligned mode, liquid crystal molecules are almost vertically aligned with respect to a substrate without an applied voltage, whereas the liquid crystal molecules are obliquely aligned with respect to a vertically aligned state of the liquid crystal molecules with an applied voltage supplied to the liquid crystal capacity CL(i, j) of the pixel PIX(i, j). Such a liquid crystal cell is used in a normally black mode in which a black display is carried out without an applied voltage.

Specifically, as shown in FIG. 4, the pixel array 2 of the present embodiment includes a liquid crystal cell 111 (a liquid crystal display apparatus) of a vertically aligned mode (a VA mode), and polarization plates 112 and 113 provided on both sides of the liquid crystal cell 111. The polarization plates 112 and 113 are disposed such that an absorption axis AA112 of the polarization plate 112 is orthogonal to an absorption axis AA113 of the polarization plate 113.

The liquid crystal cell 111 includes (i) a TFT (Thin Film Transistor) substrate 111*a* provided with pixel electrodes 121*a* corresponding to respective pixels PIX, (ii) an opposed substrate 111*b* provided with an opposed electrode 121*b*, and (iii) a liquid crystal layer 111*c* that is made of a nematic liquid crystal having a negative dielectric anisotropy and is held tight by the substrates 111*a* and 111*b*. Note that the liquid crystal display apparatus 1 of the present embodiment can carry out a color display, and the opposed substrate 111*b* is provided with color filters (not shown) corresponding to colors of the respective pixels PIX.

The TFT substrate 111*a* is further provided with a vertically aligned layer 122*a* on its surface on the side of the liquid crystal layer 111*c*. Similarly, the opposed substrate 111*b* is provided with a vertically aligned layer 122*b* on its surface on the side of the liquid crystal layer 111*c*. As will be explained in detail later, the electrodes 121*a* and 121*b* are arranged such that with an applied voltage across the electrodes 121*a* and 121*b*, an electric field is generated in a direction inclined with respect the surfaces of the substrates 111*a* and 111*b* at least in a part of the pixel (i, j). Incidentally, since these substrates 111*a* and 111*b* are provided so as to face one another, respective normal line directions and in-plane directions are simply referred as a normal line direction and an in-plane direction if not necessary to specify. Here, one of these substrates 111*a* and 111*b* correspond to the first substrate, and the other corresponds to the second substrate in claims. Further, one of the electrodes 121*a* and 121*b* corresponds to the first electrode, and the other corresponds to the second electrode.

In the pixel array 2, without an application of a voltage across the electrodes 121*a* and 121*b*, by the alignment regulation force of the vertically aligned layers 122*a* and 122*b*, liquid crystal molecules M of the liquid crystal layer 111*c* which is provided between the both substrates 111*a* and 111*b* are aligned almost vertically with respect to the surfaces of the substrates 111*a* and 111*b*.

In this state (without an application of a voltage), the light incident on the liquid crystal cell 111 from a normal line direction has no phase difference caused by the respective liquid crystal molecules, and pass through the liquid crystal cell 111 while keeping the polarized state. This causes the light incident on a polarization plate on an outgoing side (here, for example, the polarization plate 112) to become linearly polarized light whose polarization direction is substantially parallel to the absorption axis AA112 of the polarization plate 112, resulting in that the light cannot pass through the polarization plate 112. As a result, the pixel array 2 can display in a bright black color.

Figure 6:
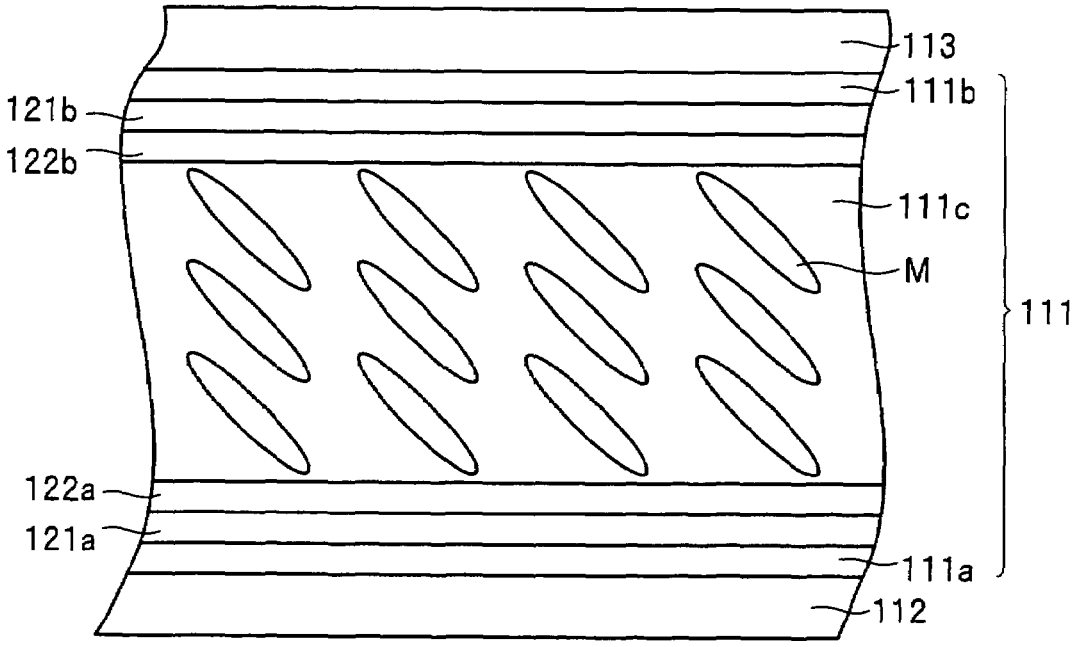
FIG. 6 is a typical depiction illustrating a liquid crystal cell provided in the liquid crystal display apparatus with an application of a voltage.

On the other hand, with an application of a voltage across the electrodes 121*a* and 121*b*, an electric field is generated with an electric field line inclined with respect to the surfaces of the substrates 11*a* and 11*b*, which, in turn, makes the liquid crystal molecules align in an oblique direction in an angle according to an applied voltage from the state in the normal line direction of the substrates 111*a* and 111*b* (see FIG. 6). This allows the light passing through the liquid crystal cell 111 to have a retardation that varies depending on the voltage thus supplied.

Note that the polarization plates 112 and 113 are disposed such that the absorption axis AA112 of the polarization plate 112 is orthogonal to the absorption axis AA113 of the polarization plate 113. This allows the light incident on a polarization plate on an outgoing side (for example, the polarization plate 112) to become elliptically polarized light that varies depending on the retardation caused by the liquid crystal cell 111, such that the incident light partially passes through the polarization plate (the polarization plate 112). Thus, it is possible to control the amount of the outgoing light from the polarization plate 112 in response to the voltage thus supplied, thereby permitting carrying out of the gradation display.

The liquid crystal cell 111 of the present embodiment is a liquid crystal cell of a multidomain alignment or of a radical and oblique alignment, in which with an application of a voltage, regions having respectively different alignment directions of the liquid crystal molecules M coexist within a pixel.

Figure 7:
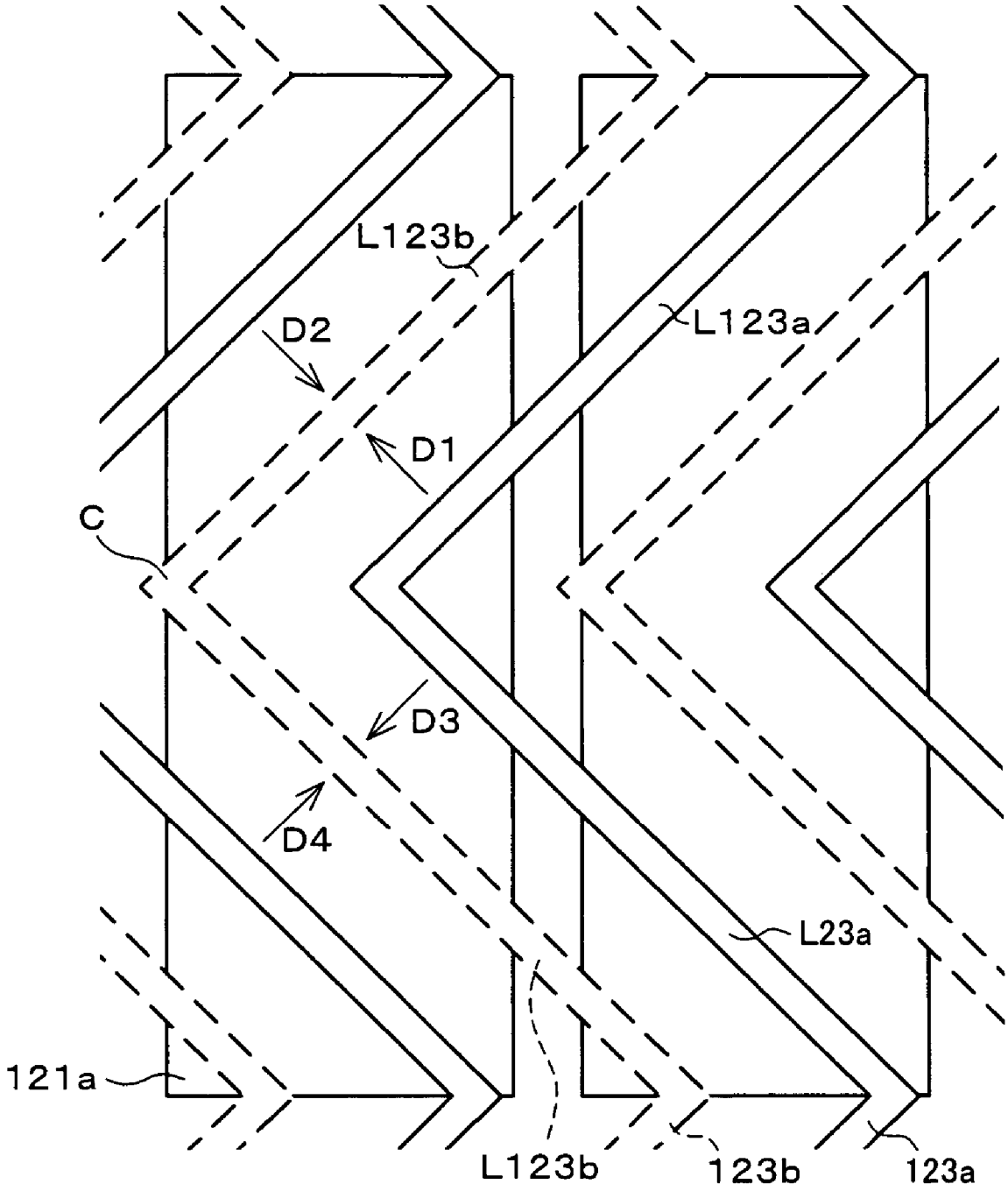
FIG. 7 which shows an example structure of the liquid crystal cell is a plan view of an area around the pixel electrode.
Figure 8:
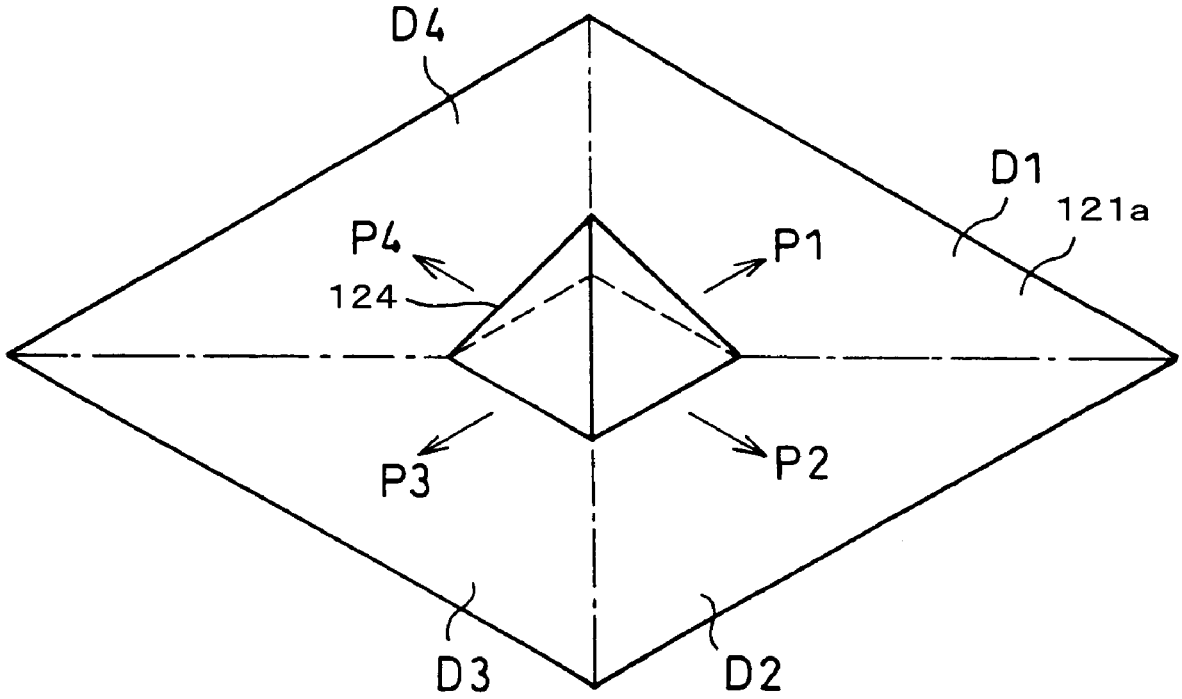
FIG. 8 which shows another example structure of the liquid crystal cell is a perspective view of the pixel electrode.
Figure 9:
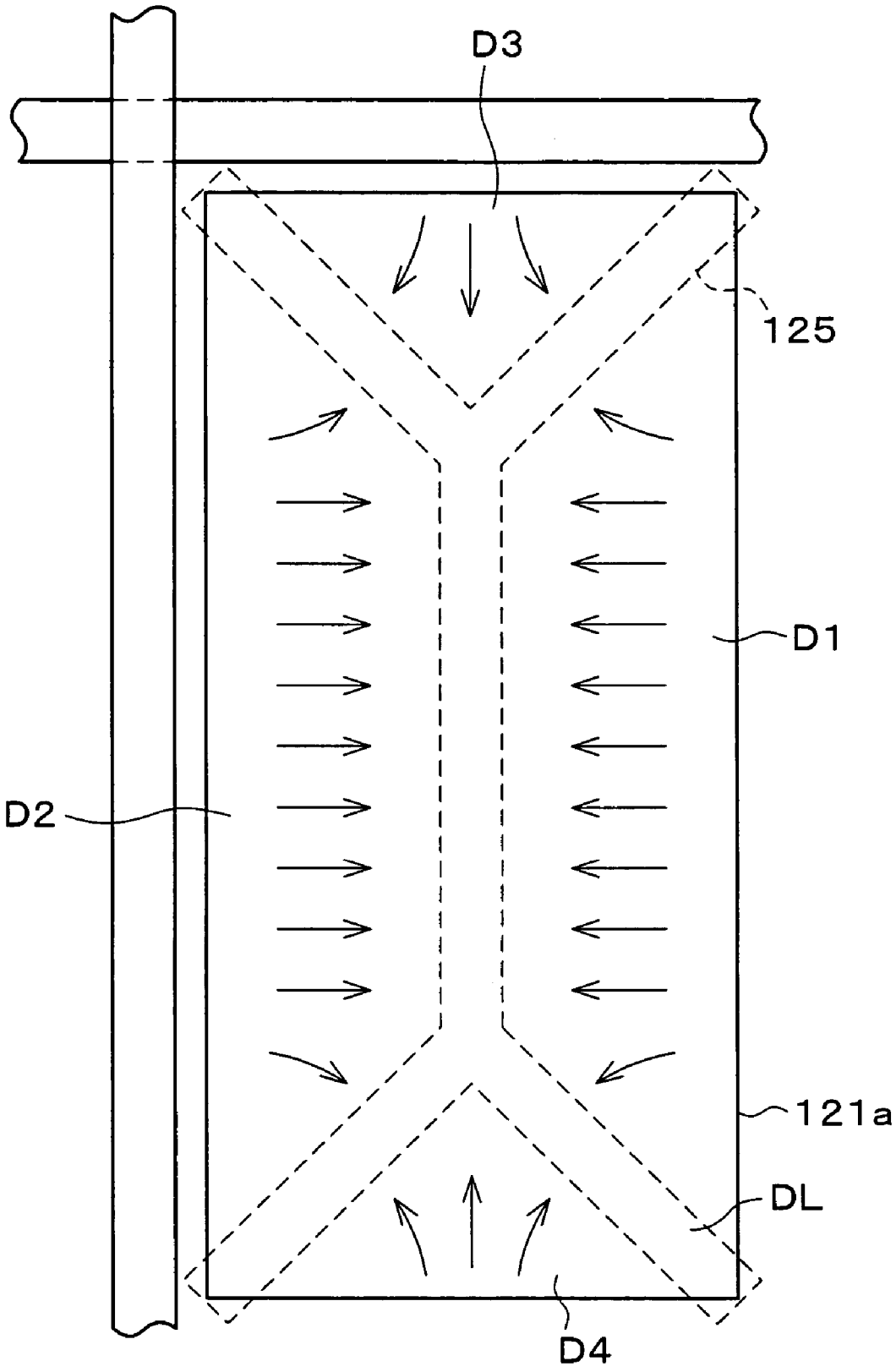
FIG. 9 which shows still another example structure of the liquid crystal cell is a plan view of an area around the pixel electrode.

In the following, example structures of the liquid crystal cells of the multidomain alignment and of radical and oblique alignment will be explained in reference to FIG. 7 through FIG. 12. FIG. 7 through FIG. 9 show liquid crystal cells of the multidomain alignment wherein each of the pixels PIX is divided into a plurality of domains, and alignment directions, i.e., directions (in-plane components of alignment directions) in which the liquid crystal molecules M are obliquely aligned with an application of a voltage are controlled to be different for each domain. In this example, each pixel PIX is divided into four domains D1 to D4, and further, the polarization plates 112 and 113 shown in FIG. 4 are disposed such that the respective absorption axes AA112 and AA113 form an angle of 45° with the in-plane components of the liquid crystal molecules in the alignment directions in the respective domains D1 through D4.

More specifically, as shown in FIG. 7, the pixel electrode 121*a* includes a string of projections 123*a*, aligned in a stripe manner, each having a cross section in a shape of dancette and an in-plane shape of zigzag so as to bend substantially at a right angle. The opposed electrode 121*b* includes slits 123*b* (aperture: an area in which an electrode is formed), provided in a stripe manner, that have an in-plane shape of zigzag so as to bend at substantially a right angle. The string of the projections 123*a* and the slits 123*b* are provided at a predetermined interval. The string of the projections 123*a* is prepared by applying photosensitive resin onto the pixel electrode 121*a*, and then carrying out the photolithographic process. These electrodes 121*a* and 121*b* are formed by forming ITO (Indium Tin Oxide) films on the substrates 111*a* and 111*b*, by applying photoresists onto the ITO films, though the process of exposure and development, and then by etching electrode patterns, respectively. The slits 123*b* is formed by carrying out patterning such that the areas corresponding to the slits 123*b* are removed in the process of forming of the opposed electrode 121*b*.

In the vicinity of the sequence of the projections 123*a*, the liquid crystal molecules are aligned perpendicular to an oblique plane of the sequence of the projections 123*a*. Further, with an application of a voltage, the electric field in a vicinity of the sequence of the projections 123*a* inclines parallel to the oblique plane of the sequence of the projections 123*a*. Since this causes each major axis of the liquid crystal molecules to incline in a direction that is perpendicular to the electric field, the liquid crystal molecules align in a direction oblique to the surface of the substrate. Further, because of the continuity of the liquid crystal, the liquid crystal molecules away from the oblique plane of the sequence of the projections 123*a* are also aligned in a direction similar to that of the liquid crystal molecules in the vicinity of the inclined plane of the string of the projections 123*a*.

Similarly, with an application of a voltage, an electric field is generated with an electric field line inclined with respect to the surface of the substrate in the vicinity of an edge of the slits 123*b*, the edge indicating a boundary between the slits 123*b* and the opposed electrode 121*b*, which, in turn, align the liquid crystal molecules in an oblique direction to the surface of the substrate. Further, because of the continuity of the liquid crystal, the liquid crystal molecules in the vicinity of the edge are also aligned in a direction similar to that of the liquid crystal molecules in the vicinity of the edge.

Here, it is assumed in each of the sequence of the projections 123*a* and the slits 123*b* that a part between neighboring two corner parts C is referred to as a line part. In an area between a line part 123*a* of the sequence of the projections 123*a* and its neighboring line part 123*b* of the slits 123*b*, an in-plane component of the liquid crystal molecules in an alignment direction is identical with that in a direction from the line part L123*a* toward the line part L123*b*.

The string of the projections 123*a*, and the slits 123*b* bend at the corner part C, substantially at a right angle. This allows the alignment directions of the liquid crystal molecules to be divided into four in a pixel PIX, thereby forming domains D1 through D4 in a pixel PIX, whose alignment directions of the liquid crystal molecules are different from each other.

In another arrangement in which the liquid crystal adopts a pixel electrode 121*a* shown in FIG. 8, the string of the projections 123*a* and the string of the slits 123*b* are omitted, and the pixel electrode 121*a* includes a quadrangular projection 124. It should be noted here that the projection 124 can be obtained by applying the photosensitive resin onto the pixel electrode 121*a* and by carrying out the photolithography process, like the case of forming the string of the projections 123*a*.

In the foregoing arrangement, in an area around the projection 124, the liquid crystal molecules are aligned in a direction perpendicular to each of the oblique planes of the projection 124. Further, with an application of a voltage, an electric field generated from around the projection 124 has an electric field line inclined in a direction parallel to the inclined plane of the projection 124. Therefore, with an application of a voltage, the in-plane components of the alignment angle of the liquid crystal molecule are equal to those (the direction P1, P2, P3, or P4) of the normal line direction of the nearest inclined plane. Thus, the pixel area is divided into four domains D1 through D4 that have different alignment directions during the inclination.

Incidentally, for a large-size liquid crystal television of such as 40-inch, a large size pixel is adopted, for example, a pixel of 1 mm. In this case, with only one projection 124 for each pixel electrode 121*a*, the alignment becomes unstable resulting from an insufficient alignment regulation force. Accordingly, it is preferable that a plurality of projections 124 be provided on the respective pixel electrodes 121*a*, when a sufficient alignment force cannot be ensured like the above case.

Further, for example, as shown in FIG. 9, it is also possible to realize the multiple-domain alignment by providing an alignment control window 125 which is formed by Y-shaped slits, symmetrically interconnected in an up-and-down direction, on the opposed electrode 121*b* of the opposed substrate 111*b*. The up-and-down direction corresponds to a direction parallel to some one of the sides of the pixel electrode 121*a* having substantially an orthogonal shape. The alignment control window 125 corresponds to areas in which no electrode is provided.

In the arrangement, in an area, directly underneath the alignment control window 125, of the surface of the opposed substrate 111*b*, no electric field which causes the liquid crystal molecules to incline is generated, even when a voltage is supplied. This allows the liquid crystal molecules to vertically align. In contrast, in an area, around the alignment control window 125, of the surface of the opposed substrate 111*b*, generated is the electric field which extends around the alignment control window 125 as it comes closer to the opposed substrate 111*b*. The liquid crystal molecules incline in such a direction that their major axes are perpendicular to the electric field. This causes the liquid crystal molecules to have in-plane components of the alignment direction that is substantially perpendicular to each of the sides of the alignment control window 125 as indicated by arrows shown in FIG. 9.

Figure 10:
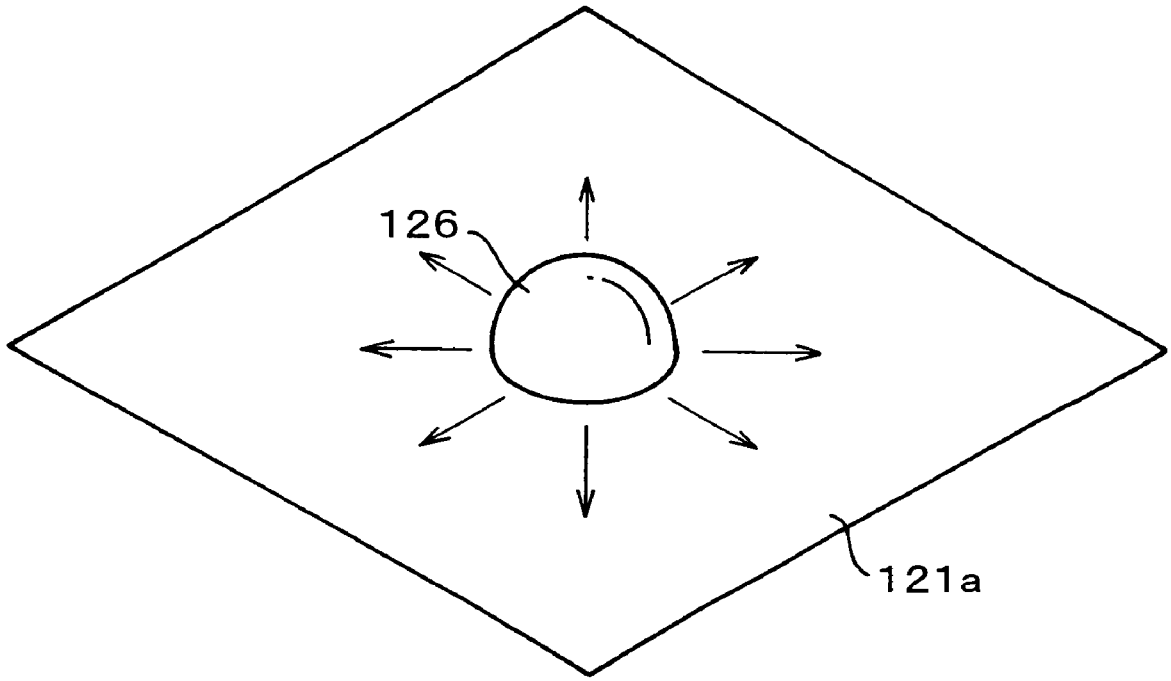
FIG. 10 which shows another example structure of the liquid crystal cell is a perspective view of the pixel electrode.
Figure 11:
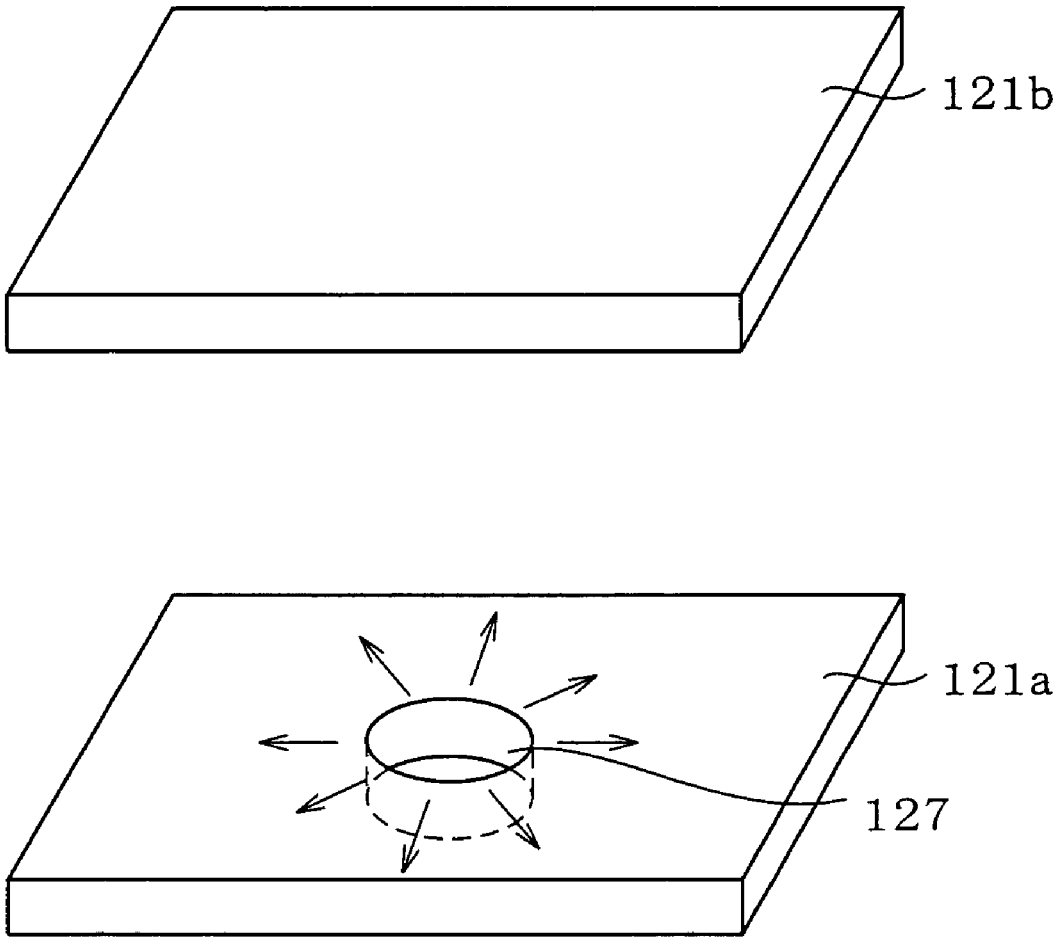
FIG. 11 which shows still another example structure of the liquid crystal cell is a perspective view of the pixel electrode and the counter electrode.
Figure 12:
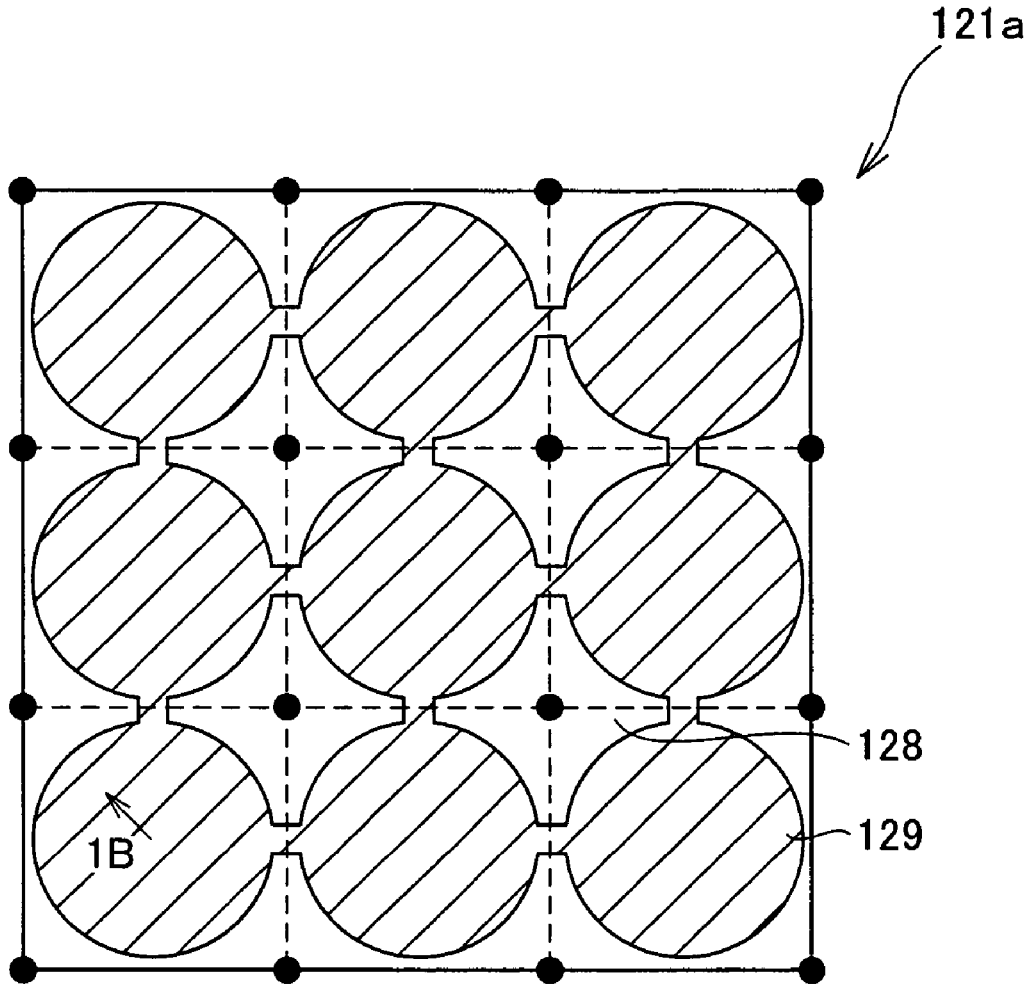
FIG. 12 which shows still another example of the liquid crystal cell is a plan view of the pixel electrode.

FIG. 10 through FIG. 12 show structures of radical liquid crystal cells of oblique alignment. Specifically, in the structure of FIG. 10, a substantially semispherical projection 126 is provided, in place of the projections 124 shown in FIG. 8. In this case, in the vicinity of the projection 126, the liquid crystal molecules are aligned in a direction perpendicular to the surface of the projection 126. Further, when a voltage is supplied, the electric field of the projection 126 inclines so as to be parallel to the surface of the projection 126. On this account, the liquid crystal molecules are easy to radically incline with a central focus on the projection 126, when the liquid crystal molecules incline in response to the voltage supply. This allows the respective liquid crystal molecules of the liquid crystal cell 111 to radically and obliquely align. The projection 126 can also be obtained in accordance with the steps similar to those of the projection 124. As in the case of the projections 124, it is preferable to provide a plurality of projections 126 on the respective pixel electrodes 121*a*, in cases where the shortage in the controlling of the alignment occurs.

In the arrangement shown in FIG. 11, a circular slit 127 is provided in the pixel electrode 121*a*, in place of the projection 124 shown in FIG. 8. On this account, in an area, directly above the circular slit 127, of the surface of the pixel electrode 121*a*, no electric field which causes the liquid crystal molecules to incline is generated in response to the voltage supply. This causes the liquid crystal molecules to vertically align in such an area. In contrast, in an area, in the vicinity of the circular slit 127, of the surface of the pixel electrode 121*a*, generated is the electric field which extends around the slit 127 as it comes closer to the slit 127 in a thickness direction. The liquid crystal molecules are inclined in a direction in which their major axes are perpendicular to the electric field. The liquid crystal molecules away from the slit 127 also align in the similar direction because of the continuity of the liquid crystal. Accordingly, when the voltage is supplied to the pixel electrode 121*a*, the respective liquid crystal molecules align such that their in-plane components of the alignment direction are radically extend with a center focus on the slit 127. Namely, the respective liquid crystal molecules align such that the in-plane components of the alignment direction are axisymmetric with respect to the center of the slit 127. The inclination of the electric field varies depending on the supplied voltage. Accordingly, it is possible to control the components of the normal line direction of the substrate, i.e., to control the tilt angle of the liquid crystal molecules in accordance with the supplied voltage. When the supplied voltage increases, the tilt angle with respect to the normal line direction of the substrate increases, accordingly. This allows the respective liquid crystal molecules to align (i) substantially parallel to the surface of the display screen and (ii) radically in the in-plane. Like the projection 126, it is preferable to provide a plurality of slits 127 on the respective pixel electrodes 121*a*, in cases where the shortage in the controlling of the alignment occurs.

The pixel electrode 121*a* may be arranged such that the area in which no electrode is provided (i.e., the slit) and the area in which the electrode is provided may be replaced with each other. More specifically, in the pixel electrode 121*a* shown in FIG. 27, a plurality of slits 128 are formed in such a manner that a center of each silt 128 forms a tetragonal lattice, and a solid-core section (hereinafter, referred to as a unit solid-core section) 129 has an elliptical shape. The unit solid-core section 129 is substantially enclosed by four slits 128, each of which is disposed on each of four lattice points that constitute one unit lattice. Each slit 128 has four edges, each of has a quadrant arch. The slit 128 has a starlike outer shape, and has a four-fold axis at its center. Incidentally, the pixel electrode 121*a* is constituted by a conductive film such as ITO film. For example, after providing the conductive film, the conductive film is removed so as to have the starlike outer shapes, and then the plural slits 128 are formed. The plurality of slits 128 are formed for each pixel electrode 121*a*. In contrast, the solid-core section 129 is basically constituted by a single continuous conductive film.

The foregoing explanations have been given through the case wherein the slits 128 are provided in such a manner that a center of each slit 128 forms a tetragonal lattice. However, the present invention is not intended to be limited to the foregoing structure. For example, the slits 128 may be provided so as to form a lattice in other shape, like a rectangular shape. Similarly, the foregoing explanations have been given through the case wherein the slit 127 and the solid-core section 129 have substantially a circular shape. However, the present invention is not intended to be limited to the foregoing structure, and those in other shapes including but not limited to an elliptical shape, a rectangular shape, etc., may be adopted. In either arrangement, if a liquid crystal cell satisfies the following conditions (i) and (ii), the same effects may be obtained: (i) the liquid crystal molecules are vertically aligned without an application of a voltage, whereas the electric field oblique to the surface of the substrate is formed in the area (the edge area) in a vicinity of the boundary between the area in which the electrode is provided and the area in which no electrode is provided with an application of a voltage the pixel electrode; and (ii) the alignment direction of liquid crystal molecules is determined in accordance with the oblique electric field thus generated. As shown in FIG. 12, however, when each center of the slit 128 constitutes the tetragonal lattice and the solid-core section 129 has an elliptical shape, it is possible to uniformly disperse the alignment directions of the liquid crystal molecules in the pixel PIX (i, j). As a result, it is possible to realize a liquid crystal display apparatus 1 having improved viewing angle characteristics.

As illustrated in the structures of FIG. 7 to FIG. 12, in the liquid crystal cell of the multidomain alignment and radical and oblique alignment, regions having different alignment directions of liquid crystal molecules M coexist in each pixel. Therefore, even in the case where the light passing through the liquid crystal molecule cannot have a phase contrast when the liquid crystal cell 111 is seen from the direction parallel to the alignment direction of the liquid crystal molecule in a prescribed region, a liquid crystal molecule in another region may apply a phase contrast to the light passing therethrough. This allows the respective domains to optically compensate to each other. As a result, it is possible to improve the display quality when obliquely viewing the liquid crystal cell 111, thereby realizing an enlarged viewing angle.

In particular, in the case of radical and oblique alignment, the alignment direction of each liquid crystal molecule is subjected to successive changes, and different from the multidomain alignment, a boundary between domains does not exist. As a result, an uniform wide viewing angle can be realized not only in four directions but in any direction.

Furthermore, according to the liquid crystal display apparatus 1 in accordance with the present embodiment, since the modulation driving processing section 21 (see FIG. 2) is provided, an improved response speed can be realized by facilitating the gradation transition. As a result, it is possible to provide a liquid crystal display apparatus 1 which realizes of high contrast and desirable viewing angle characteristic while realizing a high response speed.

Earnest research and developments were made by inventors of the present invention to realize an improved image quality of the liquid crystal display apparatus 1 in accordance with the present embodiment, wherein a liquid crystal panel of a vertical alignment in which liquid crystal molecules are obliquely aligned with an application of a voltage is driven by facilitating the gradation transition from the last gradation to the current gradation. As a result, the present invention can be achieved by discovering that for liquid crystal display apparatus 1 wherein the degree of facilitating the gradation transition is set to such degree that the actual luminance of the pixel PIX becomes the level indicated by the image data D (i, j, k) of the current frame FR (k), when the achievement ratio after one display period (driving frequency: one field when driving once in each field) falls in a range of from 95% to 100%, an occurrence of an excessive brightness or a poor brightness can be suppressed to the level acceptable by the user, and that to achieve the foregoing effect, it is necessary to select the parameter $d^2 \cdot \gamma/\Delta V$ [$mm^4/(V \cdot s)$] defined by the thickness d [μm], the flow viscosity γ of the liquid crystal panel at the panel temperature of 5° C., and a difference ΔV [V] in liquid crystal layer application voltage between the maximum luminance display and the minimum luminance display, to fall in the below-defined range. In the present application, the achievement ratio indicates the ratio of the luminance of the pixel actually displayed in the liquid crystal panel with respect to the luminance as specified (target luminance), defined by the following formula:

Achievement Ratio=(actual current luminance−last target luminance)/(current target luminance−last target luminance).

When image data D is converted from a value indicative of a maximum luminance display to a value indicative of a minimum luminance display, the achievement ratio after one field is obtained by deducting from 100%, the transmittance Tr after one field (regulated at the maximum luminance display). Incidentally, the transmittance Tf after one field more specifically indicates the transmittance Tf of the period in which a signal to be converted from a value indicative of a maximum luminance display to a value indicative of a minimum luminance display is input, i.e., the period directly before the period in which the next signal is to be input.

Specifically, in the case where it is not possible to reach the target luminance level by the gradation transition from the second last gradation to the last gradation even when driving by facilitating the gradation transition, if in the subsequent frame, the gradation transition is facilitated by assuming that the gradation transition from the second last transition to the last transition can be made to a sufficient level, the gradation transition cannot be facilitated approximately.

Figure 13:
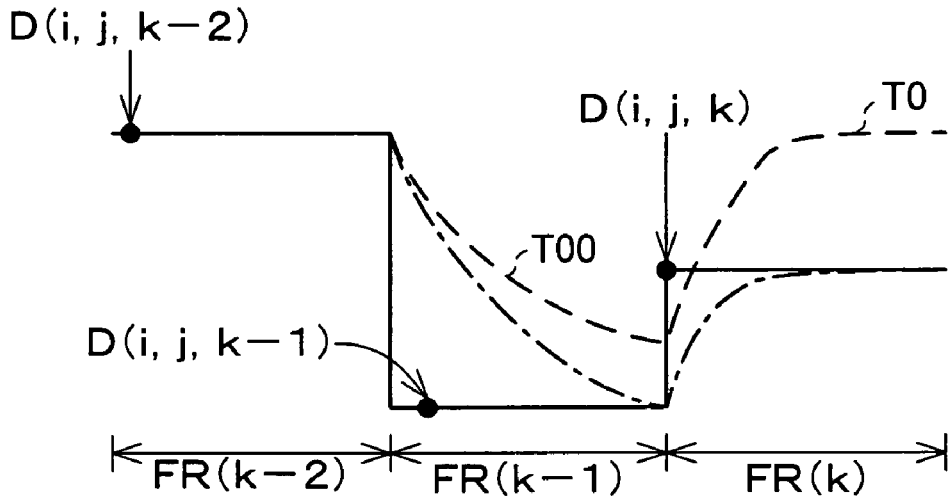
FIG. 13 is a timing chart which shows an actual luminance level in the case where a transition from a second last gradation to a current transition is from rise to decay.

For example, as shown in FIG. 13, in the case where the luminance indicated by the image data D (i, j, k-1) of the last frame FR (k-1) is lower than the luminance indicated by the image data D(i, j, k-2) of the second last frame FR (k-2), and the luminance indicated by the image data D (I, j, k) of the current frame FR (k) is higher than the luminance indicated by the image data D (i, j, k-1) of the last frame FR (k-1), i.e., the case wherein the gradation transition from the second last transition indicated by the image data D(i, j, k-2) of the second last frame FR (k-2) to the last transition indicated by the image data D (i, j, k-1) of the last frame FR (k-1) is decay, and the gradation transition from the luminance indicated by the image data D (i, j, k-1) of the last frame FR (k-1) to the luminance indicated by the image data D (i, j, k) of the current frame FR (k-1) is rise, a voltage signal to be input to a pixel PIX (i, j) of the pixel array 2 changes as indicated by the solid line in FIG. 13. As indicated by the dotted line or dot-dashed line, the luminance of the pixel PIX (i, j) changes following changes in voltage signal; however, as indicated by the dotted line. Here, if pixels are driven in the current frame FR (k) in the same manner as the case where the gradation transition is made in a sufficient level as indicated by the dashed line, despite of that the gradation transition T00 made from the second last gradation to the last gradation is in fact insufficient, and the luminance at a start of the current frame FR (k) is not reduced to a sufficiently low level, the gradation transition from the last gradation to the current gradation would be as indicated by T0, and a problem of generating an excessive brightness occurs resulting from an over facilitation of gradation transition.

Figure 14:
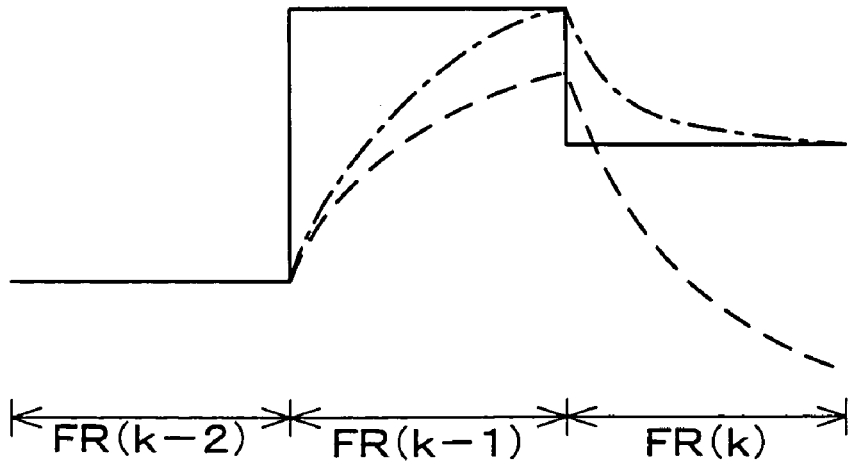
FIG. 14 is a timing chart which shows an actual luminance level in the case where a transition from a second last transition to a current transition is from rise to decay.

On the other hand, as indicated by the solid line in FIG. 14, when the gradation transition from the second last gradation to the current gradation is from rise to decay, if pixels are driven in the current frame FR (k) in the same manner as the case where the gradation transition is made in a sufficient level as indicated by the dashed line, despite of that the gradation transition made from the second last gradation to the last gradation is in fact insufficient, and the luminance at a start of the current frame FR (k) is not raised to a sufficiently high level, a problem of generating a poor brightness occurs resulting from an over facilitation of gradation transition.

In contract, according to the liquid crystal display apparatus 1 in accordance with the present embodiment, $d^2 \cdot \gamma/\Delta V$ [$mm^4/(V \cdot s)$] of the liquid crystal panel 11 is given by the following formula:

$$d^2 \cdot \gamma/\Delta V \leqq 41 \times 10^{-6} \quad (1)$$

wherein d [μm] is a thickness of the liquid crystal panel, γ is a flow viscosity at the panel temperature of 5° C., and ΔV [V] is a difference in liquid crystal layer application voltage between the maximum luminance display and the minimum luminance display.

According to the foregoing liquid crystal display apparatus 1 in accordance with the present embodiment, the luminance achievement ratio (actual luminance/target luminance) after one field of the liquid crystal panel 11 can be maintained at 95% or above.

With the foregoing structure, for example, for an outdoor setting, even under the condition that the panel temperature (temperature of the liquid crystal cell 11) is 5° C., an occurrence of an excessive brightness or a poor brightness can be suppressed to a sufficient level, thereby realizing beneficial characteristics of the liquid crystal display apparatus 1, i.e., a high contrast, a desirable oblique viewing angle characteristic, and a high response speed.

In the following, results of measurements made with respect to samples of the liquid crystal panel 11 with regard to display speed (transmittance after one field) and the evaluation of the display quality will be explained. In the evaluations, as shown in the Table of FIG. 15, liquid crystal panels K1 to K22 of 22 types are adopted. In the Table, the structure "CPA" (Continuous Pinwheel Alignment) indicates a liquid crystal panel of the radical oblique alignment structure shown in FIG. 12, and the structure "MVA" indicates a liquid crystal panel of the multidomain alignment structure as shown in FIG. 7. Incidentally, it was confirmed from the measurements that the results of evaluations were the same for other liquid crystal panels of radical oblique alignment structure or the multi-domain alignment structure shown in FIG. 8 through FIG. 11. The values indicative of flow viscosity in the figures are measured values. In these Figures, the driving voltage indicates a voltage (V255) for white display and a voltage (V0) for a black display.

For respective liquid crystal panels K1 to K22, the response time $\tau$ and the current gradation achievement ratio after one field were measured without facilitating the gradation transition, i.e., by applying a voltage according to the target gradation irrespectively of the last gradation. The results of this measurement are shown in FIG. 16 and FIG. 17.

In these Figures, the gradation achievement ratio is obtained by deducting from 100%, the transmittance Tr after one field (regulated at a maximum luminance display) when converting the image data D from the value indicative of the maximum luminance display to the value indicative of the minimum luminance display. On the other hand, the response time $\tau$ indicates a time required for a change in luminance from 100% to 10% when the gradation transition is made from a white display to a black display wherein the luminance of the pixel PIX is 100% for while display and 0% for black display. In FIGS. 16 and 17 and also in figures to be explained later, not only the results of measurements when the panel temperature is set to 5° C. but also the results of measurements when the panel temperature is set to 25° C. are shown.

With respect to each of the liquid crystal panel K1 to K22, $d^2 \cdot \gamma / \Delta V$ was obtained from the thickness d[μm], the flow viscosity $\gamma$ [$mm^2$] of the liquid crystal panel, and a difference in liquid crystal layer application voltage $\Delta V$ [V] between a maximum luminance display and a minimum luminance display or a response speed as shown in FIG. 18 and FIG. 19.

Figure 21:
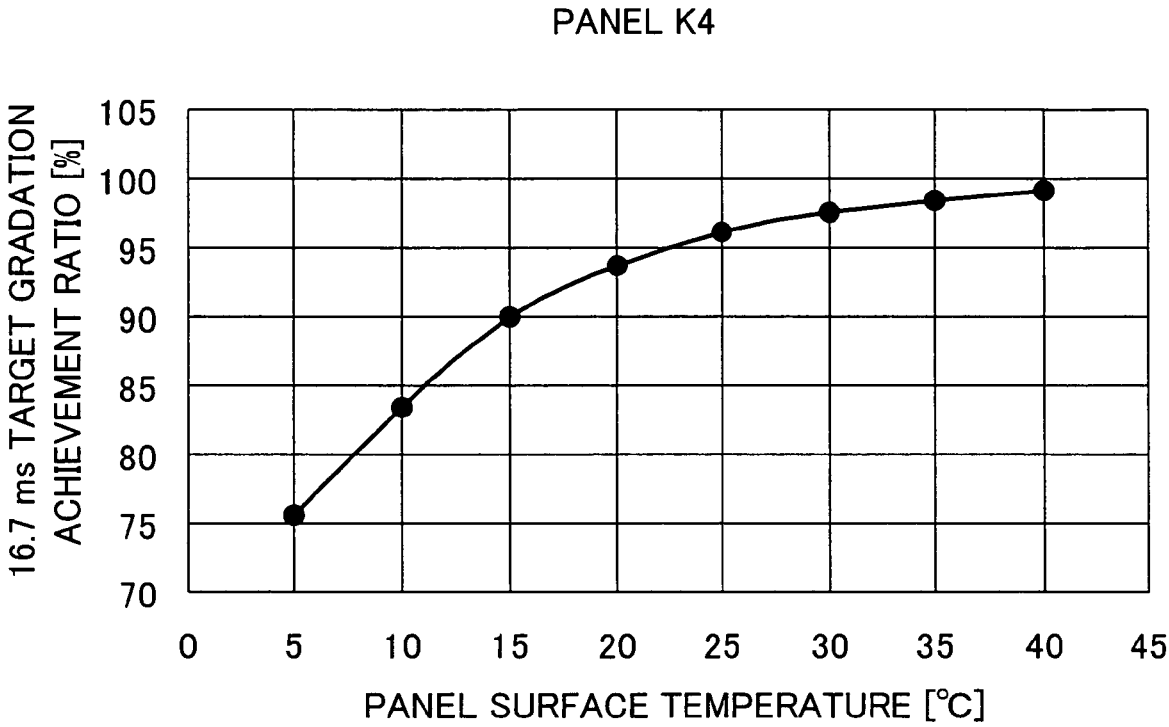
FIG. 21 is a graph showing changes in achievement ratio with changes in panel temperature with respect to the panel K4 as selected from the liquid crystal panels used for the evaluation.

The subjective evaluations are made by the user with respect to examples of the liquid crystal display apparatus 1 respectively adopting the liquid crystal panels K1 to K22 by displaying a live image (human, rose, etc.) as an object. The results of evaluation of the above measurement are shown in FIG. 20. In the evaluation, X indicates the state in which excessive brightness or poor brightness is outstanding due to the gradation transition resulting from the movement, and the display quality is significantly deteriorated, ○ indicates the state in which excessive brightness or poor brightness is not outstanding, and deterioration of display quality is not recognized, and Δ indicates the state in which display quality is in an acceptable level. In FIG. 20, the results of measurement of the respective achievement ratios and the evaluations are shown with changes in panel temperatures in the range of 10° C. to 40° C. for respective liquid crystal panels. In particular, for the liquid crystal panel K4, the relationship between the panel temperature and the achievement ratio after one field is shown in the graph of FIG. 21. As can be seen from the graph, with a rise in panel temperature, the achievement ratio simply increases.

As is clear from FIG. 20, when the achievement ratio as measured when the image data D is rewritten from the value indicative of the maximum luminance display to the value indicative of the minimum luminance display is 95%, like the foregoing liquid crystal display apparatus 1, even when adopting the structure wherein the degree of facilitating the gradation transition is set to such degree that the actual luminance of the pixel PIX becomes the level indicated by the image data D (i, j, k) of the current frame FR (k), an occurrence of an excessive brightness or poor brightness can be suppressed to the permissible level.

Figure 22:
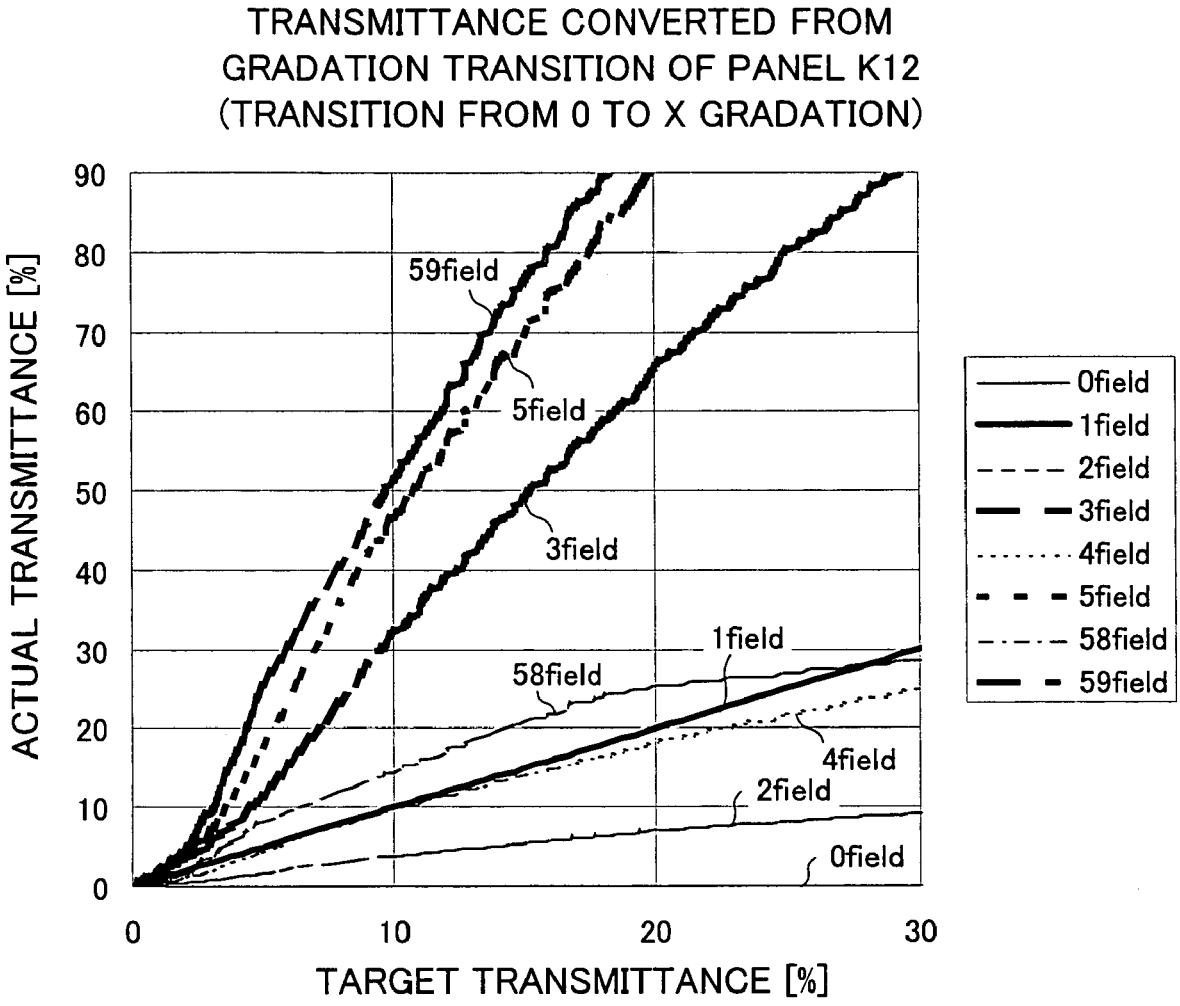
FIG. 22 is a graph showing transmittance in each field when a panel K12 is driven in a gradation of from 0 to X, as selected from the liquid crystal panels used for the evaluation.
Figure 23:
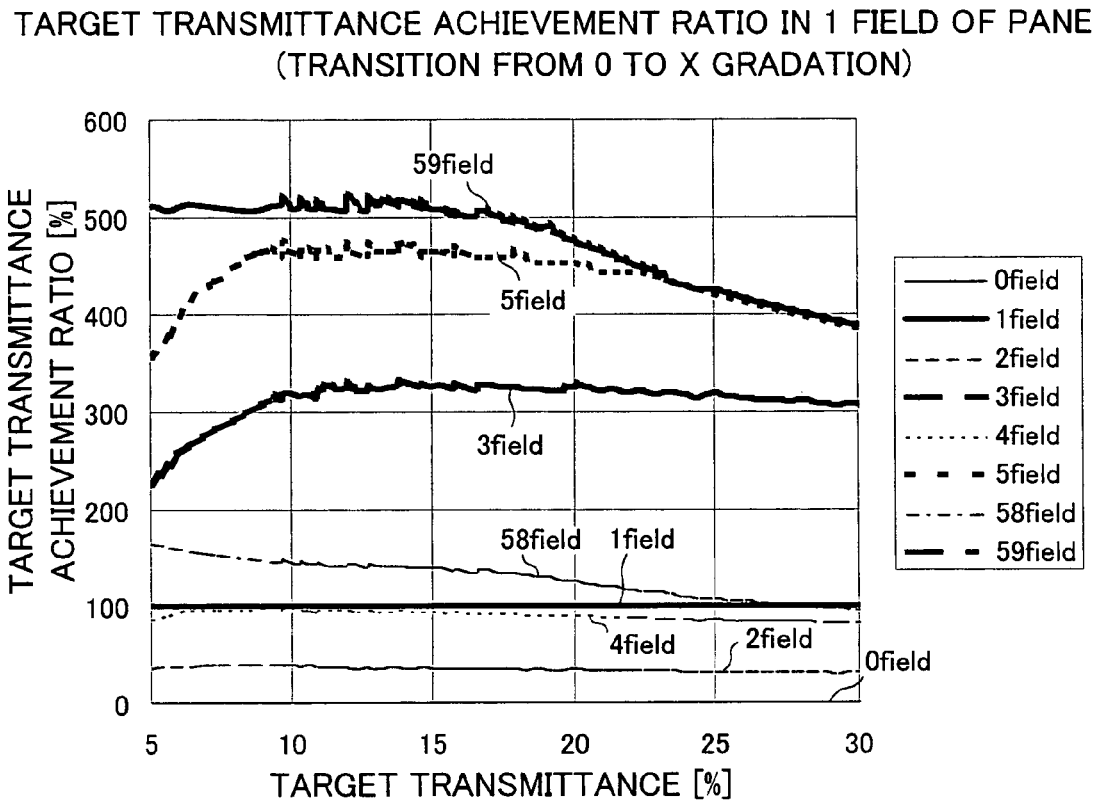
FIG. 23 shows an achievement ratio as converted from transmittance.
Figure 24:
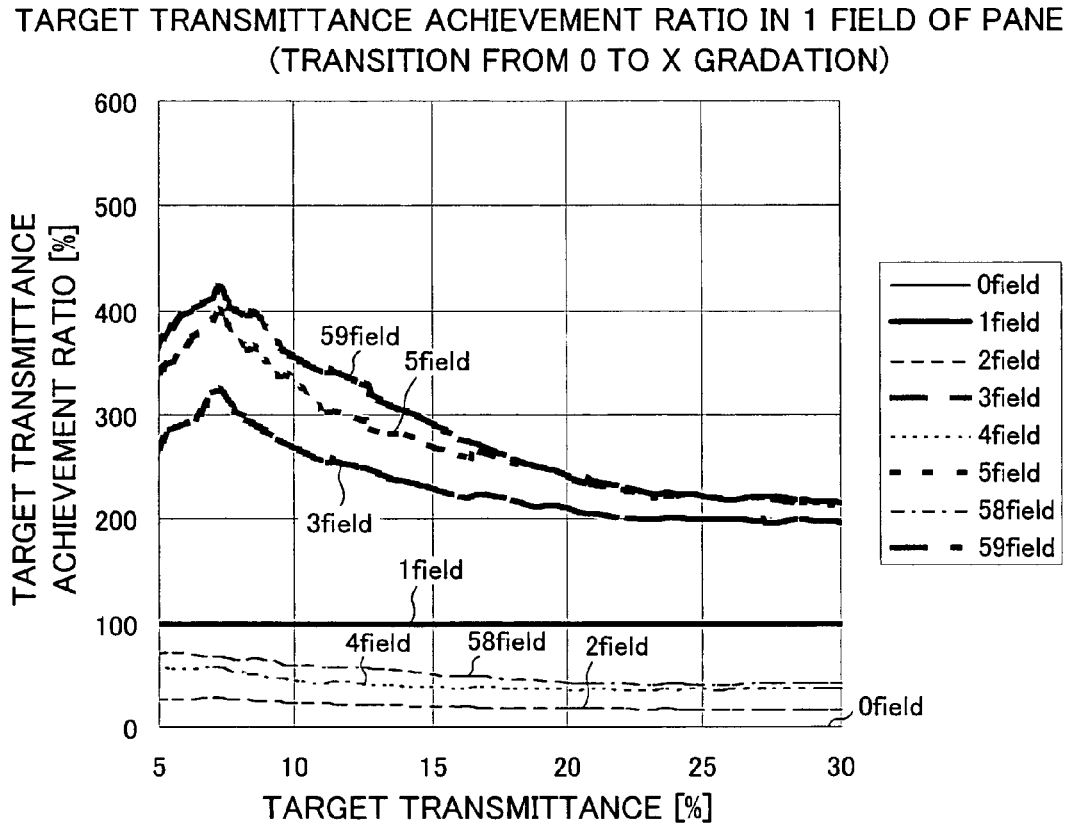
FIG. 24 is a graph showing achievement ratio in each field when a panel K13 is driven in a gradation of from 0 to X, as selected from the liquid crystal panels used for the evaluation.
Figure 25:
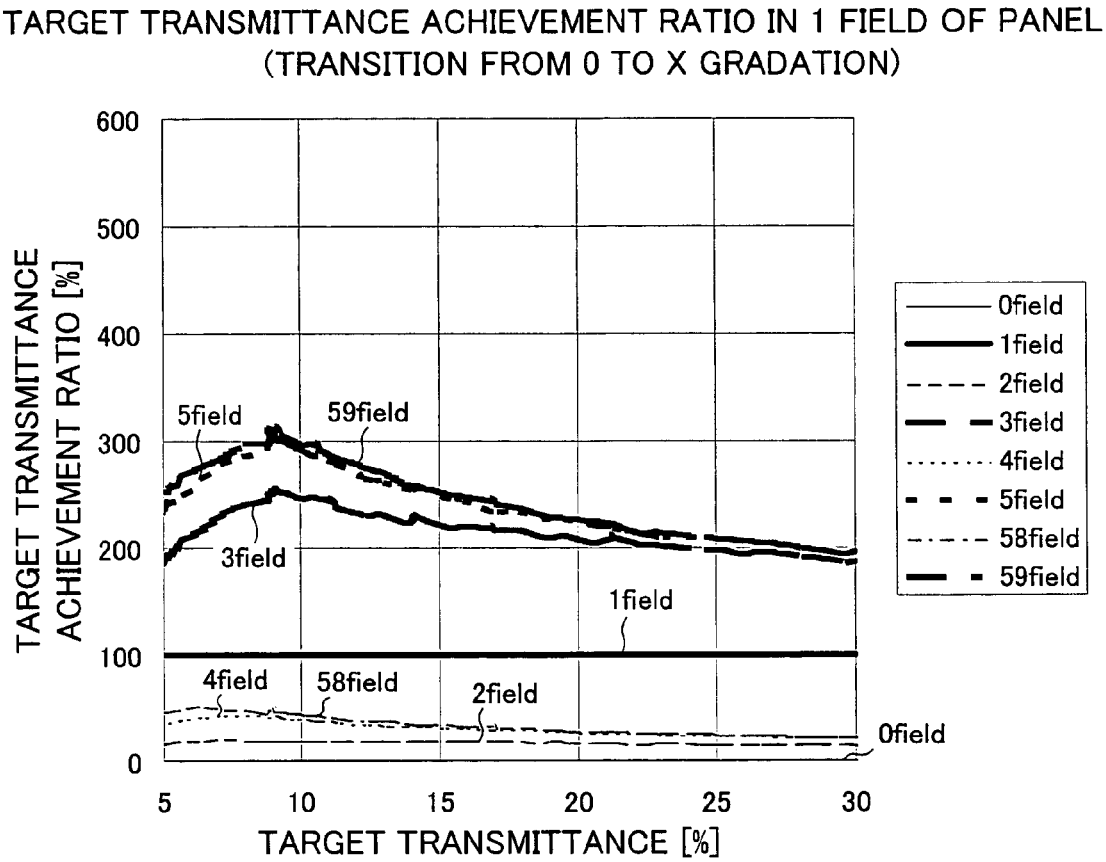
FIG. 25 is a graph showing achievement ratio in each field when a panel K14 is driven in a gradation of from 0 to X, as selected from the liquid crystal panels used for the evaluation.
Figure 26:
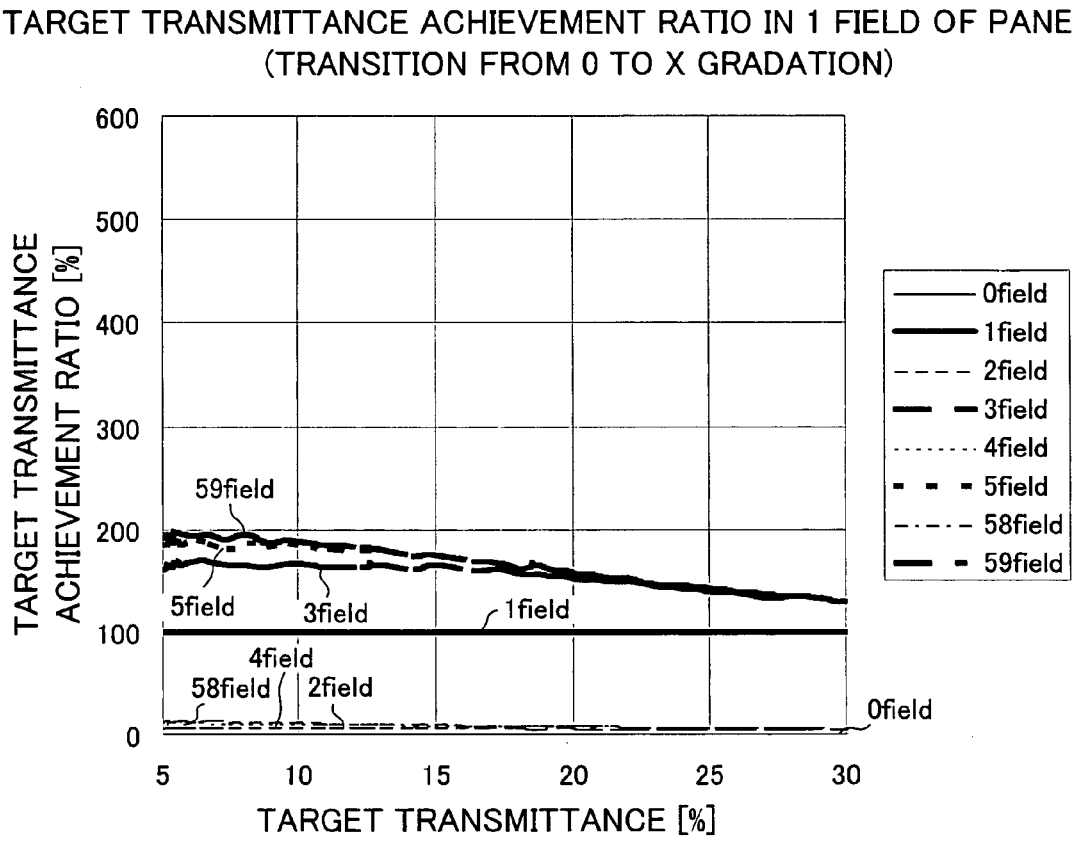
FIG. 26 is a graph showing achievement ratio in each field when a panel K15 is driven in a gradation of from 0 to X, as selected from the liquid crystal panels used for the evaluation.
Figure 27:
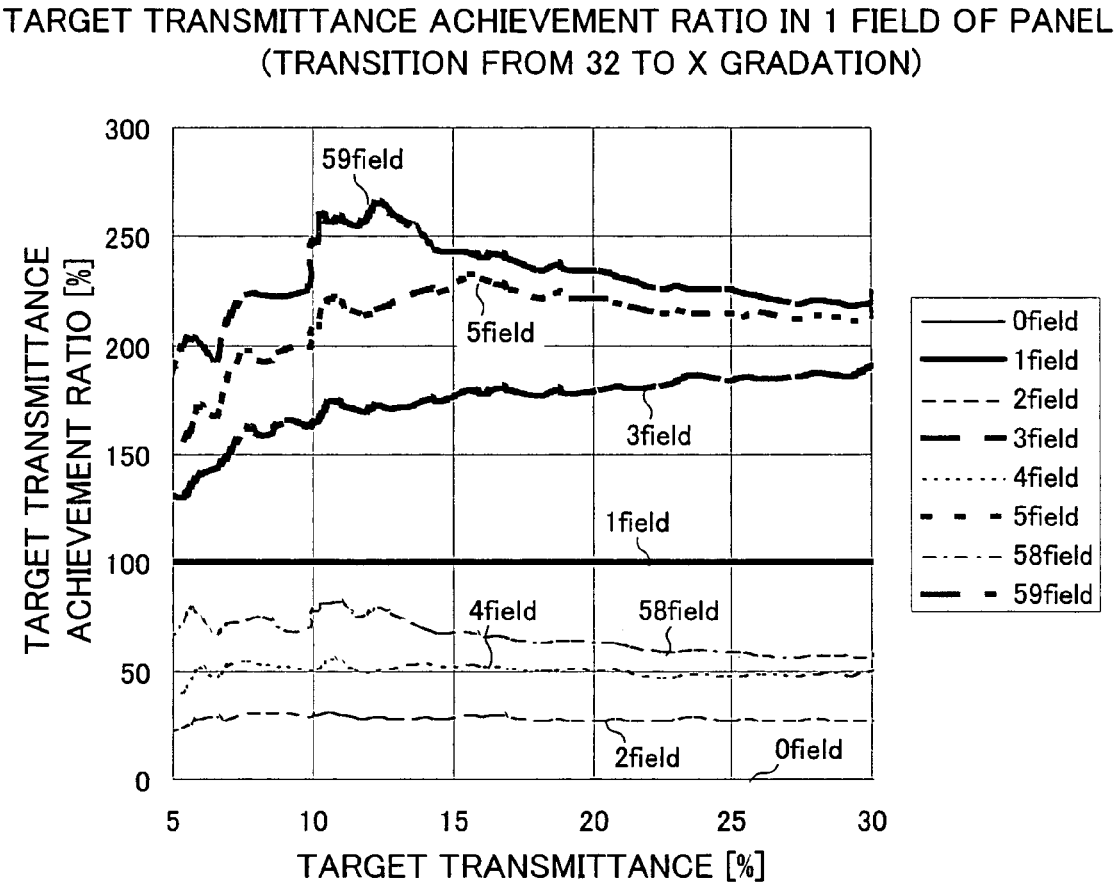
FIG. 27 is a graph showing achievement ratio in each field when a panel K12 is driven in a gradation of from 32 to X, as selected from the liquid crystal panels used for the evaluation.
Figure 28:
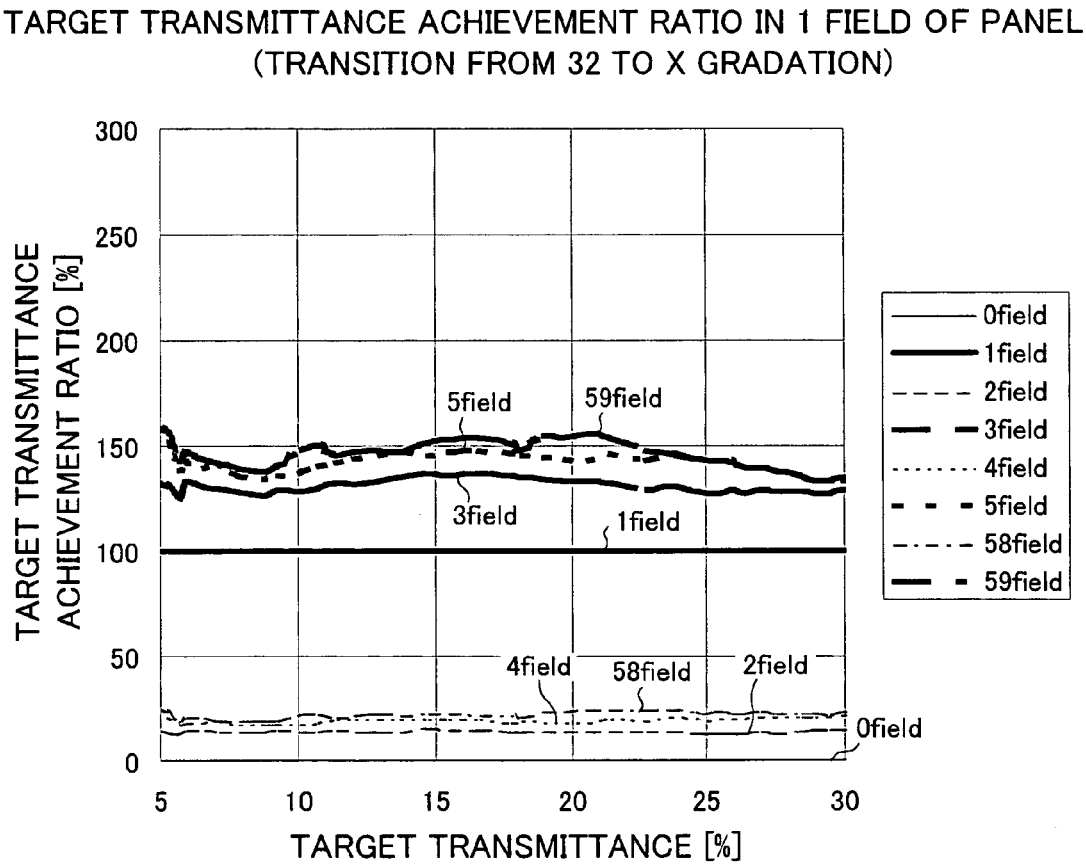
FIG. 28 is a graph showing achievement ratio in each field when a panel K13 is driven in a gradation of from 32 to X, as selected from the liquid crystal panels used for the evaluation.

FIG. 22 is a graph showing the relationship between the target transmittance (transmittance corresponding to X gradation) and the actual transmittance in each field when displaying an image which is most liable to have a problem of excessive brightness or poor brightness in the liquid crystal panel K12 by changing its gradation to a pixel PIX alternatively between the 0 gradation and the arbitrary X gradation at every field (16.7[ms]) under the condition of the temperature of the liquid crystal panel K12 of 5° C. The graph of FIG. 22 in which the Y axis shows the actual transmittance can be converted to FIG. 23 in which the Y axis shows the achievement ratio (actual transmittance/target transmittance). The relationship between the achievement ratio and the target transmittance as measured with respect to each of the liquid crystal display panels K13 to K15 under the condition of the panel temperature of 5° C. are shown in FIG. 24 through FIG. 26.

FIG. 27 through FIG. 30 show the relationship between the achievement ratio and the target transmittance when displaying another image while gradation is subjected to change between 32 gradation and an arbitrary X gradation in each of the liquid crystal panels K12 to K15 under the panel temperature of 5° C. In the above gradation, $\gamma$ characteristic is set to 2.2, and the 32 gradation in 0 to 255 gradations is converted into the luminance of around 1%.

Figure 29:
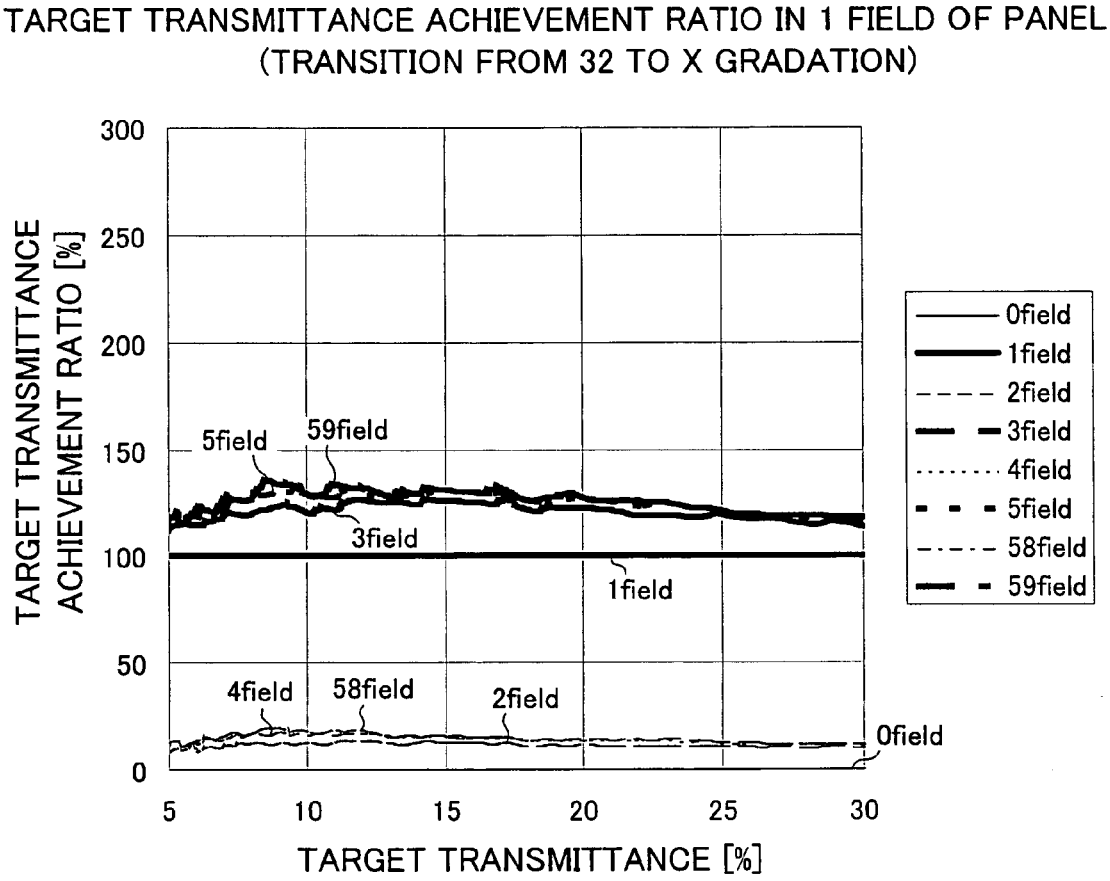
FIG. 29 is a graph showing achievement ratio in each field when a panel K14 is driven in a gradation of from 32 to X, as selected from the liquid crystal panels used for the evaluation.
Figure 30:
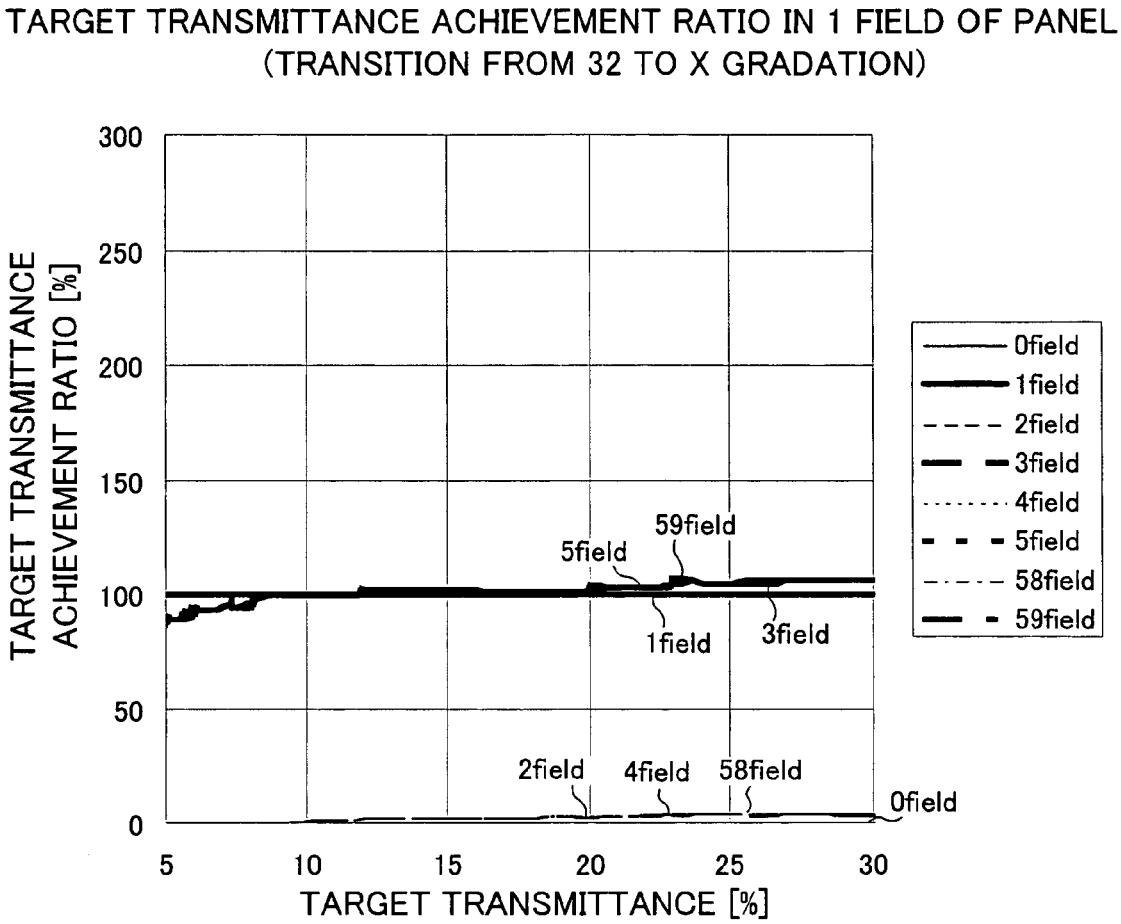
FIG. 30 is a graph showing achievement ratio in each field when a panel K15 is driven in a gradation of from 32 to X, as selected from the liquid crystal panels used for the evaluation.

As can be seen from FIG. 30, for the liquid crystal panel (K15) which shows the achievement ratio after one field of 95%, even when displaying an image which is subjected to a gradation transition to 32 gradation which is the darkest gradation of a general image to be displayed in practical applications, the luminance of each odd numbered field (which is supposed to be 100%) can be suppressed to be less than 110% of the target luminance, thereby suppressing an occurrence of an excessive brightness and a poor brightness. On the other hand, for the liquid crystal panels (K12 through K14), which shows the achievement ratio after one field of less than 95%, when displaying an image which is subjected to the gradation transition to 32 gradation, the gradation transition is over facilitated, and, for example, as shown in FIG. 29, even the liquid crystal panel K14 shows the luminance after 59 fields (supposed to be 100%) of more than 110% of the target luminance.

As can be seen also from FIG. 27 through FIG. 30, it can be confirmed that as long as the achievement ratio when the image data D is written from the value indicative of the maximum luminance display to the image data D indicative of the minimum luminance display is 95%, even for the liquid crystal display apparatus wherein the gradation transition is facilitated to such a degree that an actual luminance of the pixel becomes a luminance indicated by the image data D (i, j, k) of the current frame FR(k) like the liquid crystal display apparatus 1 of the present embodiment, an occurrence of excessive brightness and poor brightness can be suppressed to an acceptable range.

Figure 31:
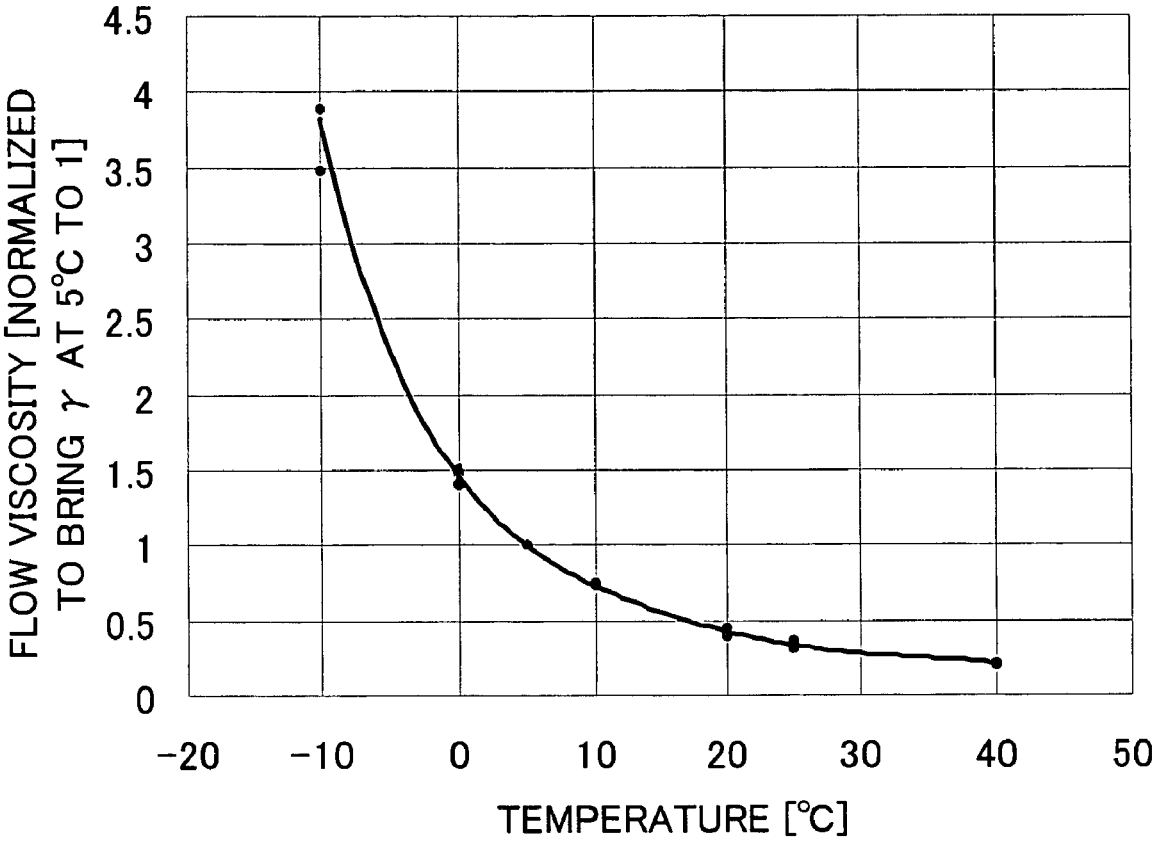
FIG. 31 is a graph showing the relationship between flow viscosity and temperature.

With respect to each of the liquid crystal panels K1 through K22, the flow viscosity $\gamma[mm^2]$ was measured with changes in panel temperature, and the relationship between the flow viscosity and temperature characteristic shown in FIG. 31 was obtained. FIG. 31 is a graph normalized to bring $\gamma$ at 5° C. into 1.

Figure 1:
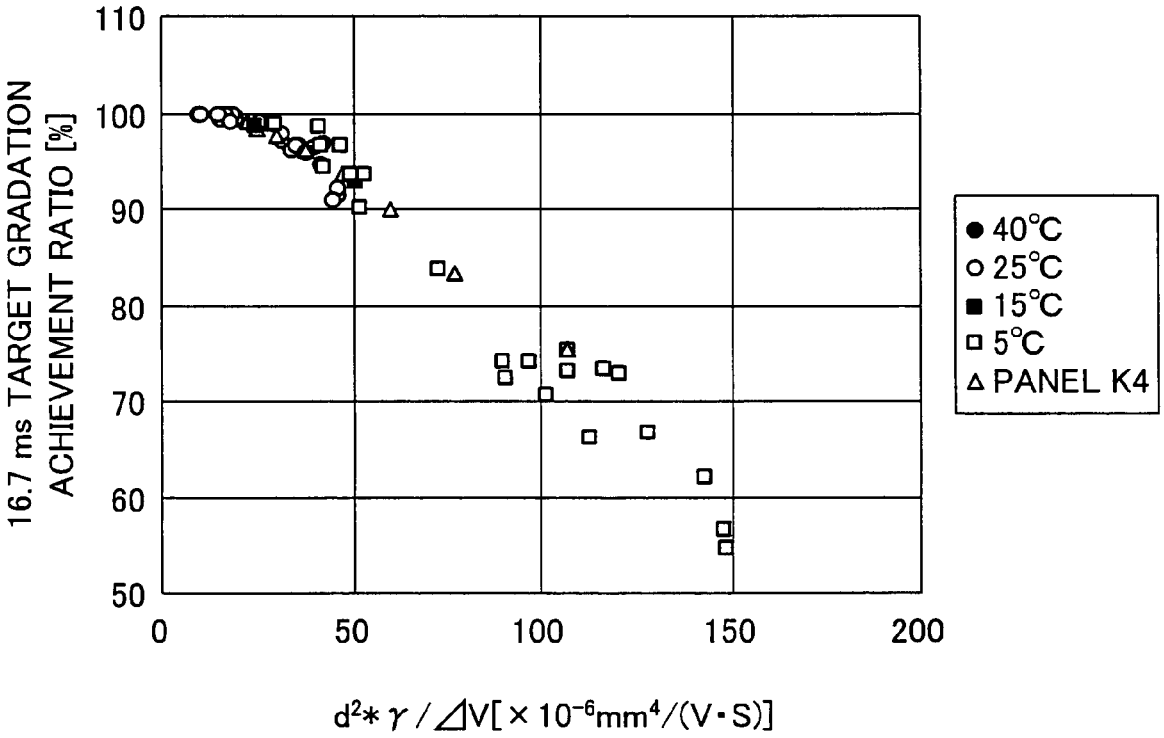
FIG. 1, which shows one embodiment of the present invention, is a graph showing the relationship between an achievement ratio after a period of 16.7 ms and $d^2 \cdot \gamma/\Delta V$.
Figure 32:
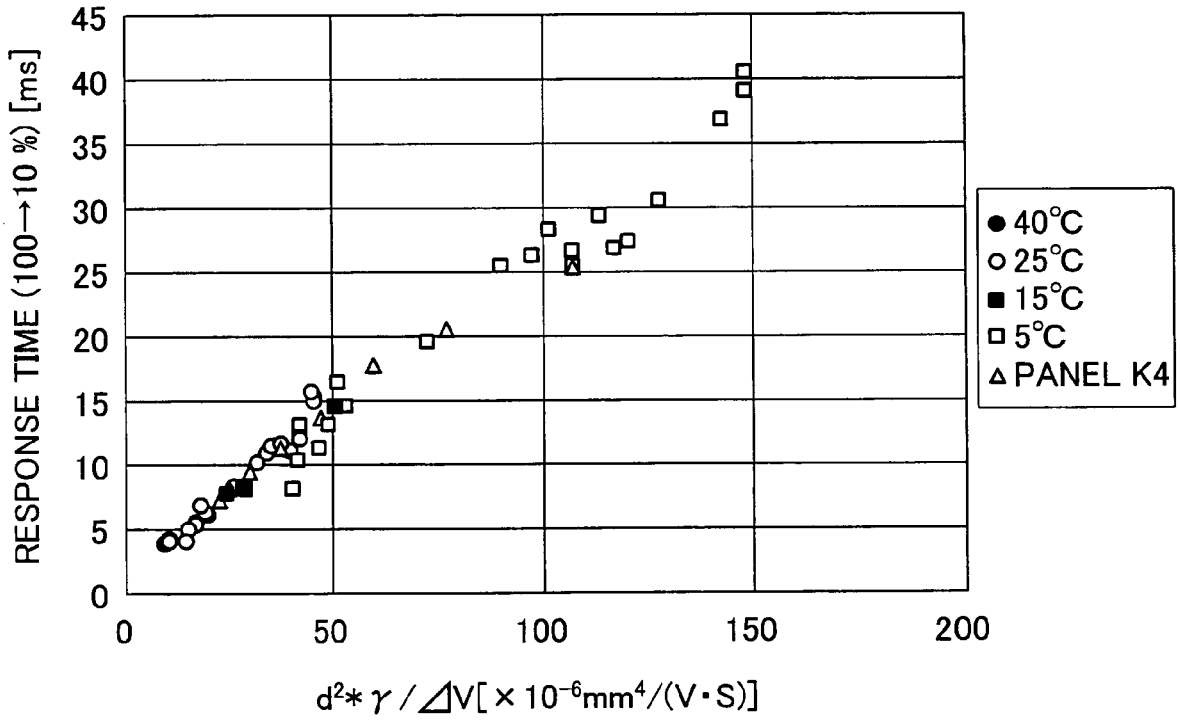
FIG. 32 is a graph showing a relationship between the response time required for a change in luminance from 100% to 10%, and $d^2 \cdot \gamma/\Delta V$.

In the case of driving each of the liquid crystal panels K1 to K22 by applying a voltage once in each field (FIG. 16 and FIG. 17), the response time $\tau$, the achievement ratio after 16.7 [ms] and $d2\cdot\gamma/\Delta V$ were measured, and by plotting the results of measurements, the response time $\tau$, the achievement ratio after 16.7 [ms] and $d2\cdot\gamma/\Delta V$ showed the relationship shown in FIG. 1 and FIG. 32. Incidentally, in the case where the image data D is rewritten from the value indicative of the maximum luminance display to the value indicative of the minimum luminance display, as the maximum luminance of 100% and the minimum luminance of 0% are given, the gradation achievement ratio+the achievement ratio=100% can be obtained.

Figure 34:
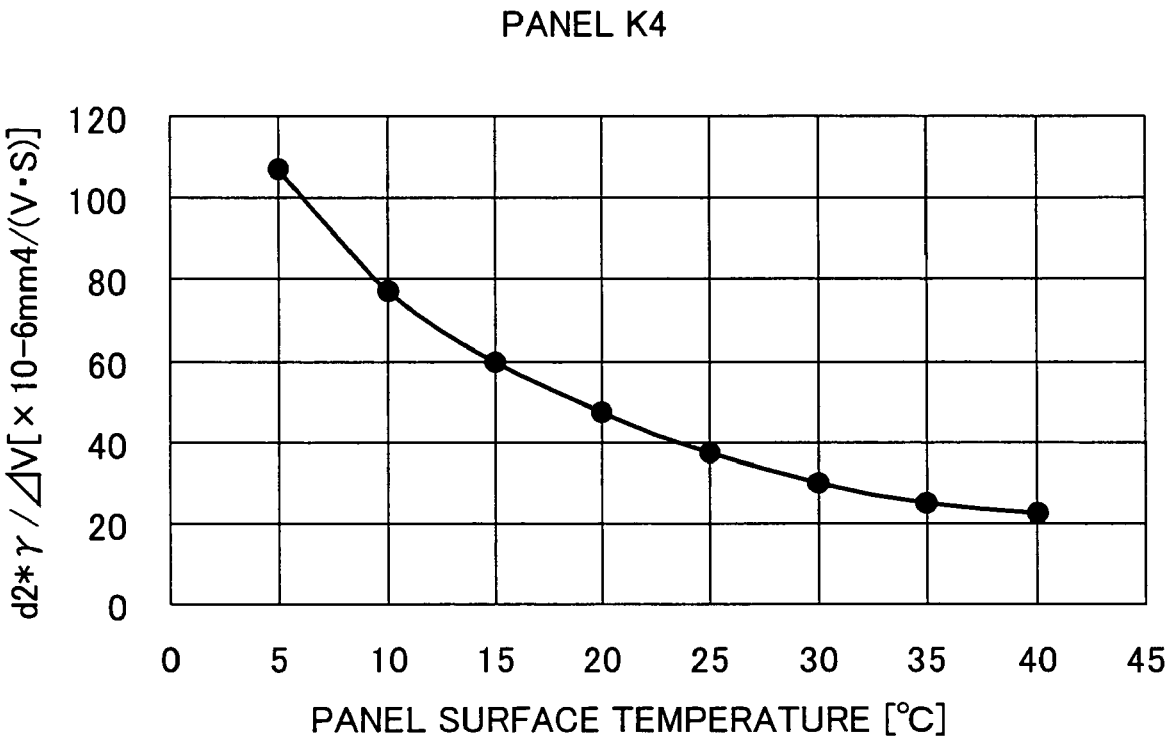
FIG. 34 is a graph showing changes in $d^2 \cdot \gamma/\Delta V$ with changes in panel temperature of the panel K4 as selected from the liquid crystal panels used for the evaluation.

The evaluations were made in the case of driving by applying a voltage indicative of the luminance to each pixel PIX (i, j) once in 16.7 [ms], and the results of evaluations are shown in FIG. 33. In FIG. 33, the column for $d^2\cdot\gamma/\Delta V$ is formed as in FIG. 19, in addition to the columns for subjective evaluations and achievement ratio shown in FIG. 20. In FIG. 33, the results of measurements of the achievement ratio and $d2\cdot\gamma/\Delta V$ with changes in panel temperature in a range of 10° C. to 40° C. with respect to several sample liquid crystal panels are also shown. In particular, for the liquid crystal panel K4, the relationship between the panel temperature and $d2\cdot\gamma/\Delta V$ is shown in the graph of FIG. 34, from the graph of FIG. 34, it can be seen that $d2\cdot\gamma/\Delta V$ simply decreases with an increase in panel temperature. In FIG. 33 and subsequent Figures, the unit for $d2\cdot\gamma/\Delta V$, i.e., $[mm^4/(V\cdot s)]$ is omitted.

As can be seen from FIG. 33, the range for the achievement ratio of not less than 95% corresponds to the range in which $d2\cdot\gamma/\Delta V$ is in the range of $9\times10^{-6}$ to $42\times10^{-6}$ $[mm^4/(V\cdot s)]$. As shown in FIG. 1, the smaller is $d2\cdot\gamma/\Delta V$, the more the achievement ratio is increased, and $d2\cdot\gamma/\Delta V$ is therefore only required to be larger than 0.

As shown in FIG. 1, the achievement ratio and $d2\cdot\gamma/\Delta V$ have substantially the linear correspondence, and when the correspondence is approximated to a linear line, the achievement ratio is given by the following equation (2):

$$\text{Achievement ratio}=-0.34\times(d2\cdot\gamma/\Delta V\times10^{-6})+109[\%] \quad (2)$$

Therefore, as long as $d2\cdot\gamma/\Delta V$ satisfies the condition defined by an inequality (1), the achievement ratio after one field in the range of 95% to 100% can be ensured, and an occurrence of excessive brightness and poor brightness can be suppressed to a permissible range, and the results of evaluation of ○ or Δ can be obtained.

For the measurements performed in the case of driving by applying a voltage indicative of the luminance of each pixel PIX (i, j) once in 16.7 [ms], the results are shown in FIG. 35. In the table of FIG. 35, the column for the response time $\lambda$ is formed in addition to the columns for achievement ratio and evaluation shown in FIG. 20. In FIG. 35, the results of measurements of the achievement ratio and the response speed with changes in panel temperature in a range of 10° C. to 40° C. with respect to several sample liquid crystal panels are also shown.

As can be seen from FIG. 35, the range for the achievement ratio of not less than 95% corresponds to the range in which the response time $\lambda$ is in the range of longer than 3.8 [ms] and not longer than 12.7 [ms], and by setting the response time $\lambda$ to fall in the above range, the achievement ration in the range of from 95% to 100% can be ensured, and the results of evaluation of ○ or Δ can be obtained. Here, as shown in FIG. 32, the smaller is $d2\cdot\gamma/\Delta V$, the shorter is a response time $\lambda$, and as shown in FIG. 1, the smaller is $d2\cdot\gamma/\Delta V$, the higher is the achievement ratio. Therefore, as long as the response time $\lambda$ is selected to fall in the range of longer than 3.8 [ms] and not longer than 12.7 [ms], the results of evaluation of ○ or Δ can be obtained.

Therefore, as long as $d2\cdot\gamma/\Delta V$ and the response time $\lambda$ are selected to fall in the above ranges, like the foregoing the liquid crystal display apparatus 1, even when adopting the structure wherein the degree of facilitating the gradation transition is set to such degree that the actual luminance of the pixel PIX becomes the level indicated by the image data D (i, j, k) of the current frame FR (k), an occurrence of an excessive brightness or poor brightness can be suppressed to the permissible level.

In the above example, the liquid crystal panel 11 is defined by $d2\cdot\gamma/\Delta V$. However, in view of that $\Delta V=5.5$ [V] in most cases, by taking this value 5.5 [V] for $\Delta V$ as an approximate value, the formula (1) can be rewritten as the following simplified inequality (3).

$$d^2\cdot\gamma[mm^4/s]\leqq226\times10^{-6} \quad (3)$$

In the above, explanations have been given the case wherein one field is set to 16.7 [m], and a voltage indicative of luminance is applied to each pixel PIX (i, j) once in each field. In this embodiment, subjective evaluations were made with respect to the liquid crystal display apparatus 1*a* by the user also under other condition, i.e., in the case of driving at double speed, or applying a voltage indicative of luminance twice in one field, such as the case of applying a voltage indicative of a black display irrespectively of a luminance as specified in the predetermined period in one field in the same manner as the subjective evaluations shown in FIG. 20. As a result, it can be confirmed that as long as the achievement ratio in the range of 95% to 100% can be ensured, like the liquid crystal display apparatus 1, even when adopting the structure wherein the degree of facilitating the gradation transition is set to such degree that the actual luminance of the pixel PIX becomes the level indicated by the image data D (i, j, k) of the current frame FR (k), an occurrence of an excessive brightness or poor brightness can be suppressed to the permissible level as in the case of the evaluation shown in FIG. 20.

Figure 36:
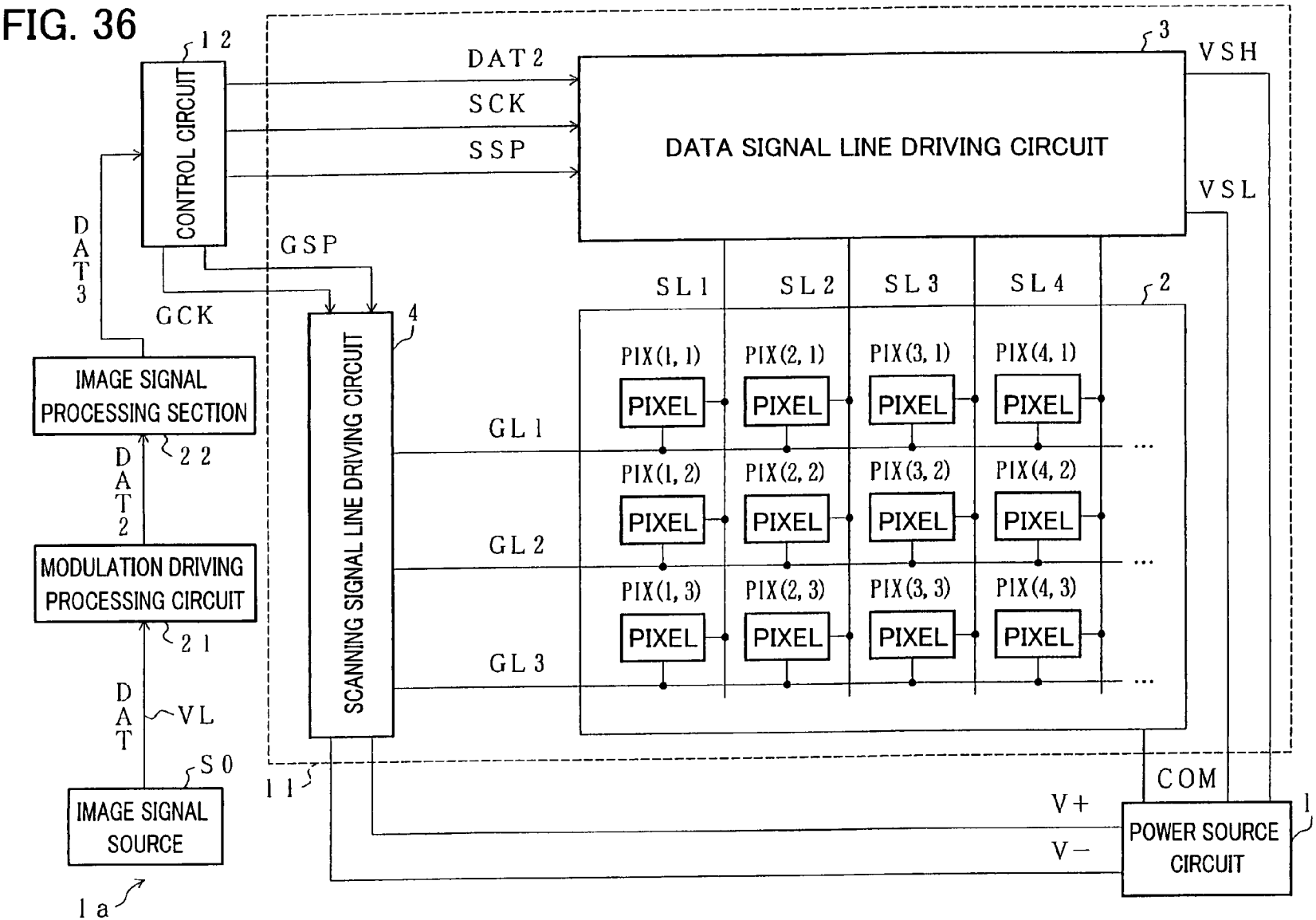
FIG. 36 which shows a modified example of the liquid crystal display apparatus is a block diagram illustrating the structure of essential parts of the liquid crystal display apparatus.

Specifically, the liquid crystal display apparatus 1*a* in accordance with the present embodiment basically has the same structure as the liquid crystal display apparatus 1 shown in FIG. 2 except that an image signal processing section 22 is provided between the modulation driving processing section 21 and the control circuit 12 as shown in FIG. 36. This image signal processing section 22, for example, stores the amended D2 (i, j, k) to be written in each pixel with a predetermined dot frequency, and outputs the amended image data D2 (i, j, k) twice in each field as the image data D3 (i, j, k) having a frequency twice as high as that of above the amended image data D2 (i, j, k) to supply to the control circuit 12, the image data D3 (i, j, k) having a frequency twice as high as that of the amended image data D2 (i, j, k). Here, the driving frequency of the control circuit 12 is changed according to the dot frequency of the image data D3 (i, j, k), and the control circuit 12 can drive the pixel array 2 (liquid crystal panel 11) at a frequency twice as high as that in the structure of FIG. 1, thereby suppressing an occurrence of flicker, for example.

In the case of performing a black display in a predetermined period in one field without adopting a double speed driving, the image signal processing section 22 stores the amended image data D2 (i, j, k) to be written in each pixel with a predetermined dot frequency, for example, from the modulation driving processing section 21, and outputs the amended image data D2 (i, j, k) as the amended image data D3 (i, j, k) having a frequency twice as high as that of the amended image data D2 (i, j, k) once in each frame. According to this structure, the period required for outputting the amended image data D2 (i, j, k) can be reduced to one half of that required in the structure of FIG. 2, and in the latter half, the image signal processing section 22 outputs the image data D3 (i, j, k) indicative of a black display with a frequency twice as high as the amended image data D2 (i, j, k).

Figure 39:
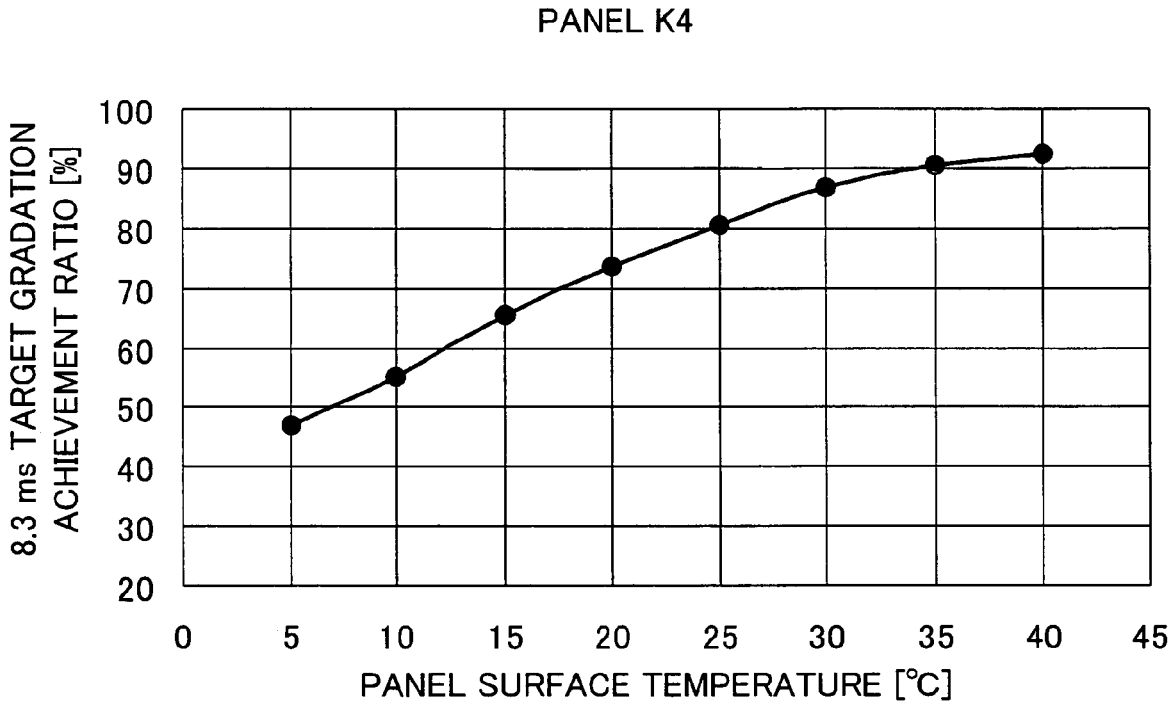
FIG. 39 is a graph which shows changes in achievement ratio with changes in panel temperature of a panel K4 of each liquid crystal panel as selected from the liquid crystal panels used for the evaluation.
Figure 40:
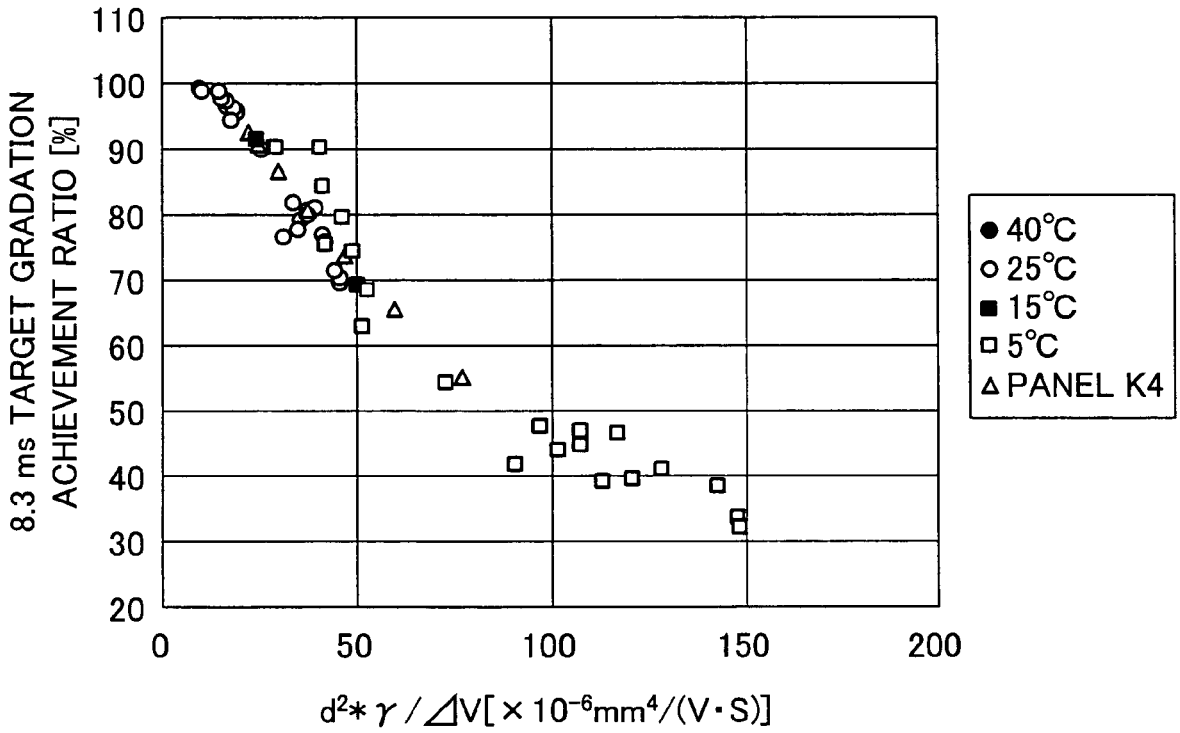
FIG. 40 is a graph showing the relationship between the achievement ratio after 8.3 ms and $d^2 \cdot \gamma / \Delta V$.
Figure 44:
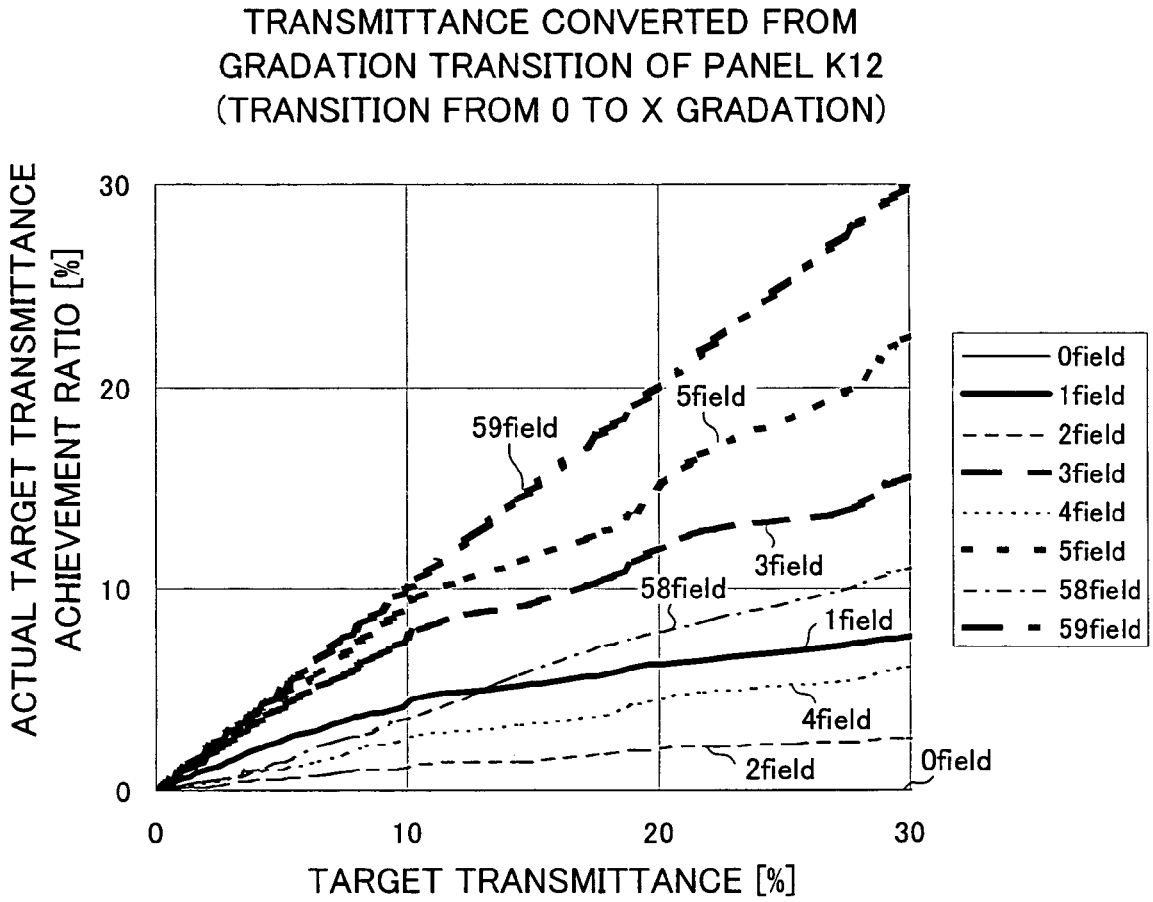
FIG. 44 is a graph showing transmittance in each field when a panel K12 is driven in a gradation of from 0 to X, as selected from the liquid crystal panels used for the evaluation.
Figure 45:
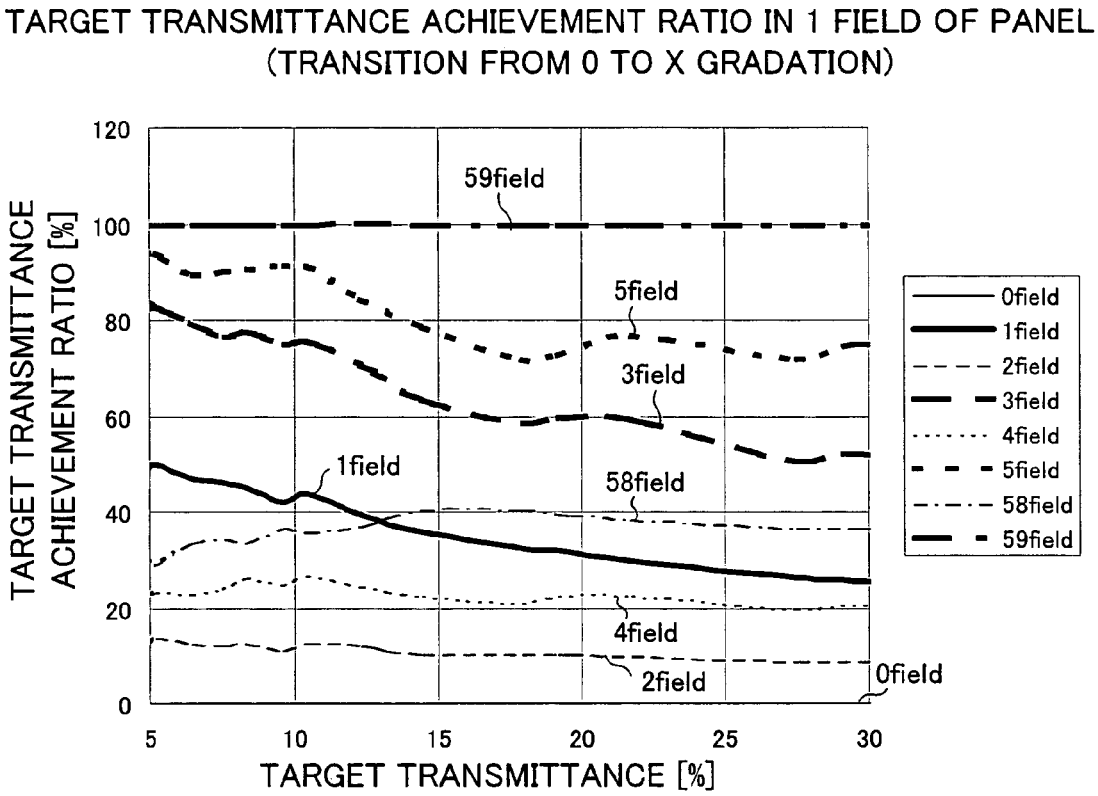
FIG. 45 shows an achievement ratio as converted from transmittance.
Figure 46:
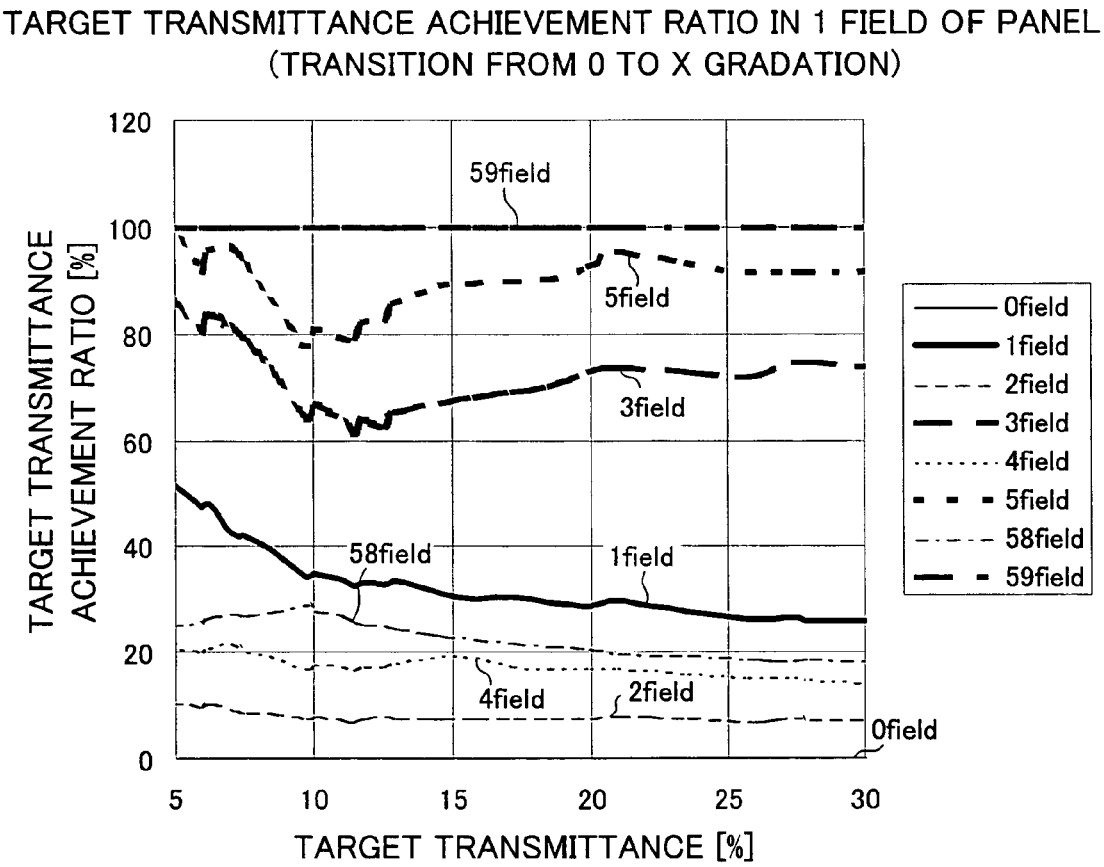
FIG. 46 is a graph showing achievement ratio in each field when a panel K13 is driven in a gradation of from 0 to X, as selected from the liquid crystal panels used for the evaluation.
Figure 47:
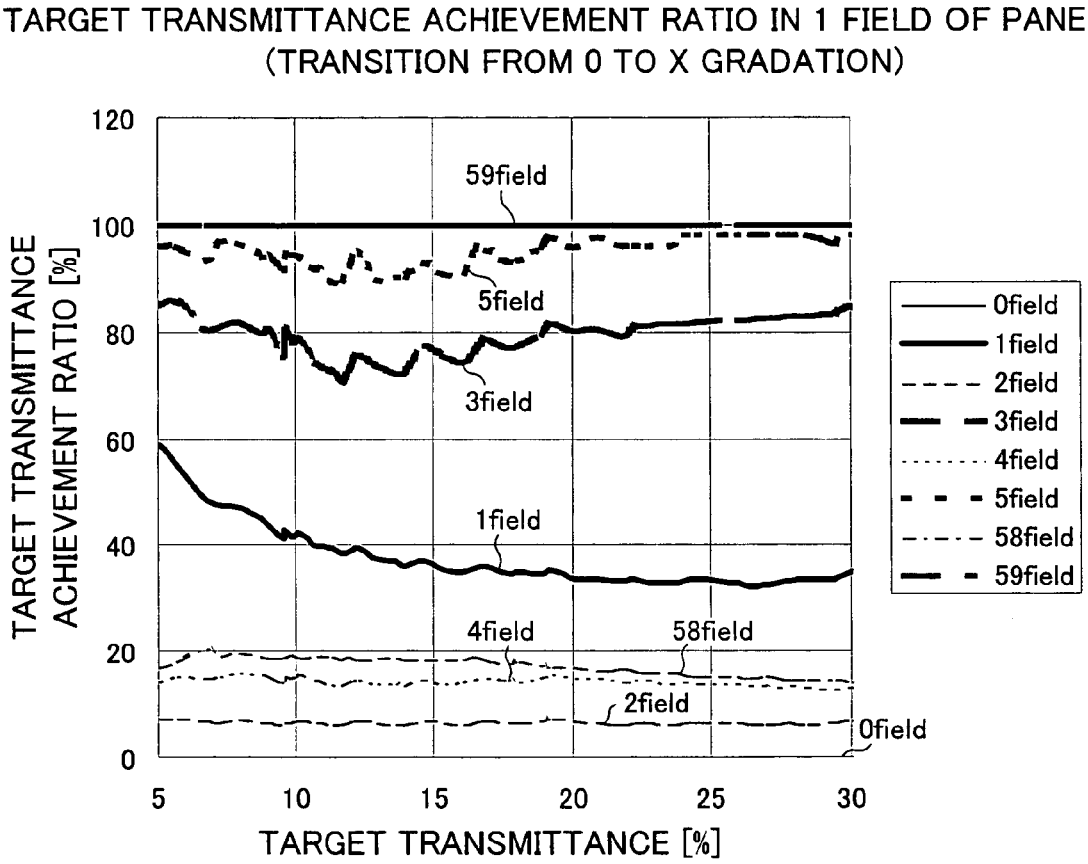
FIG. 47 is a graph showing achievement ratio in each field when a panel K14 is driven in a gradation of from 0 to X, as selected from the liquid crystal panels used for the evaluation.
Figure 48:
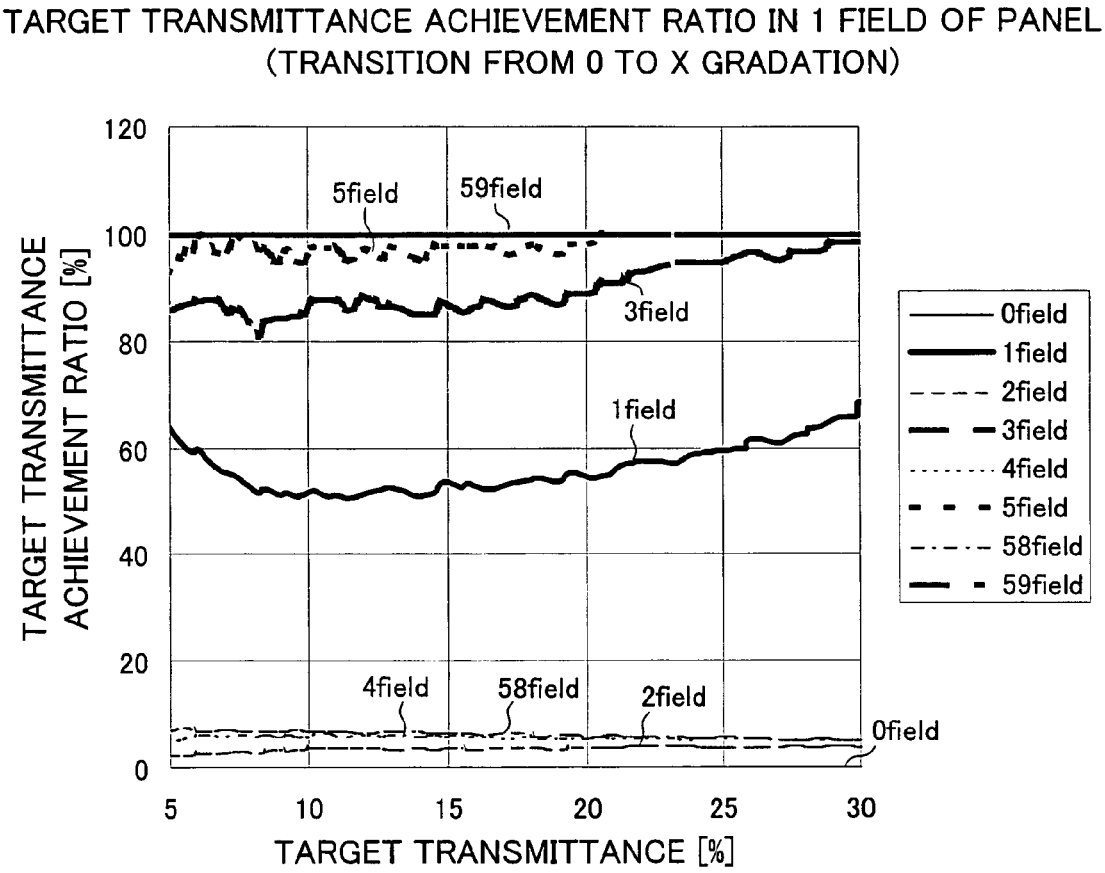
FIG. 48 is a graph showing achievement ratio in each field when a panel K15 is driven in a gradation of from 0 to X, as selected from the liquid crystal panels used for the evaluation.
Figure 49:
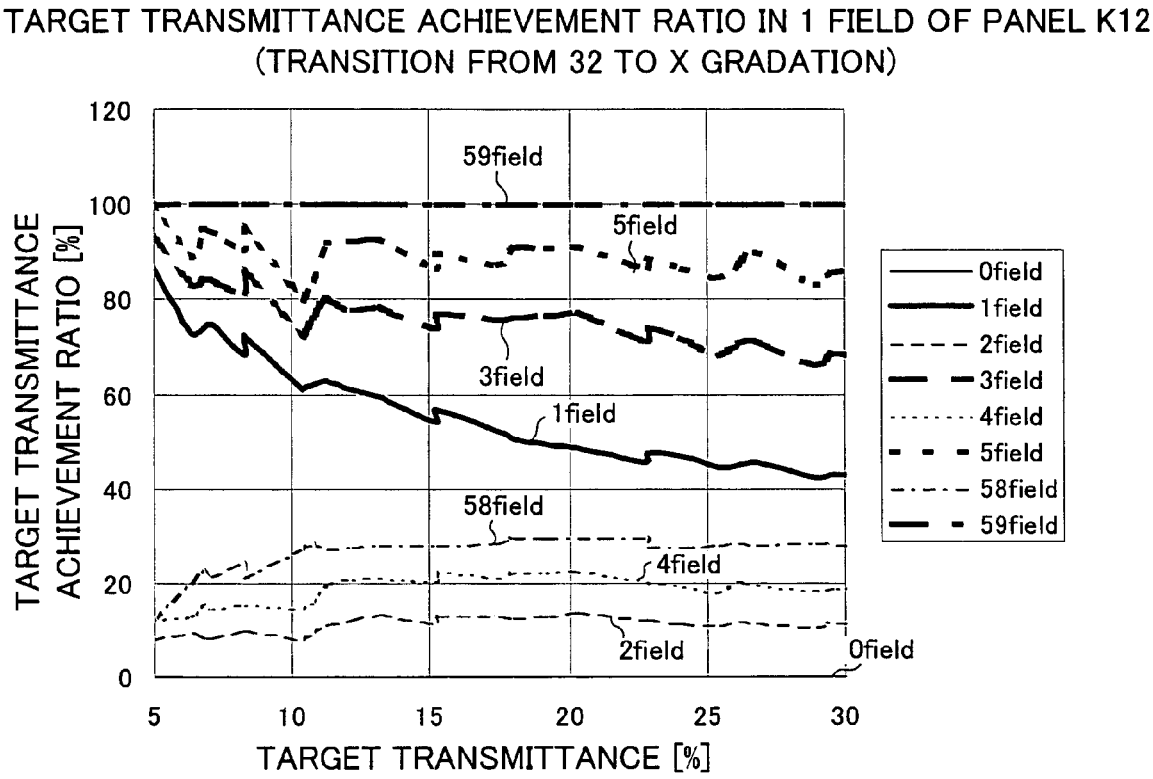
FIG. 49 is a graph showing achievement ratio in each field when a panel K12 is driven in a gradation of from 32 to X, as selected from the liquid crystal panels used for the evaluation.

As in the case of FIGS. 16 and 17, the results of measurements of the response time $\tau$, the gradation achievement ratio after driving one field performed under the condition of driving each of the liquid crystal panels K1 to K21 at double speed, i.e., applying a driving voltage twice in each field 16.7 [ms] are shown in FIG. 37 and FIG. 38. In particular, for the liquid crystal panel K4, the relationship between the panel temperature and the gradation achievement ratio after 8.3 [ms] is shown in the graph of FIG. 39. As can be seen from the graph, with a rise in panel temperature, the gradation achievement ratio simply increases. In the case of driving each of the liquid crystal panels K1 to K21 at double speed, the relationship between the achievement ratio after 8.3 [ms] and $d2\cdot\gamma/\Delta V$ were measured, and by plotting the results of measurements, the achievement ratio after 8.3 [ms] and $d2\cdot\gamma/\Delta V$ showed the relationship shown in FIG. 40. For the above measurements, the relationship between the achievement ratio and $d^2\cdot\gamma/\Delta V$ is shown in FIG. 41, and the relationship between the achievement ratio and the response time is shown in FIG. 42. In the tables of FIG. 41 and FIG. 42, the results of measurements of the achievement ratio, $d2\cdot\gamma/\Delta V$ and the response speed with changes in panel temperature in a range of 10° C. to 40° C. with respect to several sample liquid crystal panels are also shown. As explained, the smaller is $d2\cdot\gamma/\Delta V$, the higher is a response speed and the higher is the achievement ratio. As explained, the smaller is $d^2\cdot\gamma/\Delta V$, the higher is a response speed and the higher is the achievement ratio also in the case of driving at double speed.

From the above figures and the relationship among $d^2\cdot\gamma/\Delta V$, the response speed and the achievement ratio, it can be said that when driving at a frequency of 8.3 [ms], by selecting $d^2\cdot\gamma/\Delta V$ to be larger than 0 and not larger than $17\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of the liquid crystal layer in the liquid crystal panel, and $\Delta V$ [V] indicates a difference in liquid crystal layer application voltage between a maximum luminance display and a minimum luminance display, it is possible to maintain the achievement ratio after driving one field of the liquid crystal panel 11 in a range of from 95% to 100% as in the case of driving at a frequency of 16.7 [ms]. Similarly, by selecting the response time when the liquid crystal panel is set to a temperature of 5° C. to be longer than 0 ms and not longer than 6.3 ms wherein the response time indicates a time required for a luminance of a pixel, in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance, it is possible to maintain the achievement ratio after driving one field within the range of from 95% to 100% as in the case of driving at a frequency of 16.7 [ms].

As a result, like the foregoing the liquid crystal display apparatus 1, even when adopting the structure wherein the degree of facilitating the gradation transition is set to such degree that the actual luminance of the pixel PIX becomes the level indicated by the image data D (i, j, k) of the current frame FR (k), an occurrence of an excessive brightness or poor brightness can be suppressed to a permissible range.

Second Embodiment

In the above first embodiment, explanations have been given through the case where the modulation driving processing section 21 of the liquid crystal display apparatus 1 is arranged so as to facilitate the gradation transition to such a degree that an actual luminance of the pixel becomes a luminance indicated by the image data D (i, j, k) of the current frame FR(k). In the present embodiment, explanations will be given through the case where the gradation transition is facilitated by the modulation driving processing section 21 to a degree lower than that of the first embodiment.

As shown in FIG. 13 and FIG. 14 explained earlier, when the gradation transition is not facilitated to an appropriate level, excessive brightness or poor brightness is liable to occur. Here, when comparing the excessive brightness with poor brightness, the excessive brightness is more liable to be recognized by the user, and the excessive brightness causes a more serious deterioration of the display quality.

In a liquid crystal display apparatus 1 in accordance with the present embodiment, it is arranged so as to facilitate the gradation transition in and after the first field, to a degree lower than that in the first embodiment, specifically to such a degree that a response speed can be maximized, provided that the gradation achievement ratio does not exceed 100%, i.e., the excessive brightness does not occur. Specifically, in the present embodiment, under the condition of the liquid crystal panel temperature of temperature of 5° C., the degree of facilitating the gradation transition is selected between the degree of facilitating the gradation transition set under the condition of the liquid crystal panel temperature of 5° C. and the degree of facilitating the gradation transition set under the condition of the liquid crystal panel temperature of 20° C. higher than 5° C., i.e., 25° C. in the first embodiment. Namely, the degree of facilitating the gradation transition is set in the present embodiment, for example, to the degree set under the condition of 5 or 10° C. higher than the actual temperature. Here, the degree of facilitating the gradation transition may be set by changing a value set in the LUT 52 to be a different value from that of the first embodiment, for example, by the temperature sensor 33.

According to the foregoing structure wherein the degree of facilitating the gradation transition is selected to be lower than that of the first embodiment, although poor brightness occurs more frequently, an occurrence of excessive brightness which causes a deterioration of the display quality to a greater degree than the poor brightness can be suppressed. Therefore, an overall deterioration of the display quality noticeable by the user caused by the poor brightness or the excessive brightness can be suppressed.

In view of the foregoing, the liquid crystal display apparatus 1 of the present embodiment is arranged such that $d2\cdot\gamma/\Delta V[mm^4/(V\cdot s)]$ of the liquid crystal panel 11 satisfies the following condition:

$$d2\cdot\gamma/\Delta V \leqq 56\times10^{-6} \quad (4)$$

wherein $\gamma$ [$mm^2/s$] indicates a flow viscosity when the liquid crystal panel is set to a temperature of 5° C., d [μm] indicates a thickness of the liquid crystal layer in the liquid crystal panel, and $\Delta V$ [V] indicates a difference in liquid crystal layer application voltage between a maximum luminance display and a minimum luminance display. With this structure, the luminance achievement ratio (actual luminance/target luminance) in one field of the liquid crystal panel 11 is maintained at 90% or higher.

According to the foregoing structure, it is possible to realize the liquid crystal display apparatus which permits even under the foregoing low temperature condition like the outdoor use environment where the temperature of the panel (liquid crystal cell 111) is at around 5° C. an occurrence of excessive brightness or poor brightness to be suppressed to a level acceptable by the user, and which realizes a high contrast and desirable viewing angle characteristics, while realizing a high response speed.

In the present embodiment, subjective evaluations were made by the user for each of the liquid crystal panels K1 to K22 by displaying the same image as the first embodiment. The results of evaluation are shown in the table of FIG. 43.

As in the evaluation shown in FIG. 22 through FIG. 30, FIG. 44 through FIG. 53 show relationships between the transmittance or the achievement ratio and target transmittance in each field when displaying an image whose gradation is subjected to change between 0 and an arbitrary X gradation or an image whose gradation is subjected to change between 32 gradation and an arbitrary X gradation.

Figure 50:
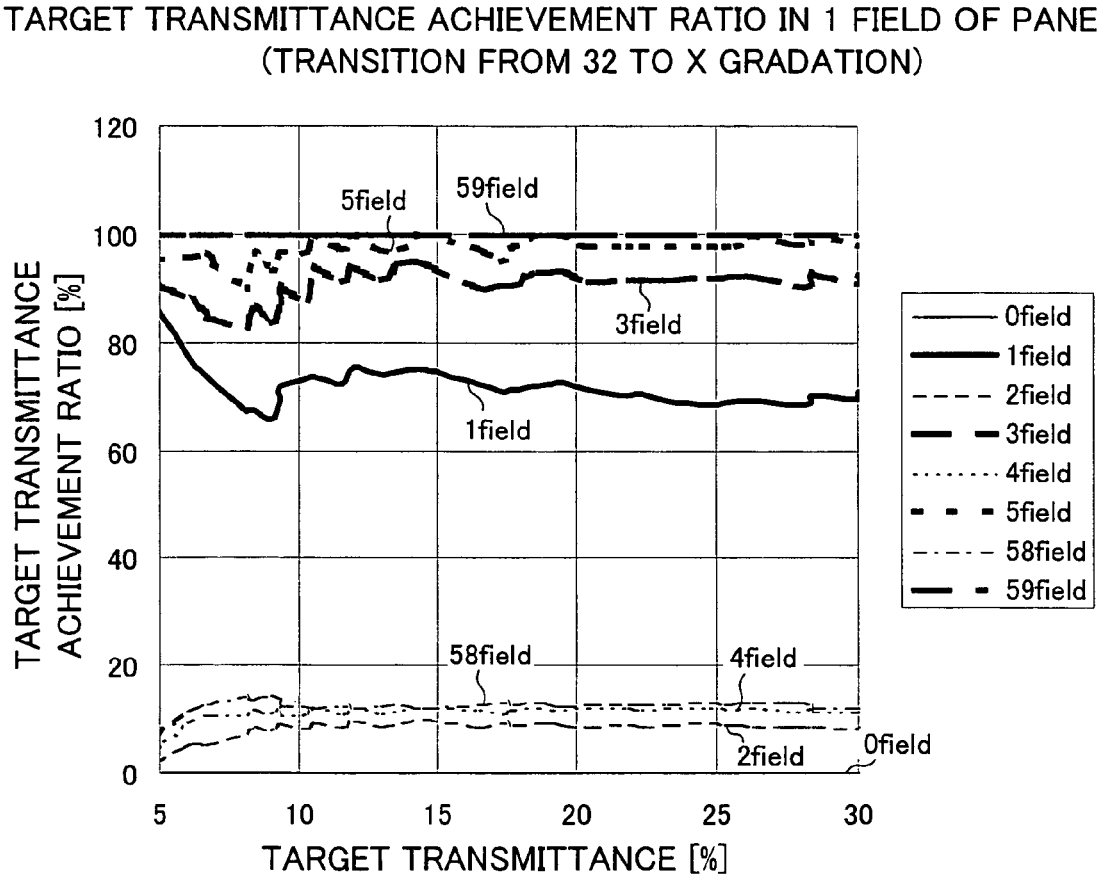
FIG. 50 is a graph showing achievement ratio in each field when a panel K13 is driven in a gradation of from 32 to X, as selected from the liquid crystal panels used for the evaluation.
Figure 51:
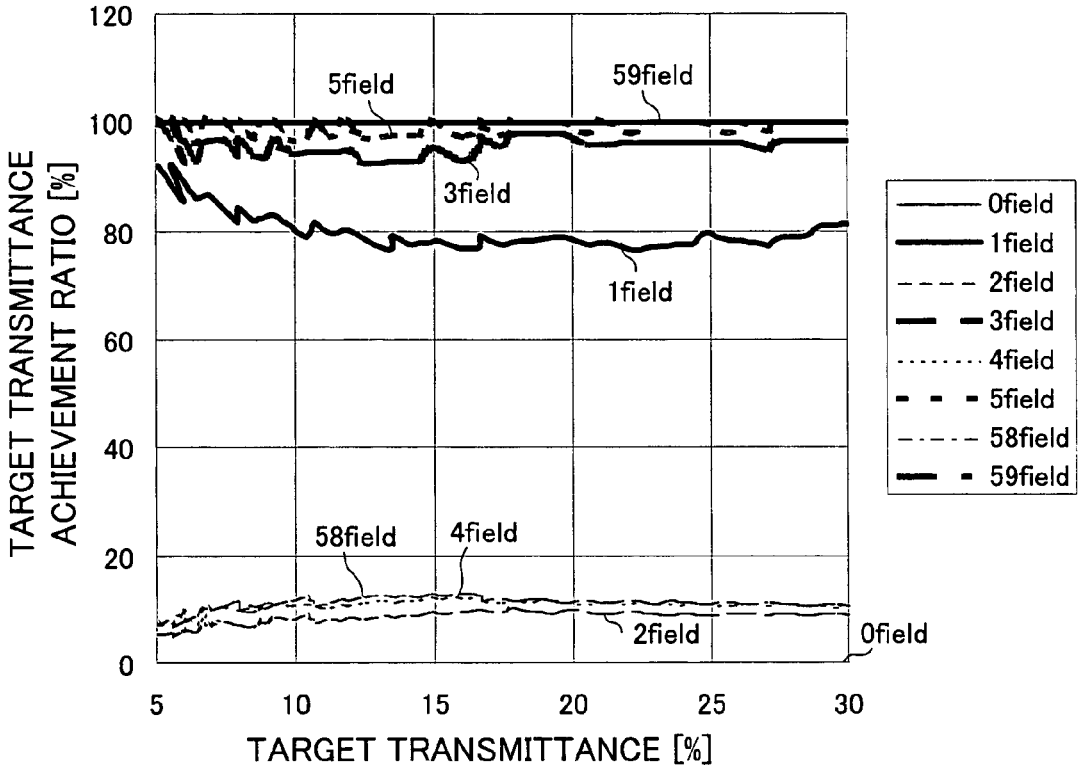
FIG. 51 is a graph showing achievement ratio in each field when a panel K14 is driven in a gradation of from 32 to X, as selected from the liquid crystal panels used for the evaluation.
Figure 52:
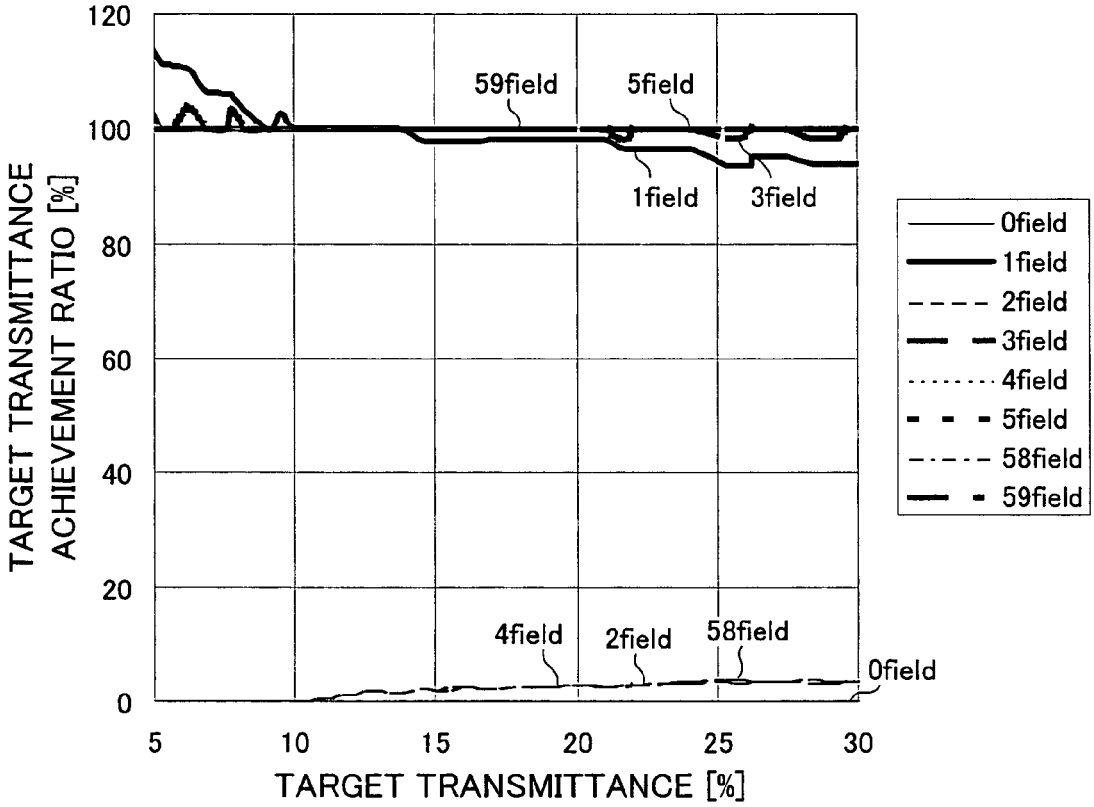
FIG. 52 is a graph showing achievement ratio in each field when a panel K15 is driven in a gradation of from 32 to X, as selected from the liquid crystal panels used for the evaluation.

As is clear from the results shown in FIGS. 44 through FIG. 53, for the liquid crystal panels (K12 and K13) which show an achievement ratio of not more than 90%, when displaying an image whose gradation is subjected to transition to 32 gradation, the gradation transition cannot be facilitated to a sufficient level. Specifically, as shown in FIG. 50, even for the liquid crystal panel K13, the luminance after 58 fields, which is supposed to be 0%, exceeds 10% of the target luminance corresponding to the higher gradation.

In contrast, according to the arrangement of the present embodiment, like the liquid crystal panel (K15) which shows the achievement ratio after one field of 95% and the liquid crystal panel (K14) which shows the achievement ratio after one field of 90%, even when displaying an image which is subjected to a gradation transition to 32 gradation which is the darkest gradation of a general image to be displayed in practical applications, an occurrence of excessive brightness and poor brightness can be suppressed.

The correspondence between the achievement ratio and $d2\cdot\gamma/\Delta V$ as obtained from the tables of FIGS. 43 and 19 is as shown in the table of FIG. 53. Similarly, the correspondence between the achievement ratio and the response sped as obtained from the tables of FIGS. 43 and 16 is as shown in the table of FIG. 54. In FIG. 53 and FIG. 54, the results of measurements of the achievement ratio, $d2\cdot\gamma/\Delta V$ and the response speed with changes in panel temperature in a range of 10° C. to 40° C. with respect to several sample liquid crystal panels are also shown. As explained, the smaller is $d2\cdot\gamma/\Delta V$, the higher is a response speed and the higher is the achievement ratio.

From the above figures and the formula (2), which shows the relationship between $d^2\cdot\gamma/\Delta V$ and the achievement ratio, it can be said that by selecting $d2\cdot\gamma/\Delta V$ to be larger than 0 and not larger than $56\times10^{-6}$ [$mm^4/(V\cdot s)$], it is possible to maintain the luminance achievement ratio (actual luminance/target luminance) after one field of the liquid crystal panel 11 at 90% or above.

Similarly, from the above figures and the relationship between the response speed and the achievement ratio, it can be said that by selecting a response time when the liquid crystal panel is set to a temperature of 5° C. to be longer than 0 ms and not longer than 17.8 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance, it is possible to maintain the luminance achievement ratio (actual luminance/target luminance) after one field of the liquid crystal panel 11 at 90% or above.

As a result, it is possible to realize the liquid crystal display apparatus 1, which permits an occurrence of excessive brightness or poor brightness to be suppressed to a level acceptable by the user, and which ensures a high contrast and desirable viewing angle characteristics, while realizing a high response speed.

In the above example, the liquid crystal panel 11 is specified by $d2\cdot\gamma/\Delta V$. However, in view of that $\Delta V$=5.5 [V] in most cases, by taking this value 5.5 [V] for $\Delta V$ as an approximate value, the formula (4) can be rewritten as the following simplified inequality (5).

$$d^2\cdot\gamma[mm^4/s] \leqq 308\times10^{-6} \quad (5)$$

In the above, explanations have been given through the case wherein one field is 16.7[m], and a voltage indicative of luminance is applied to each pixel PIX (i, j) once in each field. In this embodiment, subjective evaluations were made with respect to the liquid crystal display apparatus 1*a* by the user also under other condition, i.e., applying a voltage indicative of luminance twice in one field, such as the case of driving at double speed, or applying a voltage indicative of a black display irrespectively of a luminance as specified in the predetermined period in one field in the same manner as the subjective evaluations shown in FIG. 43. As in the case of the evaluation shown in FIG. 43, it can be confirmed that as long as the achievement ratio in the range of 90% to 100% can be ensured, the liquid crystal display apparatus 1 realizes a high contrast and desirable viewing angle characteristics, while suppressing a deterioration of an image quality due to a difference between a target luminance as specified and an actual luminance of a pixel, to a level acceptable by the user, while realizing an improved response speed by facilitating gradation transition, as in the former example of the liquid crystal display apparatus 1 of present embodiment.

As in the tables of FIG. 41 and FIG. 42, the columns for $d2\cdot\gamma/\Delta V$ and response speed $\lambda$ are formed in the tables of FIGS. 55 and 56 in addition to the columns for achievement ratio and evaluation.

In FIG. 55 and FIG. 56, the results of measurements of the achievement ratio, $d2\cdot\gamma/\Delta V$ and the response speed with changes in panel temperature in a range of 10° C. to 40° C. with respect to several sample liquid crystal panels are also shown. As explained, the smaller is $d2\cdot\gamma/\Delta V$, the higher is a response speed and the higher is the achievement ratio also in the case of driving at double speed.

From the above figures and the relationship among $d2\cdot\gamma/\Delta V$, the response speed and the achievement ratio, it can be said that by selecting $d2\cdot\gamma/\Delta V$ to be larger than 0 and not larger than $29\times10^{-6}$ [$mm^4/(V\cdot s)$] wherein $\gamma$ [$mm^2/s$] indicates a flow viscosity when the liquid crystal panel is set to a temperature of 5° C., d [μm] indicates a thickness of the liquid crystal layer in the liquid crystal panel, and $\Delta V$ [V] indicates a difference in liquid crystal layer application voltage between a maximum luminance display and a minimum luminance display, it is possible to maintain the luminance achievement ratio (actual luminance/target luminance) after one field of the liquid crystal panel 11 at 90% or above. Similarly, by selecting the response time when the liquid crystal panel is set to a temperature of 5° C. to be longer than 0 ms and not longer than 8.3 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance, it is possible to maintain the luminance achievement ratio (actual luminance/target luminance) after one field of the liquid crystal panel 11 at 90% or above.

As a result, it is possible to provide the liquid crystal display apparatus 1*a* which permits an occurrence of excessive brightness or poor brightness to be suppressed to a level acceptable by the user, and which ensures a high contrast and desirable viewing angle characteristics, while realizing a high response speed.

In the described preferred first and second embodiments, explanations have been given through the case of the liquid crystal panel of a multidomain alignment or a radical oblique alignment. However, the present invention is not limited to such liquid crystal panel, and it is confirmed that as long as liquid crystal molecules are inclined from the substantially vertically aligned state with an application of a voltage across electrodes, any liquid crystal panel can offer the same results as achieved from the liquid crystal panels adopted in the first and second embodiments. It should be noted here that by adopting the liquid crystal panel of a multidomain alignment or a radical oblique alignment as in the first and second embodiments, a larger viewing angle can be realized as compared to the liquid crystal panel in which liquid crystal molecules in each pixel are inclined in the same direction.

Incidentally, in each of the embodiments, explanations have been given through the case where an image data DAT is driven at 60 [Hz] (120 [Hz] when driving at double speed) as in the NTSC (National Television System Committee). However, the same effect can be achieved from the case where the image data DAT is driven at lower frequency, for example, at 50 [Hz] (100 [Hz] when driving at double speed), as in the case of PAL, by setting the achievement ratio to fall in the range defined in each of the embodiments of the present invention.

In the above example, the liquid crystal panel 11 is specified by $d2\cdot\gamma/\Delta V$. However, in view of that $\Delta V=5.5$ [V] in most cases, by taking this value 5.5 [V] for $\Delta V$ as an approximate value, the formula (4) can be rewritten as the following simplified inequality (5).

$$d^2\cdot\gamma[mm^4/s]\leqq308\times10^{-6} \tag{5}$$

In the above, explanations have been given the case wherein one field is 16.7[m], and a voltage indicative of luminance is applied to each pixel PIX (i, j) once in each field. In this embodiment, subjective evaluations were made with respect to the liquid crystal display apparatus 1*a* by the user also under other condition, i.e., applying a voltage indicative of luminance twice in one field, such as the case of driving at double speed, or applying a voltage indicative of a black display irrespectively of a luminance as specified in the predetermined period in one field in the same manner as the subjective evaluations shown in FIG. 43. As in the case of the evaluation shown in FIG. 43, it can be confirmed that as long as the achievement ratio in the range of 90% to 100% can be ensured, the liquid crystal display apparatus 1 realizes a high contrast and desirable viewing angle characteristics, while suppressing a deterioration of an image quality due to a difference between a target luminance as specified and an actual luminance of a pixel, to a level acceptable by the user, while realizing an improved response speed by facilitating gradation transition, as in the former example of the liquid crystal display apparatus 1 of present embodiment.

As described, the liquid crystal display apparatus (1, 1*a*) of the present invention is provided with i) a liquid crystal panel (11) in which a display signal indicative of a luminance of each pixel is written at every predetermined display period, and ii) correction means (modulation driving processing section 12, for example) for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate (TFT substrate 111*a*, for example), a second substrate (counter substrate 111*b*, for example), and a liquid crystal layer (111*c*) formed between the first substrate and the second substrate;

in the liquid crystal panel, formed is a region made up of a plurality of pixels (pixels PIX (1, 1) . . . ), the region being defined by a first electrode (pixel electrode 121*a*, for example) provided on the first substrate on the side of the liquid crystal layer, and a second electrode (counter electrode 121*b*, for example) provided on the second substrate so as to face the first electrode via the liquid crystal layer, wherein a voltage corresponding to the display signal is applied across the first electrode and the second electrode;

liquid crystal molecules of the liquid crystal layer are vertically aligned without an application of a voltage across the first electrode and the second electrode, and are inclined from a vertical alignment with an application of a voltage across the first electrode and the second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means, and the liquid crystal display apparatus of the present invention has the following characteristic structure.

That is, the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and an achievement ratio after one period is in a range of from 95% to 100% when the liquid crystal panel is set to a temperature of 5° C., and the second last data signal indicates a maximum luminance display, and the last data signal indicates a minimum luminance display, wherein the achievement ratio indicates a ratio of a luminance actually displayed in a pixel of the liquid crystal panel with respect to the luminance indicated by the last data signal, and the achievement ratio after one period indicates an achievement ratio directly before inputting the current panel signal in a period after the last panel signal is input.

In the foregoing structure as well as in each of the below explained structures, the liquid crystal panel may be arranged such that a current panel signal is written without being processed as a voltage signal between the first electrode and the second electrode of each pixel, or a current panel signal is written by applying a voltage as generated so as to correspond to a luminance indicated by the current panel signal.

As described, the liquid crystal display apparatus (1) of the present invention is provided with i) a liquid crystal panel (11) in which a display signal indicative of a luminance of each pixel is written at every predetermined display period, and ii) correction means (modulation driving processing section 21, for example) for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate (TFT substrate 111*a*, for example), a second substrate (counter substrate 111*b*, for example), and a liquid crystal layer (111*c*) formed between the first substrate and the second substrate;

in the liquid crystal panel, formed is a region made up of a plurality of pixels (pixels PIX (1, 1) . . . ), the region being defined by a first electrode (pixel electrode 121*a*, for example) provided on the first substrate on the side of the liquid crystal layer, and a second electrode (counter electrode 121*b*, for example) provided on the second substrate so as to face the first electrode via the liquid crystal layer, wherein a voltage corresponding to the display signal is applied across the first electrode and the second electrode;

liquid crystal molecules of the liquid crystal layer are vertically aligned without an application of a voltage across the first electrode and the second electrode, and are inclined from a vertical alignment with an application of a voltage across the first electrode and the second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means, and the liquid crystal display apparatus of the present invention has the following characteristic structure.

That is, the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

the predetermined display period is 16.7 [ms]; and $d2\cdot\gamma/\Delta V$ is selected to be larger than 0 and not larger than $41\times10^{-6}$ [$mm^4/(V\cdot s)$], wherein $\gamma$ [$mm^2/s$] indicates a flow viscosity when the liquid crystal panel is set to a temperature of 5° C., d [m] indicates a thickness of the liquid crystal layer in the liquid crystal panel, and $\Delta V$ [V] indicates a difference in liquid crystal layer application voltage between a maximum luminance display and a minimum luminance display.

As described, the liquid crystal display apparatus (1) of the present invention is provided with i) a liquid crystal panel (11) in which a display signal indicative of a luminance of each pixel is written at every predetermined display period, and ii) correction means (modulation driving processing section 21, for example) for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate (TFT substrate 111*a*, for example), a second substrate (counter substrate 111*b*, for example), and a liquid crystal layer (111*c*) formed between the first substrate and the second substrate;

in the liquid crystal panel, formed is a region made up of a plurality of pixels (pixels PIX (1, 1) . . . ), the region being defined by a first electrode (pixel electrode 121*a*, for example) provided on the first substrate on the side of the liquid crystal layer, and a second electrode (counter electrode 121*b*, for example) provided on the second substrate so as to face the first electrode via the liquid crystal layer, wherein a voltage corresponding to the display signal is applied across the first electrode and the second electrode;

liquid crystal molecules of the liquid crystal layer are vertically aligned without an application of a voltage across the first electrode and the second electrode, and are inclined from a vertical alignment with an application of a voltage across the first electrode and the second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means, and the liquid crystal display apparatus has the following characteristic structure.

That is, the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

the predetermined display period is 16.7 [ms]; and a response time when the liquid crystal panel is set to a temperature of 5° C. is selected to be longer than 0 ms and not longer than 12.7 ms, wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

As described, the liquid crystal display apparatus (1*a*) of the present invention is provided with i) a liquid crystal panel (11) in which a display signal indicative of a luminance of each pixel is written at every predetermined display period, and ii) correction means (modulation driving processing section 21, for example) for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate (TFT substrate 111*a*, for example), a second substrate (counter substrate 111*b*, for example), and a liquid crystal layer (111*c*) formed between the first substrate and the second substrate;

in the liquid crystal panel, formed is a region made up of a plurality of pixels (pixels PIX (1, 1) . . . ), the region being defined by a first electrode (pixel electrode 121*a*, for example) provided on the first substrate on the side of the liquid crystal layer, and a second electrode (counter electrode 121*b*, for example) provided on the second substrate so as to face the first electrode via the liquid crystal layer, wherein a voltage corresponding to the display signal is applied across the first electrode and the second electrode;

liquid crystal molecules of the liquid crystal layer are vertically aligned without an application of a voltage across the first electrode and the second electrode, and are inclined from a vertical alignment with an application of a voltage across the first electrode and the second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means, and the liquid crystal display apparatus has the following characteristic structure.

That is, the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

the predetermined display period is 8.3 [ms]; and $d2\cdot\gamma/\Delta V$ is selected to be larger than 0 and not larger than $17\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of the liquid crystal layer in the liquid crystal panel, and $\Delta V$ [V] indicates a difference in liquid crystal layer application voltage between a maximum luminance display and a minimum luminance display.

As described, the liquid crystal display apparatus (1) of the present invention is provided with i) a liquid crystal panel (11) in which a display signal indicative of a luminance of each pixel is written at every predetermined display period, and ii) correction means (modulation driving processing section 21, for example) for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate (TFT substrate 111*a*, for example), a second substrate (counter substrate 111*b*, for example), and a liquid crystal layer (111*c*) formed between the first substrate and the second substrate;

in the liquid crystal panel, formed is a region made up of a plurality of pixels (pixels PIX (1, 1) . . . ), the region being defined by a first electrode (pixel electrode 121*a*, for example) provided on the first substrate on the side of the liquid crystal layer, and a second electrode (counter electrode 121*b*, for example) provided on the second substrate so as to face the first electrode via the liquid crystal layer, wherein a voltage corresponding to the display signal is applied across the first electrode and the second electrode;

liquid crystal molecules of the liquid crystal layer are vertically aligned without an application of a voltage across the first electrode and the second electrode, and are inclined from a vertical alignment with an application of a voltage across the first electrode and the second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means, and the liquid crystal display apparatus has the following characteristic structure.

That is, the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

the predetermined display period is 8.3 [ms]; and a response time when the liquid crystal panel is set to a temperature of 5° C. is selected to be longer than 0 ms and not longer than 6.3 ms, wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

As described, the liquid crystal display apparatus (1, 1*a*) of the present invention is provided with i) a liquid crystal panel (11) in which a display signal indicative of a luminance of each pixel is written at every predetermined display period, and ii) correction means (modulation driving processing section 21, for example) for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate (TFT substrate 111*a*, for example), a second substrate (counter substrate 111*b*, for example), and a liquid crystal layer (111*c*) formed between the first substrate and the second substrate;

in the liquid crystal panel, formed is a region made up of a plurality of pixels (pixels PIX (1, 1) . . . ), the region being defined by a first electrode (pixel electrode 121*a*, for example) provided on the first substrate on the side of the liquid crystal layer, and a second electrode (counter electrode 121*b*, for example) provided on the second substrate so as to face the first electrode via the liquid crystal layer, wherein a voltage corresponding to the display signal is applied across the first electrode and the second electrode;

liquid crystal molecules of the liquid crystal layer are vertically aligned without an application of a voltage across the first electrode and the second electrode, and are inclined from a vertical alignment with an application of a voltage across the first electrode and the second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means, and the liquid crystal display apparatus has the following characteristic structure.

That is, the gradation transition is facilitated by the correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal; and an achievement ratio after one period is in a range of from 90% to 100% when the liquid crystal panel is set to a temperature of 5° C., and the second last data signal indicates a maximum luminance display, and the last data signal indicates a minimum luminance display, wherein the achievement ratio indicates a ratio of a luminance actually displayed in a pixel of the liquid crystal panel with respect to the luminance indicated by the last data signal, and the achievement ratio after one period indicates an achievement ratio directly before inputting the current panel signal in a period after the last panel signal is input.

As described, the liquid crystal display apparatus (1) of the present invention is provided with i) a liquid crystal panel (11) in which a display signal indicative of a luminance of each pixel is written at every predetermined display period, and ii) correction means (modulation driving processing section 21, for example) for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate (TFT substrate 111*a*, for example), a second substrate (counter substrate 111*b*, for example), and a liquid crystal layer (111*c*) formed between the first substrate and the second substrate;

in the liquid crystal panel, formed is a region made up of a plurality of pixels (pixels PIX (1, 1) . . . ), the region being defined by a first electrode (pixel electrode 121*a*, for example) provided on the first substrate on the side of the liquid crystal layer, and a second electrode (counter electrode 121*b*, for example) provided on the second substrate so as to face the first electrode via the liquid crystal layer, wherein a voltage corresponding to the display signal is applied across the first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means, and the liquid crystal display apparatus has the following characteristic structure.

That is, the gradation transition is facilitated by the correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

the predetermined display period is 16.7 [ms]; and $d2\cdot\gamma/\Delta V$ is selected to be larger than 0 and not larger than $56\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of the liquid crystal layer in the liquid crystal panel, and $\Delta V$ [V] indicates a difference in liquid crystal layer application voltage between a maximum luminance display and a minimum luminance display.

As described, the liquid crystal display apparatus (1) of the present invention is provided with i) a liquid crystal panel (11) in which a display signal indicative of a luminance of each pixel is written at every predetermined display period, and ii) correction means (modulation driving processing section 21, for example) for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate (TFT substrate 111*a*, for example), a second substrate (counter substrate 111*b*, for example), and a liquid crystal layer (111*c*) formed between the first substrate and the second substrate;

in the liquid crystal panel, formed is a region made up of a plurality of pixels (pixels PIX (1, 1). . . ), the region being defined by a first electrode (pixel electrode 121*a*, for example) provided on the first substrate on the side of the liquid crystal layer, and a second electrode (counter electrode 121*b*, for example) provided on the second substrate so as to face the first electrode via the liquid crystal layer, wherein a voltage corresponding to the display signal is applied across the first electrode and the second electrode;

liquid crystal molecules of the liquid crystal layer are vertically aligned without an application of a voltage across the first electrode and the second electrode, and are inclined from a vertical alignment with an application of a voltage across the first electrode and the second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means, and the liquid crystal display apparatus has the following characteristic structure.

That is, the gradation transition is facilitated by the correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

the display predetermined display period is 16.7 [ms]; and a response time when the liquid crystal panel is set to a temperature of 5° C. is selected to be longer than 0 ms and not longer than 17.8 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

As described, the liquid crystal display apparatus (1*a*) of the present invention is provided with i) a liquid crystal panel (11) in which a display signal indicative of a luminance of each pixel is written at every predetermined display period, and ii) correction means (modulation driving processing section 21, for example) for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate (TFT substrate 111*a*, for example), a second substrate (counter substrate 111*b*, for example), and a liquid crystal layer (111*c*) formed between the first substrate and the second substrate;

in the liquid crystal panel, formed is a region made up of a plurality of pixels (pixels PIX (1, 1) . . . ), the region being defined by a first electrode (pixel electrode 121*a*, for example) provided on the first substrate on the side of the liquid crystal layer, and a second electrode (counter electrode 121*b*, for example) provided on the second substrate so as to face the first electrode via the liquid crystal layer, wherein a voltage corresponding to the display signal is applied across the first electrode and the second electrode;

liquid crystal molecules of the liquid crystal layer are vertically aligned without an application of a voltage across the first electrode and the second electrode, and are inclined from a vertical alignment with an application of a voltage across the first electrode and the second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means.

That is, the gradation transition is facilitated by the correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

the predetermined display period is 8.3 [ms]; and $d2\cdot\gamma/\Delta V$ is selected to be larger than 0 and not larger than $29\times10^{-6}$ [$mm^4/(V\cdot s)$] wherein $\gamma$ [$mm^2/s$]indicates a flow viscosity when the liquid crystal panel is set to a temperature of 5° C., d [μm] indicates a thickness of the liquid crystal layer in the liquid crystal panel, and $\Delta V$ [V] indicates a difference in liquid crystal layer application voltage between a maximum luminance display and a minimum luminance display.

As described, the liquid crystal display apparatus (1*a*) of the present invention is provided with i) a liquid crystal panel (11) in which a display signal indicative of a luminance of each pixel is written at every predetermined display period, and ii) correction means (modulation driving processing section 21, for example) for correcting the display signal to be written in the liquid crystal display panel by correcting the display signal which transmits therethrough, the correction means being provided in a transmission path of the display signal, which extends from an image signal source to the liquid crystal panel, wherein:

the liquid crystal panel comprises a first substrate (TFT substrate 111*a*, for example), a second substrate (counter substrate 111*b*, for example), and a liquid crystal layer (111*c*) formed between the first substrate and the second substrate;

in the liquid crystal panel, formed is a region made up of a plurality of pixels (pixels PIX (1, 1) . . . ), the region being defined by a first electrode (pixel electrode 121*a*, for example) provided on the first substrate on the side of the liquid crystal layer, and a second electrode (counter electrode 121*b*, for example) provided on the second substrate so as to face the first electrode via the liquid crystal layer, wherein a voltage corresponding to the display signal is applied across the first electrode and the second electrode;

liquid crystal molecules of the liquid crystal layer are vertically aligned without an application of a voltage across the first electrode and the second electrode, and are inclined from a vertical alignment with an application of a voltage across the first electrode and the second electrode; and a luminance, which is indicative of a current panel signal when the luminance indicated by the current data signal has changed from a luminance indicated by a last data signal, is corrected by the correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of the liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to the correction means, and the liquid crystal display apparatus has the following characteristic structure.

That is, the gradation transition is facilitated by the correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

the predetermined display period is 8.3 [ms]; and a response time when the liquid crystal panel is set to a temperature of 5° C. is selected to be longer than 0 ms and not longer than 8.3 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

As described, the liquid crystal television of the present invention is characterized by including i) the liquid crystal display apparatus of any of the foregoing structures, and ii) a tuner section, which servers as an image signal source of the liquid crystal display apparatus, for selecting a channel of a television transmission signal and outputting as a display signal, a television image signal of the channel as selected.

As described, the liquid crystal monitor of the present invention is characterized by including i) the liquid crystal display apparatus of any of the foregoing structures, and ii) a signal processing section, which serves as an image signal source of the liquid crystal display apparatus, for processing a monitor signal indicative of an image to be displayed on a liquid crystal panel and outputting as a display signal, the monitor signal as processed.

As described, the liquid crystal display apparatus of the present invention is arranged such that:

the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and According to the foregoing structure, the correction means facilitates a gradation transition to the above degree, and therefore, as long as a gradation transition from the second last gradation to the last gradation is made to a sufficient level, it is possible to attain a current luminance in a level as desired by a gradation transition from the last gradation to the current gradation.

The gradation transition is facilitated by the correction means to the above degree, and therefore, in the case where in the gradation transition from the second last gradation to the last gradation is decay (in the direction of decreasing the luminance), and the gradation transition is made in an insufficient level, the following problem may arise. That is, in the case where the gradation transition from the last transition to the current transition is rise (in the direction of increasing the luminance), the gradation transition may be too much facilitated, which may result in an excessive luminance. Particularly, under the outdoor use environment, or even under the indoor use environment, if the liquid crystal panel has not been heated enough by circuits of the liquid crystal apparatus (for example, directly after turning on the power of the liquid crystal display apparatus), an excessive brightness is liable to occur, and an image quality is therefore liable to be deteriorated.

However, according to the structure of the present invention, the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and an achievement ratio after one period is in a range of from 95% to 100% when said liquid crystal panel is set to a temperature of 5° C., and the second last data signal indicates a maximum luminance display, and the last data signal indicates a minimum luminance display, even in the case of driving the liquid crystal display apparatus under the foregoing low temperature conditions, an occurrence of excessive brightness or poor brightness can be suppressed to a level acceptable by the user. Moreover, it is possible to provide a liquid crystal display apparatus, which realizes a high contrast and desirable viewing angle characteristics, while suppressing a deterioration of an image quality due to a difference between a target luminance as specified and an actual luminance of a pixel to a level acceptable by the user, irrespectively of an improved response speed by facilitating gradation transition.

As described, the liquid crystal display apparatus in accordance with the present invention is arranged such that:

the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and $d2 \cdot \gamma/\Delta V$ is selected to be larger than 0 and not larger than $41 \times 10^{-6}$ [$mm^4/(V \cdot s)$] when said liquid crystal panel is set to a temperature of 5° C.

According to the foregoing structure, when displaying a generally used image signal, i.e., an image signal with a period of specifying a luminance of each pixel of 16.7 [ms], the achievement ratio can be set in a range of from 95% to 100%.

As a result, it is possible to provide a liquid crystal display apparatus, which realizes a high contrast and desirable viewing angle characteristics, while suppressing an occurrence of excessive brightness and poor brightness, and a deterioration of a display quality due to a difference between a target luminance as specified and an actual luminance of a pixel to a level acceptable by the user, irrespectively of an improved response speed by facilitating gradation transition.

As described, the liquid crystal display apparatus of the present invention is arranged such that:

the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and a response time when the liquid crystal panel is set to a temperature of 5° C. is selected to be longer than 0 ms and not longer than 12.7 ms.

According to the foregoing structure, when displaying a generally used image signal, i.e., an image signal when a period of specifying a luminance of the pixel is 16.7 [ms], the achievement ratio can be set in a range of from 95% to 100%.

As a result, it is possible to provide a liquid crystal display apparatus, which realizes a high contrast and desirable viewing angle characteristics, while suppressing an occurrence of excessive brightness and poor brightness, and a deterioration of an image quality due to a difference between a target luminance as specified and an actual luminance of a pixel to a level acceptable by the user, irrespectively of an improved response speed by facilitating gradation transition.

As described, the liquid crystal display apparatus in accordance with the present invention is characterized in that the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and $d2 \cdot \gamma/\Delta V$ is selected to be larger than 0 and not larger than $17 \times 10^{-6}$ [$mm^4/(V \cdot s)$].

According to the foregoing structure, when displaying a generally used image signal by driving at double speed, i.e., an image signal with a period of specifying a luminance of the pixel of 8.3 [ms], the achievement ratio can be set in a range of from 95% to 100%.

As a result, as achieved from the foregoing liquid crystal display apparatuses, it is possible to provide a liquid crystal display apparatus, which realizes a high contrast and desirable viewing angle characteristics, while suppressing an occurrence of excessive brightness and poor brightness, and a deterioration of an image quality due to a difference between a target luminance as specified and an actual luminance of a pixel to a level acceptable by the user, irrespectively of an improved response speed by facilitating gradation transition.

As described, the liquid crystal display apparatus in accordance with the present invention is arranged such that:

the gradation transition is facilitated by the correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and a response time when the liquid crystal panel is set to a temperature of 5° C. is selected to be longer than 0 ms and not longer than 6.3 ms.

According to the foregoing structure, when displaying a generally used image signal by driving at double speed, i.e., an image signal with a period of specifying a luminance of the pixel of 8.3 [ms], the achievement ratio can be set in a range of from 95% to 100%.

As a result, as achieved from the foregoing liquid crystal display apparatuses, it is possible to provide a liquid crystal display apparatus, which realizes a high contrast and desirable viewing angle characteristics, while suppressing an occurrence of excessive brightness and poor brightness, and a deterioration of an image quality due to a difference between a target luminance as specified and an actual luminance of a pixel to a level acceptable by the user, irrespectively of an improved response speed by facilitating gradation transition.

As described, the liquid crystal display apparatus in accordance with the present invention is arranged such that:

the gradation transition is facilitated by the correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

an achievement ratio after one period is in a range of from 90% to 100% when the liquid crystal panel is set to a temperature of 5° C.

As described, according to the foregoing structure, the gradation transition is facilitated by the correction means, and it is therefore possible to improve a response speed of a pixel as compared to the case of not facilitating the gradation transition.

The gradation transition is facilitated by the correction means to the above degree, and therefore, excessive brightness is less likely to occur as compared to the case win which the gradation transition is facilitated to a degree which permits for an actual luminance of the pixel to attain the target luminance by the current gradation transition; on the other hand, a problem may arise in that the gradation transition may not be facilitated to a sufficient level by the gradation transition from the last transition to the current transition. In this case, since the luminance of the pixel cannot reach the target luminance, when displaying an image while a luminance of each pixel is being subjected to changes with time (when displaying a dynamic image, for example), an image quality may be deteriorated to a level recognized by the user.

Particularly, under the outdoor use environment, or even under the indoor use environment, if the liquid crystal panel has not been heated enough by circuits of the liquid crystal apparatus (for example, directly after turning on the power of the liquid crystal display apparatus), it is likely that the gradation transition cannot be made to a sufficient level, and an image quality is therefore liable to be deteriorated.

However, according to the structure of the present invention, an achievement ratio after one period required for rewriting a display signal from a value indicative of a maximum luminance display to a value indicative of a minimum luminance display is in a range of from 95% to 100% when said liquid crystal panel is set to a temperature of 5° C., even in the case of driving the liquid crystal display apparatus under the foregoing low temperature conditions, deterioration of a display quality can be suppressed to a level acceptable by the user. Moreover, it is possible to provide a liquid crystal display apparatus, which realizes a high contrast and desirable viewing angle characteristics, while suppressing a deterioration of an image quality due to a difference between a target luminance as specified and an actual luminance of a pixel to a level acceptable by the user, irrespectively of an improved response speed by facilitating gradation transition.

As described, the liquid crystal display apparatus in accordance with the present invention is arranged such that:

the gradation transition is facilitated by the correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal; and $d2\cdot\gamma/\Delta V$ is selected to be larger than 0 and not larger than $56\times10^{-6}$ [$mm^4/(V\cdot s)$] when said liquid crystal panel is set to a temperature of 5° C.

According to the foregoing structure, when displaying a generally used image signal, i.e., an image signal with a period of specifying a luminance of each pixel of 16.7 [ms], the achievement ratio can be set in a range of from 90% to 100%.

As a result, it is possible to provide a liquid crystal display apparatus, which realizes a high contrast and desirable viewing angle characteristics, while suppressing an occurrence of excessive brightness and poor brightness, and a deterioration of an image quality due to a difference between a target luminance as specified and an actual luminance of a pixel to a level acceptable by the user, irrespectively of an improved response speed by facilitating gradation transition.

As described, the liquid crystal display apparatus of the present invention is arranged such that:

the gradation transition is facilitated by the correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal; and a response time when the liquid crystal panel is set to a temperature of 5° C. is selected to be longer than 0 ms and not longer than 17.8 ms.

According to the foregoing structure, when displaying a generally used image signal, i.e., an image signal with a period of specifying a luminance of each pixel of 16.7 [ms], the achievement ratio can be set in a range of from 90% to 100%.

As a result, it is possible to provide a liquid crystal display apparatus, which realizes a high contrast and desirable viewing angle characteristics, while suppressing an occurrence of excessive brightness and poor brightness, and a deterioration of an image quality due to a difference between a target luminance as specified and an actual luminance of a pixel to a level acceptable by the user, irrespectively of an improved response speed by facilitating gradation transition.

As described, the liquid crystal display apparatus of the present invention is arranged such that:

the gradation transition is facilitated by the correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal; and $d2\cdot\gamma/\Delta V$ is selected to be larger than 0 and not larger than $29\times10^{-6}$ [$mm^4/(V\cdot s)$] when said liquid crystal panel is set to a temperature of 5° C.

According to the foregoing structure, when displaying a generally used image signal by driving at double speed, i.e., an image signal with a period of specifying a luminance of the pixel of 8.3 [ms], the achievement ratio can be set in a range of from 90% to 100%.

As a result, as achieved from the foregoing liquid crystal display apparatuses, it is possible to provide a liquid crystal display apparatus, which realizes a high contrast and desirable viewing angle characteristics, while suppressing an occurrence of excessive brightness and poor brightness, and a deterioration of an image quality due to a difference between a target luminance as specified and an actual luminance of a pixel to a level acceptable by the user, irrespectively of an improved response speed by facilitating gradation transition.

As described, the liquid crystal display apparatus in accordance with the present invention is arranged such that:

the gradation transition is facilitated by the correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal; and a response time when the liquid crystal panel is set to a temperature of 5° C. is selected to be longer than 0 ms and not longer than 8.3 ms.

According to the foregoing structure, when displaying a generally used image signal by driving at double speed, i.e., an image signal with a period of specifying a luminance of the pixel of 8.3 [ms], the achievement ratio can be set in a range of from 90% to 100%.

As a result, as achieved from the foregoing liquid crystal display apparatuses, it is possible to provide a liquid crystal display apparatus, which realizes a high contrast and desirable viewing angle characteristics, while suppressing an occurrence of excessive brightness and poor brightness, and a deterioration of an image quality due to a difference between a target luminance as specified and an actual luminance of a pixel to a level acceptable by the user, irrespectively of an improved response speed by facilitating gradation transition.

As described, liquid crystal television of the present invention is arranged so as to include the liquid crystal display apparatus of any of the foregoing structures and the tuner section. The foregoing liquid crystal television adopts the liquid crystal display apparatus which realizes a high contrast and desirable viewing angle characteristics, while suppressing an occurrence of excessive brightness and poor brightness, and a deterioration of an image quality due to a difference between a target luminance as specified and an actual luminance of a pixel to a level acceptable by the user, irrespectively of an improved response speed by facilitating gradation transition, it is suitable applied to a display of a dynamic image. The present invention is therefore suited for a liquid crystal display apparatus of the liquid crystal television for displaying a television image signal output from the tuner section.

As described, liquid crystal monitor of the present invention is arranged so as to include the liquid crystal display apparatus of any of the foregoing structures and the signal processing section. The foregoing liquid crystal monitor adopts the liquid crystal display apparatus which realizes a high contrast and desirable viewing angle characteristics, while suppressing an occurrence of excessive brightness and poor brightness, and a deterioration of an image quality due to a difference between a target luminance as specified and an actual luminance of a pixel to a level acceptable by the user, irrespectively of an improved response speed by facilitating gradation transition, it is suitable applied to a display of a dynamic image. The present invention is therefore suited for a liquid crystal display apparatus of the liquid crystal monitor for displaying a monitor image signal.

As described, the liquid crystal display apparatus of the present invention realizes a high contrast and desirable viewing angle characteristics, while suppressing an occurrence of excessive brightness and poor brightness, irrespectively of an improved response speed by facilitating gradation transition, and is therefore suitably applied to a liquid crystal television, a liquid crystal monitor, etc.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A liquid crystal display apparatus provided with i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and an achievement ratio after one period is in a range of from 95% to 100% when said liquid crystal panel is set to a temperature of 5° C., and the second last data signal indicates a maximum luminance display, and the last data signal indicates a minimum luminance display, wherein the achievement ratio indicates a ratio of a luminance actually displayed in a pixel of the liquid crystal panel with respect to the luminance indicated by the last data signal, and the achievement ratio after one period indicates an achievement ratio directly before inputting the current panel signal in a period after the last panel signal is input.

2. A liquid crystal display apparatus provided with i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

said predetermined display period is 16.7 [ms]; and $d2\cdot\gamma/\Delta V$ is selected to be larger than 0 and not larger than $41\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

3. A liquid crystal display apparatus provided with i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

said predetermined display period is 16.7 [ms]; and a response time when the liquid crystal panel is set to a temperature of 5° C. is selected to be longer than 0 ms and not longer than 12.7 ms, wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

4. A liquid crystal display apparatus provided with i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

said predetermined display period is 8.3 [ms]; and $d2\cdot\gamma/\Delta V$ is selected to be larger than 0 and not larger than $17\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

5. A liquid crystal display apparatus provided with i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and said predetermined display period is 8.3 [ms]; and a response time when the liquid crystal panel is set to a temperature of 5° C. is selected to be longer than 0 ms and not longer than 6.3 ms, wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

6. A liquid crystal display apparatus provided with i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal; and an achievement ratio after one period is in a range of from 90% to 100% when said liquid crystal panel is set to a temperature of 5° C., and the second last data signal indicates a maximum luminance display, and the last data signal indicates a minimum luminance display, wherein the achievement ratio indicates a ratio of a luminance actually displayed in a pixel of the liquid crystal panel with respect to the luminance indicated by the last data signal, and the achievement ratio after one period indicates an achievement ratio directly before inputting the current panel signal in a period after the last panel signal is input.

7. A liquid crystal display apparatus provided with i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal; and said predetermined display period is 16.7 [ms]; and $d2\cdot\gamma/\Delta V$ is selected to be larger than 0 and not larger than $56\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

8. A liquid crystal display apparatus provided with i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

said display predetermined display period is 16.7 [ms]; and a response time when the liquid crystal panel is set to a temperature of 5° C. is selected to be longer than 0 ms and not longer than 17.8 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

9. A liquid crystal display apparatus provided with i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

said predetermined display period is 8.3 [ms]; and $d2\cdot\gamma/\Delta V$ is selected to be larger than 0 and not larger than $29\times10^{-6}$ [$mm^4/(V\cdot s)$] wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

10. A liquid crystal display apparatus provided with i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

said predetermined display period is 8.3 [ms]; and a response time when the liquid crystal panel is set to a temperature of 5° C. is selected to be longer than 0 ms and not longer than 8.3 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

11. A liquid crystal television provided with i) a liquid crystal display apparatus, and ii) a tuner section, which servers as an image signal source of said liquid crystal display apparatus, for selecting a channel of a television transmission signal and outputting as a display signal, a television image signal of the channel as selected;

said liquid crystal display apparatus comprising i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and an achievement ratio after one period is in a range of from 95% to 100% when said liquid crystal panel is set to a temperature of 5° C., and the second last data signal indicates a maximum luminance display, and the last data signal indicates a minimum luminance display, wherein the achievement ratio indicates a ratio of a luminance actually displayed in a pixel of the liquid crystal panel with respect to the luminance indicated by the last data signal, and the achievement ratio after one period indicates an achievement ratio directly before inputting the current panel signal in a period after the last panel signal is input.

12. A liquid crystal television provided with i) a liquid crystal display apparatus, and ii) a tuner section, which servers as an image signal source of said liquid crystal display apparatus, for selecting a channel of a television transmission signal and outputting as a display signal, a television image signal of the channel as selected;

said liquid crystal display apparatus comprising i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

said predetermined display period is 16.7 [ms]; and $d2\cdot\gamma/\Delta V$ is selected to be larger than 0 and not larger than $41\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

13. A liquid crystal television provided with i) a liquid crystal display apparatus, and ii) a tuner section, which servers as an image signal source of said liquid crystal display apparatus, for selecting a channel of a television transmission signal and outputting as a display signal, a television image signal of the channel as selected;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

said predetermined display period is 16.7 [ms]; and $d2\cdot\gamma/\Delta V$ is selected to be larger than 0 and not larger than $41\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

14. A liquid crystal television provided with i) a liquid crystal display apparatus, and ii) a tuner section, which servers as an image signal source of said liquid crystal display apparatus, for selecting a channel of a television transmission signal and outputting as a display signal, a television image signal of the channel as selected;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

said predetermined display period is 8.3 [ms]; and $d2\cdot\gamma/\Delta V$ is selected to be larger than 0 and not larger than $17\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

15. A liquid crystal television provided with i) a liquid crystal display apparatus, and ii) a tuner section, which servers as an image signal source of said liquid crystal display apparatus, for selecting a channel of a television transmission signal and outputting as a display signal, a television image signal of the channel as selected;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

said predetermined display period is 8.3 [ms]; and a response time when the liquid crystal panel is set to a temperature of 5° C. is selected to be longer than 0 ms and not longer than 6.3 ms, wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

16. A liquid crystal television provided with i) a liquid crystal display apparatus, and ii) a tuner section, which servers as an image signal source of said liquid crystal display apparatus, for selecting a channel of a television transmission signal and outputting as a display signal, a television image signal of the channel as selected;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal; and an achievement ratio after one period is in a range of from 90% to 100% when said liquid crystal panel is set to a temperature of 5° C., and the second last data signal indicates a maximum luminance display, and the last data signal indicates a minimum luminance display, wherein the achievement ratio indicates a ratio of a luminance actually displayed in a pixel of the liquid crystal panel with respect to the luminance indicated by the last data signal, and the achievement ratio after one period indicates an achievement ratio directly before inputting the current panel signal in a period after the last panel signal is input.

17. A liquid crystal television provided with i) a liquid crystal display apparatus, and ii) a tuner section, which servers as an image signal source of said liquid crystal display apparatus, for selecting a channel of a television transmission signal and outputting as a display signal, a television image signal of the channel as selected;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal; and said predetermined display period is 16.7 [ms]; and $d2\cdot\gamma/\Delta V$ is selected to be larger than 0 and not larger than $56\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

18. A liquid crystal television provided with i) a liquid crystal display apparatus, and ii) a tuner section, which servers as an image signal source of said liquid crystal display apparatus, for selecting a channel of a television transmission signal and outputting as a display signal, a television image signal of the channel as selected;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

said display predetermined display period is 16.7 [ms]; and a response time when the liquid crystal panel is set to a temperature of 5° C. is selected to be longer than 0 ms and not longer than 17.8 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

19. A liquid crystal television provided with i) a liquid crystal display apparatus, and ii) a tuner section, which servers as an image signal source of said liquid crystal display apparatus, for selecting a channel of a television transmission signal and outputting as a display signal, a television image signal of the channel as selected;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

said predetermined display period is 8.3 [ms]; and $d2\cdot\gamma/\Delta V$ is selected to be larger than 0 and not larger than $29\times10^{-6}$ [$mm^4/(V\cdot s)$] wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

20. A liquid crystal television provided with i) a liquid crystal display apparatus, and ii) a tuner section, which servers as an image signal source of said liquid crystal display apparatus, for selecting a channel of a television transmission signal and outputting as a display signal, a television image signal of the channel as selected;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

said predetermined display period is 8.3 [ms]; and a response time when the liquid crystal panel is set to a temperature of 5° C. is selected to be longer than 0 ms and not longer than 8.3 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

21. A liquid crystal monitor provided with i) a liquid crystal display apparatus, and ii) a signal processing section, which serves as an image signal source of said liquid crystal display apparatus, for processing a monitor signal indicative of an image to be displayed on a liquid crystal panel and outputting as a display signal, the monitor signal as processed;

said liquid crystal display apparatus comprising i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and an achievement ratio after one period is in a range of from 95% to 100% when said liquid crystal panel is set to a temperature of 5° C., and the second last data signal indicates a maximum luminance display, and the last data signal indicates a minimum luminance display, wherein the achievement ratio indicates a ratio of a luminance actually displayed in a pixel of the liquid crystal panel with respect to the luminance indicated by the last data signal, and the achievement ratio after one period indicates an achievement ratio directly before inputting the current panel signal in a period after the last panel signal is input.

22. A liquid crystal monitor provided with i) a liquid crystal display apparatus, and ii) a signal processing section, which serves as an image signal source of said liquid crystal display apparatus, for processing a monitor signal indicative of an image to be displayed on a liquid crystal panel and outputting as a display signal, the monitor signal as processed;

said liquid crystal display apparatus comprising i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal; and said predetermined display period is 16.7 [ms]; and $d2\cdot\gamma/\Delta V$ is selected to be larger than 0 and not larger than $41\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of said liquid crystal layer in said liquid crystal panel, and ΔV [V] indicates a difference in liquid crystal layer application voltage between a maximum luminance display and a minimum luminance display.

23. A liquid crystal monitor provided with i) a liquid crystal display apparatus, and ii) a signal processing section, which serves as an image signal source of said liquid crystal display apparatus, for processing a monitor signal indicative of an image to be displayed on a liquid crystal panel and outputting as a display signal, the monitor signal as processed;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

said predetermined display period is 16.7 [ms]; and $d2\cdot\gamma/\Delta V$ is selected to be larger than 0 and not larger than $41\times10^{-6}$ [$mm^4/(V\cdot s)$], wherein γ [$mm^2/s$] indicates a flow viscosity when the liquid crystal panel is set to a temperature of 5° C., d [μm] indicates a thickness of said liquid crystal layer in said liquid crystal panel, and ΔV [V] indicates a difference in liquid crystal layer application voltage between a maximum luminance display and a minimum luminance display.

24. A liquid crystal monitor provided with i) a liquid crystal display apparatus, and ii) a signal processing section, which serves as an image signal source of said liquid crystal display apparatus, for processing a monitor signal indicative of an image to be displayed on a liquid crystal panel and outputting as a display signal, the monitor signal as processed;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

said predetermined display period is 8.3 [ms]; and $d2\cdot\gamma/\Delta V$ is selected to be larger than 0 and not larger than $17\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

25. A liquid crystal monitor provided with i) a liquid crystal display apparatus, and ii) a signal processing section, which serves as an image signal source of said liquid crystal display apparatus, for processing a monitor signal indicative of an image to be displayed on a liquid crystal panel and outputting as a display signal, the monitor signal as processed;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to such a degree that for an actual luminance of the pixel, the luminance indicated by the current data signal can be attained by writing the current panel signal in a state where a luminance level of the pixel of the liquid crystal panel has reached the luminance indicated by the last data signal by writing the second last panel signal and the last panel signal;

said predetermined display period is 8.3 [ms]; and a response time when the liquid crystal panel is set to a temperature of 5° C. is selected to be longer than 0 ms and not longer than 6.3 ms, wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

26. A liquid crystal monitor provided with i) a liquid crystal display apparatus, and ii) a signal processing section, which serves as an image signal source of said liquid crystal display apparatus, for processing a monitor signal indicative of an image to be displayed on a liquid crystal panel and outputting as a display signal, the monitor signal as processed;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal; and an achievement ratio after one period is in a range of from 90% to 100% when said liquid crystal panel is set to a temperature of 5° C., and the second last data signal indicates a maximum luminance display, and the last data signal indicates a minimum luminance display, wherein the achievement ratio indicates a ratio of a luminance actually displayed in a pixel of the liquid crystal panel with respect to the luminance indicated by the last data signal, and the achievement ratio after one period indicates an achievement ratio directly before inputting the current panel signal in a period after the last panel signal is input.

27. A liquid crystal monitor provided with i) a liquid crystal display apparatus, and ii) a signal processing section, which serves as an image signal source of said liquid crystal display apparatus, for processing a monitor signal indicative of an image to be displayed on a liquid crystal panel and outputting as a display signal, the monitor signal as processed;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

said predetermined display period is 16.7 [ms]; and $d2\cdot\gamma/\Delta V$ is selected to be larger than 0 and not larger than $56\times10^{-6}$ [$mm^4/(V\cdot s)$], wherein $\gamma$ [$mm^2/s$] indicates a flow viscosity when the liquid crystal panel is set to a temperature of 5° C., d [μm] indicates a thickness of said liquid crystal layer in said liquid crystal panel, and $\Delta V$ [V] indicates a difference in liquid crystal layer application voltage between a maximum luminance display and a minimum luminance display.

28. A liquid crystal monitor provided with i) a liquid crystal display apparatus, and ii) a signal processing section, which serves as an image signal source of said liquid crystal display apparatus, for processing a monitor signal indicative of an image to be displayed on a liquid crystal panel and outputting as a display signal, the monitor signal as processed;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

said display predetermined display period is 16.7 [ms]; and a response time when the liquid crystal panel is set to a temperature of 5° C. is selected to be longer than 0 ms and not longer than 17.8 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

29. A liquid crystal monitor provided with i) a liquid crystal display apparatus, and ii) a signal processing section, which serves as an image signal source of said liquid crystal display apparatus, for processing a monitor signal indicative of an image to be displayed on a liquid crystal panel and outputting as a display signal, the monitor signal as processed;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel comprises a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the luminance indicated by the last data signal by writing the second last panel signal and the last panel signal;

said display predetermined display period is 16.7 [ms]; and a response time when the liquid crystal panel is set to a temperature of 5° C. is selected to be longer than 0 ms and not longer than 17.8 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

30. A liquid crystal monitor provided with i) a liquid crystal display apparatus, and ii) a signal processing section, which serves as an image signal source of said liquid crystal display apparatus, for processing a monitor signal indicative of an image to be displayed on a liquid crystal panel and outputting as a display signal, the monitor signal as processed;

said liquid crystal display apparatus comprising: i) a liquid crystal panel in which a display signal indicative of a luminance of each pixel is written at every predetermined display period, and ii) correction means for correcting the display signal to be written in said liquid crystal display panel by correcting the display signal which transmits therethrough, said correction means being provided in a transmission path of the display signal, which extends from an image signal source to said liquid crystal panel, wherein:

said liquid crystal panel includes a first substrate, a second substrate, and a liquid crystal layer formed between said first substrate and said second substrate;

in said liquid crystal panel, formed is a region made up of a plurality of pixels, said region being defined by a first electrode provided on said first substrate on the side of said liquid crystal layer, and a second electrode provided on said second substrate so as to face said first electrode via said liquid crystal layer, wherein a voltage corresponding to the display signal is applied across said first electrode and said second electrode;

liquid crystal molecules of said liquid crystal layer are vertically aligned without an application of a voltage across said first electrode and said second electrode, and are inclined from a vertical alignment with an application of a voltage across said first electrode and said second electrode;

a luminance, which is indicative of a current panel signal when the luminance indicated by the current data signal has changed from a luminance indicated by a last data signal, is corrected by said correction means, so as to more facilitate a gradation transition from the luminance indicated by the last data signal to the luminance indicated by the current data signal, as compared to a luminance, which is indicated by the current panel signal when the luminance indicated by the current data signal is identical with the luminance indicated by the last data signal, wherein a) the current signal indicates a display signal to be written in each pixel in a current display period of said liquid crystal panel, b) the last panel signal and a second last panel signal respectively indicate display signals to be written in the last display period and second last display period in the same pixel as that in the current display period, and c) the current data signal, the last data signal and a second last data signal respectively indicate display signals corresponding to the current panel signal, the last panel signal and the second last panel signal among display signals to be input to said correction means;

the gradation transition is facilitated by said correction means to a degree lower than a degree that permits for an actual luminance of the pixel to attain the luminance indicated by the current data signal by writing the current panel signal in a state where a luminance level of the pixel of the liquid crystal panel has reached the illuminance indicated by the last data signal by writing the second last panel signal and the last panel signal;

said predetermined display period is 8.3 [ms]; and a response time when the liquid crystal panel is set to a temperature of 5° C. is selected to be longer than 0 ms and not longer than 8.3 ms wherein the response time indicates a time required for a luminance of a pixel in which the current panel signal is written, to change from 100% to 10% under such conditions that the luminance at a maximum luminance display is 100%, a luminance at a minimum luminance display is 0%, the last panel signal indicates a maximum luminance, and the current panel signal indicates a minimum luminance.

* * * * *